US009609913B2

(12) United States Patent
Bates et al.

(10) Patent No.: US 9,609,913 B2
(45) Date of Patent: Apr. 4, 2017

(54) SOLE AND ARTICLE OF FOOTWEAR HAVING A POD ASSEMBY

(71) Applicant: Reebok International Limited, London (GB)

(72) Inventors: Paul Bates, Somerset, MA (US); Paul E. Litchfield, Westboro, MA (US); David Lacorazza, Norwell, MA (US); William McInnis, Westwood, MA (US)

(73) Assignee: Reebok International Limited, London (GB)

( * ) Notice: Subject to any disclaimer, the term of this patent is extended or adjusted under 35 U.S.C. 154(b) by 883 days.

(21) Appl. No.: 13/841,012

(22) Filed: Mar. 15, 2013

(65) Prior Publication Data

US 2013/0212909 A1 Aug. 22, 2013

Related U.S. Application Data

(63) Continuation-in-part of application No. 13/339,583, filed on Dec. 29, 2011, which is a continuation-in-part of application No. 13/339,592, filed on Dec. 29, 2011.

(51) Int. Cl.
*A43B 13/18* (2006.01)
*A43B 13/20* (2006.01)

(52) U.S. Cl.
CPC ..... *A43B 13/189* (2013.01); *A43B 13/184* (2013.01); *A43B 13/20* (2013.01)

(58) Field of Classification Search
CPC ..... A43B 13/00; A43B 13/14; A43B 13/184; A43B 13/189; A43B 13/20; A43B 13/2016; A43B 13/206
USPC ..... 36/25 R, 28, 29, 103
See application file for complete search history.

(56) References Cited

U.S. PATENT DOCUMENTS

| | | | |
|---|---|---|---|
| 1,344,972 | A | 6/1920 | Armour |
| 2,090,881 | A | 4/1936 | Wilson |
| 4,112,599 | A | 9/1978 | Krippelz |
| 4,345,387 | A | 8/1982 | Daswick |
| 4,358,902 | A | 11/1982 | Cole et al. |

(Continued)

FOREIGN PATENT DOCUMENTS

| | | | |
|---|---|---|---|
| GB | 2 201 082 | A | 8/1988 |
| WO | WO 98/09546 | A1 | 3/1998 |
| WO | WO 01/19211 | A1 | 3/2011 |

OTHER PUBLICATIONS

European Search Report for European Application No. 12199619.3, European Patent Office, The Netherlands, dated Apr. 24, 2013, 6 pages.

*Primary Examiner* — Sharon M Prange
(74) *Attorney, Agent, or Firm* — Sterne, Kessler, Goldstein & Fox P.L.L.C.

(57) ABSTRACT

A sole for an article of footwear includes: a foam base; a lateral pod assembly having a plurality of pods fluidly connected in series disposed below the foam base, wherein the lateral pod assembly extends from a heel portion of the sole to a forefoot portion of the sole along a lateral side of the sole; and a medial pod assembly having a plurality of pods fluidly connected in series disposed below the foam base, wherein the medial pod assembly extends from a heel portion of the sole to a forefoot portion of the sole along a medial side of the sole, wherein a portion of the foam base extends between the lateral pod assembly and the medial pod assembly.

23 Claims, 47 Drawing Sheets

(56) References Cited

U.S. PATENT DOCUMENTS

| | | | | |
|---|---|---|---|---|
| 4,577,417 | A | 3/1986 | Cole | |
| 4,763,426 | A | 8/1988 | Polus et al. | |
| D315,634 | S | 3/1991 | Yung-Mao | |
| 4,999,931 | A | 3/1991 | Vermeulen | |
| 5,195,257 | A | 3/1993 | Holcomb et al. | |
| 5,375,346 | A | 12/1994 | Cole et al. | |
| 5,395,674 | A | 3/1995 | Schmidt et al. | |
| 5,406,719 | A | 4/1995 | Potter | |
| 5,416,986 | A | 5/1995 | Cole et al. | |
| 5,664,341 | A | 9/1997 | Schmidt et al. | |
| 5,679,439 | A | 10/1997 | Schmidt et al. | |
| 5,701,687 | A | 12/1997 | Schmidt et al. | |
| 5,753,061 | A | 5/1998 | Rudy | |
| 5,771,606 | A | 6/1998 | Litchfield et al. | |
| 5,794,359 | A | 8/1998 | Jenkins | |
| 5,826,349 | A * | 10/1998 | Goss | 36/3 R |
| 5,842,291 | A * | 12/1998 | Schmidt et al. | 36/29 |
| 5,916,664 | A | 6/1999 | Rudy | |
| 6,018,889 | A | 2/2000 | Friton | |
| 6,158,149 | A * | 12/2000 | Rudy | 36/29 |
| 6,266,897 | B1 | 7/2001 | Seydel et al. | |
| 6,453,577 | B1 | 9/2002 | Litchfield et al. | |
| 6,516,540 | B2 | 2/2003 | Seydel et al. | |
| 6,845,573 | B2 | 1/2005 | Litchfield et al. | |
| 6,915,594 | B2 * | 7/2005 | Kim | 36/29 |
| 7,181,867 | B2 | 2/2007 | Litchfield et al. | |
| 7,430,817 | B2 * | 10/2008 | Abadjian et al. | 36/29 |
| 7,475,498 | B2 | 1/2009 | Litchfield et al. | |
| 7,784,196 | B1 | 8/2010 | Christensen et al. | |
| 7,797,856 | B2 | 9/2010 | Andrews et al. | |
| 7,930,839 | B2 | 4/2011 | Litchfield et al. | |
| 2009/0165333 | A1 | 7/2009 | Litchfield et al. | |
| 2012/0048663 | A1 * | 3/2012 | McDonnell | 188/266 |
| 2012/0073160 | A1 * | 3/2012 | Marvin et al. | 36/28 |
| 2012/0233885 | A1 * | 9/2012 | Shaffer et al. | 36/103 |
| 2013/0167401 | A1 | 7/2013 | Christensen et al. | |

* cited by examiner

SOLE AND ARTICLE OF FOOTWEAR HAVING A POD ASSEMBY

CROSS-REFERENCE TO RELATED APPLICATIONS

This application is a continuation-in-part of U.S. patent application Ser. No. 13/339,583, filed on Dec. 29, 2011 and entitled "Sole and Article of Footwear Having a Pod Assembly," the disclosure of which is incorporated herein in its entirety by reference thereto. The application also claims priority to U.S. patent application Ser. No. 13/339,592, filed on Dec. 29, 2011 and entitled "Sole and Article of Footwear Having a Pod Assembly," the disclosure of which also is incorporated herein in its entirety by reference thereto.

BACKGROUND OF THE INVENTION

Field of the Invention

Embodiments of the present invention generally relate to footwear, and more particularly relate to a sole and article of footwear having a pod assembly.

Background Art

Individuals are often concerned with the amount of cushioning an article of footwear provides, as well as the aesthetic appeal of the article of footwear. This is true for articles of footwear worn for non-performance activities, such as a leisurely stroll, and for performance activities, such as running, because throughout the course of an average day, the feet and legs of an individual are subjected to substantial impact forces. When an article of footwear contacts a surface, considerable forces may act on the article of footwear and, correspondingly, the wearer's foot. The sole functions, in part, to cushion to the wearer's foot and to protect it from these forces. To achieve adequate cushioning, many footwear soles are relatively thick and heavy. When sole size and/or weight are reduced to achieve other performance goals, protection of the wearer's foot is often compromised.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, a typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the Achilles tendon and the arch stretch and contract, storing and releasing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during every day activity. Unless an individual is wearing shoes which provide proper cushioning and support, the soreness and fatigue associated with every day activity is more acute, and its onset accelerated. The discomfort for the wearer that results may diminish the incentive for further activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole (typically including an outsole, midsole and insole) which absorbs shocks. Therefore, a continuing need exists for innovations in providing cushioning to articles of footwear.

BRIEF SUMMARY OF THE INVENTION

In one embodiment, a sole for an article of footwear includes: a foam base; a lateral pod assembly having a plurality of pods fluidly connected in series disposed below the foam base, wherein the lateral pod assembly extends from a heel portion of the sole to a forefoot portion of the sole along a lateral side of the sole; and a medial pod assembly having a plurality of pods fluidly connected in series disposed below the foam base, wherein the medial pod assembly extends from a heel portion of the sole to a forefoot portion of the sole along a medial side of the sole, wherein a portion of the foam base extends between the lateral pod assembly and the medial pod assembly.

In another embodiment, a sole for an article of footwear includes: an upper sole having a base with a heel region, a midfoot region, and a toe region; a first pod assembly disposed below the upper sole portion, the first pod assembly having at least five pods fluidly connected in series extending from the heel region to the toe region; and a second pod assembly disposed below the upper sole portion, the second pod assembly having at least five pods fluidly connected in series extending from the heel region to the toe region, wherein a portion of the upper sole from the midfoot region to the toe region extends from the base between the first pod assembly and the second pod assembly.

In yet another embodiment, an article of footwear includes: an upper; and a sole coupled to the upper, the sole including: a base with a heel region, a midfoot region, and a toe region; a lateral pod assembly disposed below the upper sole portion, the lateral pod assembly having at least five pods fluidly connected in series extending from the heel region to the toe region along an outer lateral side of the sole; and a medial pod assembly disposed below the upper sole portion, the medial pod assembly having at least five pods fluidly connected in series extending from the heel region to the toe region along an outer medial side of the sole, wherein a portion of the sole extends from the base from the midfoot region to the toe region between the lateral pod assembly and the medial pod assembly.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
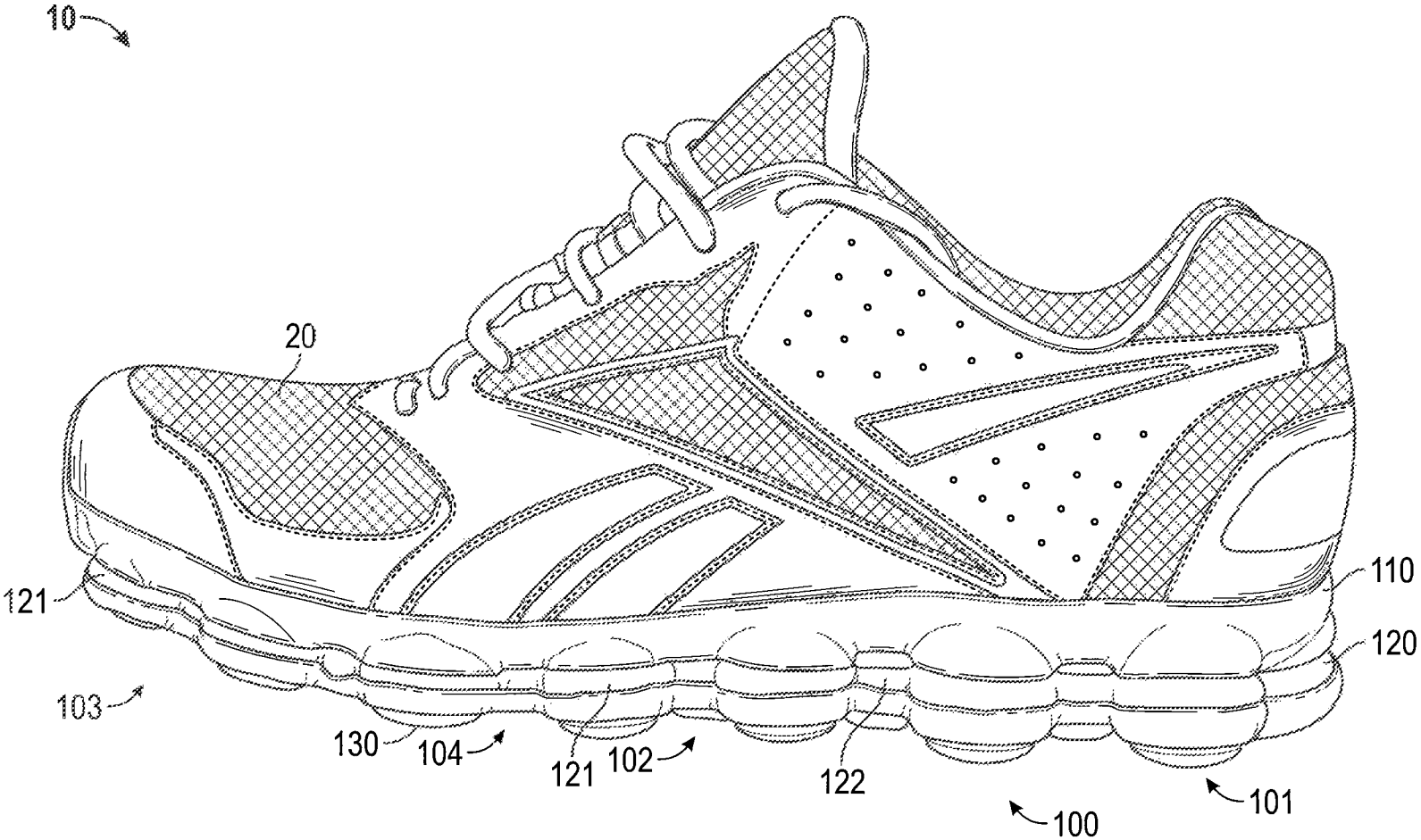
FIG. 1 is a lateral side view of an exemplary article of footwear according to an embodiment of the present invention.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic.

Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Embodiments of the present invention include an article of footwear 10 having an upper 20 and a sole 100 coupled to the upper 20. With reference to FIG. 1, the sole 100 includes an upper sole portion 110 coupled to the upper 20 and a pod assembly 120 disposed below the upper sole portion 110. The sole 100 includes a heel region 101, a midfoot or arch region 102, and a forefoot region 103. A lower sole portion 130 is disposed below the pod assembly 120. In some embodiments, one or more of the upper sole portion 110, the pod assembly 120, and/or the lower sole portion 130 may be adapted to provide particular ride features including, but not limited to, appropriate cushioning to the wearer's foot.

Figure 2:
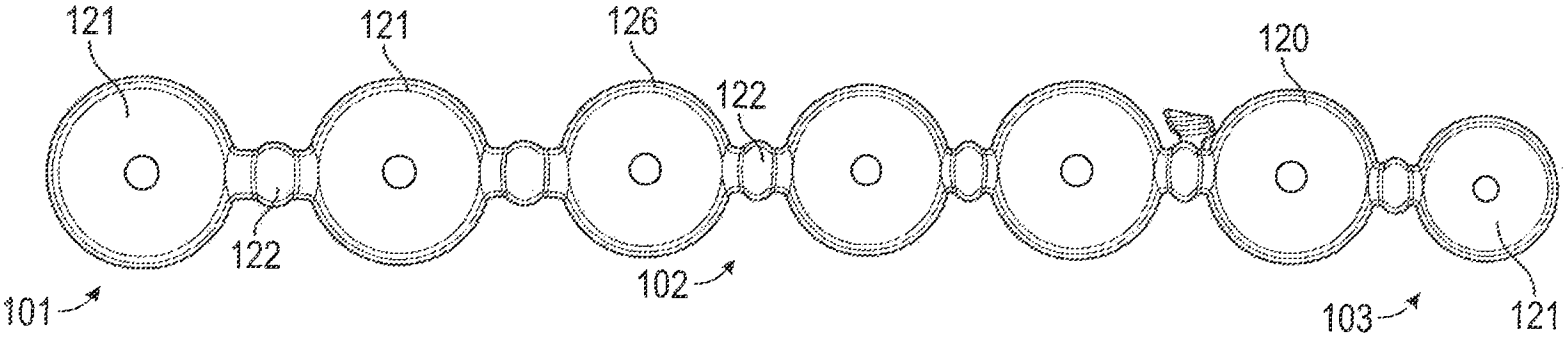
FIG. 2 is a plan view of a pod assembly according to an embodiment of the present invention.
Figure 3:
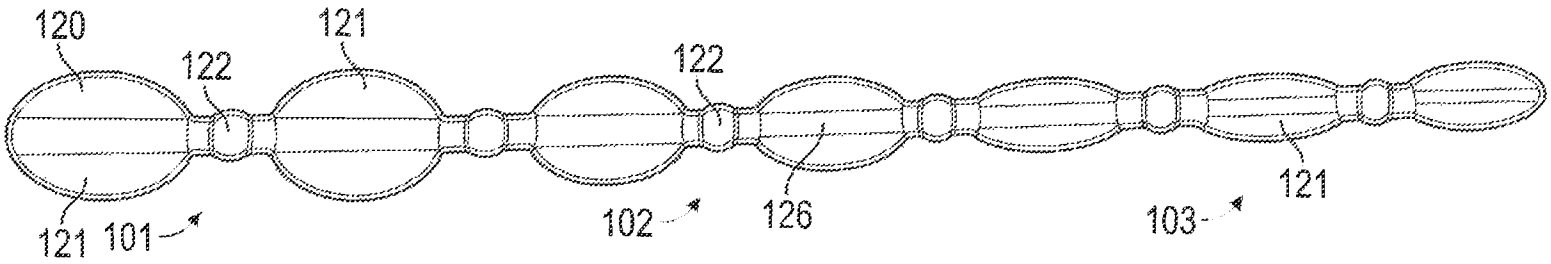
FIG. 3 is a side view of a pod assembly according to an embodiment of the present invention.

In one embodiment, as shown, for example, in FIGS. 1-3, the pod assembly 120 is hollow and includes a plurality of pods 121 fluidly connected by a passageway 122. In one embodiment, fluid passageway 122 fluidly connects two pods 121 to permit a contained material to flow between the pods in response to forces applied to the bottom of the wearer's foot. In one embodiment, the pod assembly 120 is filled with air at ambient pressure. In other embodiments, the pod assembly 120 may be filled with a fluid (e.g., a liquid or a gas such as ambient or pressurized air at a pressure greater than ambient air); a gel; a paste; particles (e.g., polymer particles, foam particles, cellulose particles, rock or mineral particles, rubber particles, and the like), or a combination thereof. In some embodiments, the pod assembly 120 and the flow of material (e.g., ambient air) therein may provide appropriate cushioning to the wearer's foot. The pod assembly 120 may provide continuous cushioning to the wearer's foot, such that a wearer's stride forces the material (e.g., ambient air) within the pod assembly to flow in a manner complementary with respect to the wearer's stride and the application of forces to the anatomical structure of the foot.

Figure 4:
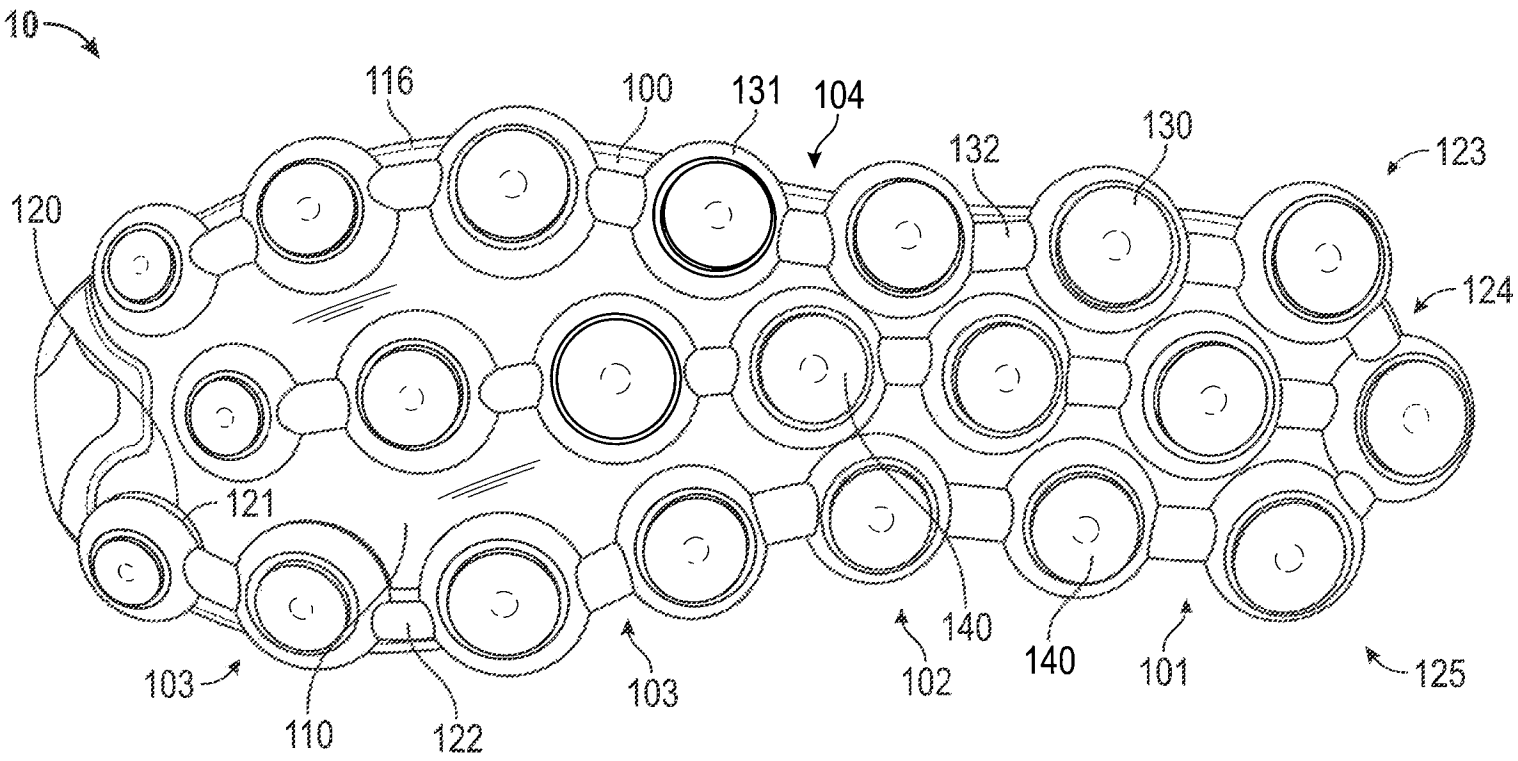
FIG. 4 is a bottom view of the exemplary article of footwear of FIG. 1 according to an embodiment of the present invention.

In one embodiment, as shown, for example, in FIGS. 1-4, the pod assembly 120 includes a plurality of pods 121 fluidly connected in a substantially linear arrangement. In this manner, the pod assembly 120 may be generally long and narrow (e.g., having a greater length than width) and, in this manner, may comprise a pod strip. As shown in FIGS. 1 and 4, for example, the pod assembly 120 may extend from the heel region 101 to the toe region 102 of the sole 100. In one embodiment, the plurality of pods 121 are fluidly connected in series and may be directly connected only to one or two immediately adjacent pods 121. For example, as best shown in FIGS. 2 and 3, the pods 121 disposed at the forward most end and rear most end of the pod assembly 120 are directly connected only to one immediately adjacent pod 121 by a fluid passageway 122. In one embodiment, the pod assembly 120 includes only two end pods. The remaining pods 121 disposed between the end pods are directly connected only to two immediately adjacent pods 121 (one forward and one rearward) to provide a substantially linear arrangement.

In some embodiments, no portion of any pod 121 in the pod assembly 120 overlaps with a portion of another pod 121 in the pod assembly 120. For example, for each pod 121, the center point of a cross-sectional area of the pod is forward and/or rearward of the center point of any pods to which the pod 121 is directly connected. In one embodiment, for each pod 121, any portion of the outer edge 126 of a pod 121 is forward and/or rearward of any portion of the outer edge 126 of any pods to which the pod 121 is directly connected. In some embodiments, the center points of three or more pods 121 in the pod assembly are aligned such that an axis drawn through the center points forms a line. In some embodiments, a pod assembly 120 having a substantially linear arrangement may include some curvature.

The number, size, and shape of the pods 121 of the pod assembly 120 may be varied to provide the desired ride characteristics. In one embodiment, the pod assembly 120 includes at least five pods connected in a substantially linear arrangement. In one embodiment, the pod assembly 120 includes at least six pods. In one embodiment, the pod assembly 120 includes seven pods. In one embodiment, the pod assembly 120 includes greater than seven pods. In one embodiment, one or more pods 121 are circular and have a circular cross-section, as shown, for example, in FIG. 2. Other shapes, including but not limited to, square, rectangular, quadrilateral, hexagonal, elliptical, and any other suitable shape may be used. In one embodiment, the size (e.g., width and height) of the pods 121 in the pod assembly may vary. For example, in one embodiment, the diameter and/or width of the pods 121 may generally decrease from the heel region 101 to the forefoot region 103. In other embodiments, at least two of the pods 121 have generally the same diameter and/or width. For example, in some embodiments, at least adjacent two pods 121, oriented along the length of the sole from heel region 101 to the forefoot region 103, have generally the same diameter and/or width. In one embodiment, the height of the pods 121 may generally decrease from the heel region 101 to the forefoot region 103. In other embodiments, at least two of the pods 121 have generally the same height. For example, in some embodiments, at least adjacent two pods 121, oriented along the length of the sole from heel region 101 to the forefoot region 103, have generally the same height. In some embodiments, at least two of the pods 121 have generally the same volume. For example, in some embodiments, at least adjacent two pods 121, oriented along the length of the sole from heel region 101 to the forefoot region 103, have generally the same volume. In one embodiment, generally larger (e.g., diameter, width, volume, or height) pods 121 may be disposed in the heel region 101 to provide for increased cushioning at the point of heel strike. In other embodiments, generally larger (e.g., diameter, width, volume, or height) pods 121 may be disposed in the forefoot region 103. In yet other embodiments, generally larger (e.g., diameter, width, volume, or height) pods 121 may be disposed in both the heel region 101 and in the forefoot region 103.

Figure 9:
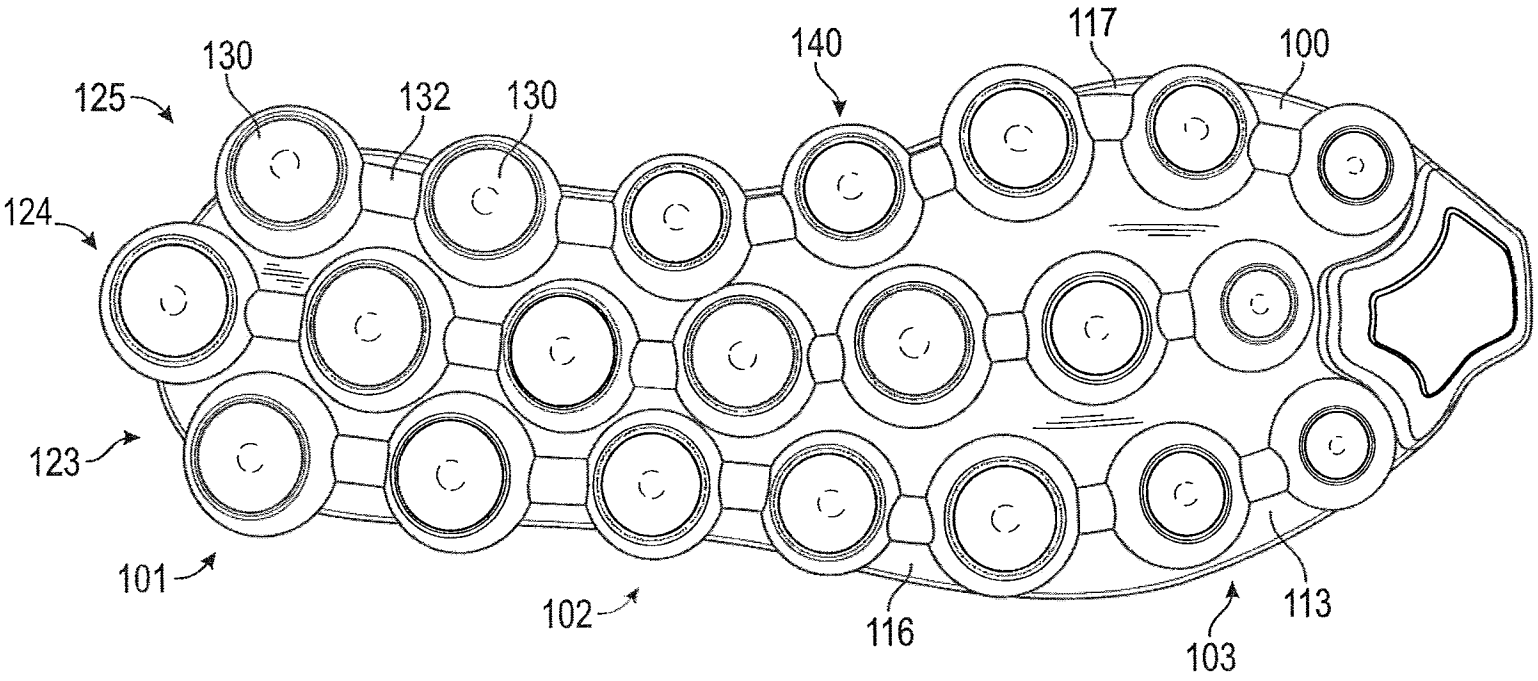
FIG. 9 is a bottom view of a sole according to an embodiment of the present invention.

The sole 100 may include one or more pod assemblies 120. In one embodiment, as shown, for example, in FIG. 4, the sole 100 may include a lateral pod assembly 123 disposed along a lateral side 104 of the sole 100, a medial pod assembly 125 disposed along a medial side 105 of the sole 100, and an intermediate pod assembly 124 disposed in between the lateral pod assembly 123 and the medial pod assembly 125. In one embodiment, the lateral pod assembly 123 extends along the outer lateral edge 116 of the sole 100, and the medial pod assembly 125 extends along the outer medial edge 117 of the sole 100, as shown, for example, in FIGS. 4 and 9. In one embodiment, as shown, for example, in FIGS. 4 and 9, the lateral pod assembly 123, medial pod assembly 125, and intermediate pod assembly 124 extend from the heel region 101 to the forefoot region 103 of the sole. In one embodiment, the lateral pod assembly 123, medial pod assembly 125, and intermediate pod assembly 124 are not fluidly connected. In another embodiment, two or more of the pod assemblies may be fluidly connected. In one embodiment, each pod assembly 120 includes the same number of pods 121.

The sole 100 may include other arrangements of one or more pod assemblies 120. In one embodiment, sole 100 may include a lateral pod assembly 123 and a medial pod assembly 125. A portion of sole 100, for example, extending from the upper sole portion 110, may extend between the lateral pod assembly 123 and a medial pod assembly 125. In one embodiment, the sole may include only a lateral pod assembly 123 or a medial pod assembly 125. In one embodiment, one or more of the lateral pod assembly 123, medial pod assembly 125, and intermediate pod assembly 124 may extend all or a portion of the length of sole 100. For example, in one embodiment, one or more of the lateral pod assembly 123, medial pod assembly 125, and intermediate pod assembly 124 may extend from the heel region 101 to the midfoot region 102. In one embodiment, one or more of the lateral pod assembly 123, medial pod assembly 125, and intermediate pod assembly 124 may extend from the midfoot region 102 to the forefoot portion 103.

The pod assembly 120 may be formed of a suitably resilient material so that it may compress with the application of force and expand with the delivery of a material (e.g., a fluid, a gel, a paste, or flowable particles), while also resisting breakdown. In one embodiment, pod assembly 120 may be formed of a polymer such as an elastomer and can be formed using any of various molding techniques known in the art. For example, pod assembly 120 may be blow molded, such as by injection blow molding or stretch blow molding. Further, other manufacturing methods can be used to form pod assembly 120, such as thermoforming and sealing, injection molding and sealing, vacuum forming and sealing or radio frequency (RF)/high frequency (HF) welding. The pod assembly may be coupled to the upper sole portion 110 and the lower sole portion 130 by adhesive bonding, welding, or other suitable technique.

Figure 5:
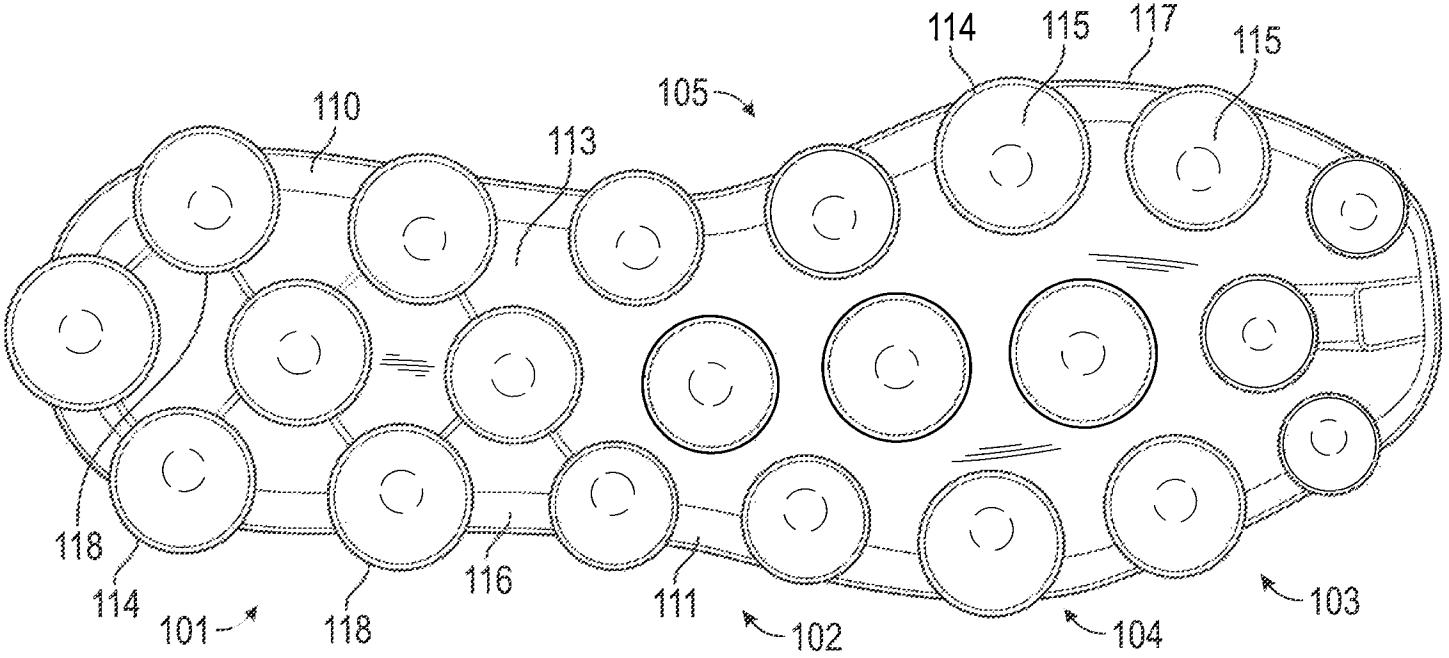
FIG. 5 is a bottom view of a portion of a sole according to an embodiment of the present invention.
Figure 10:
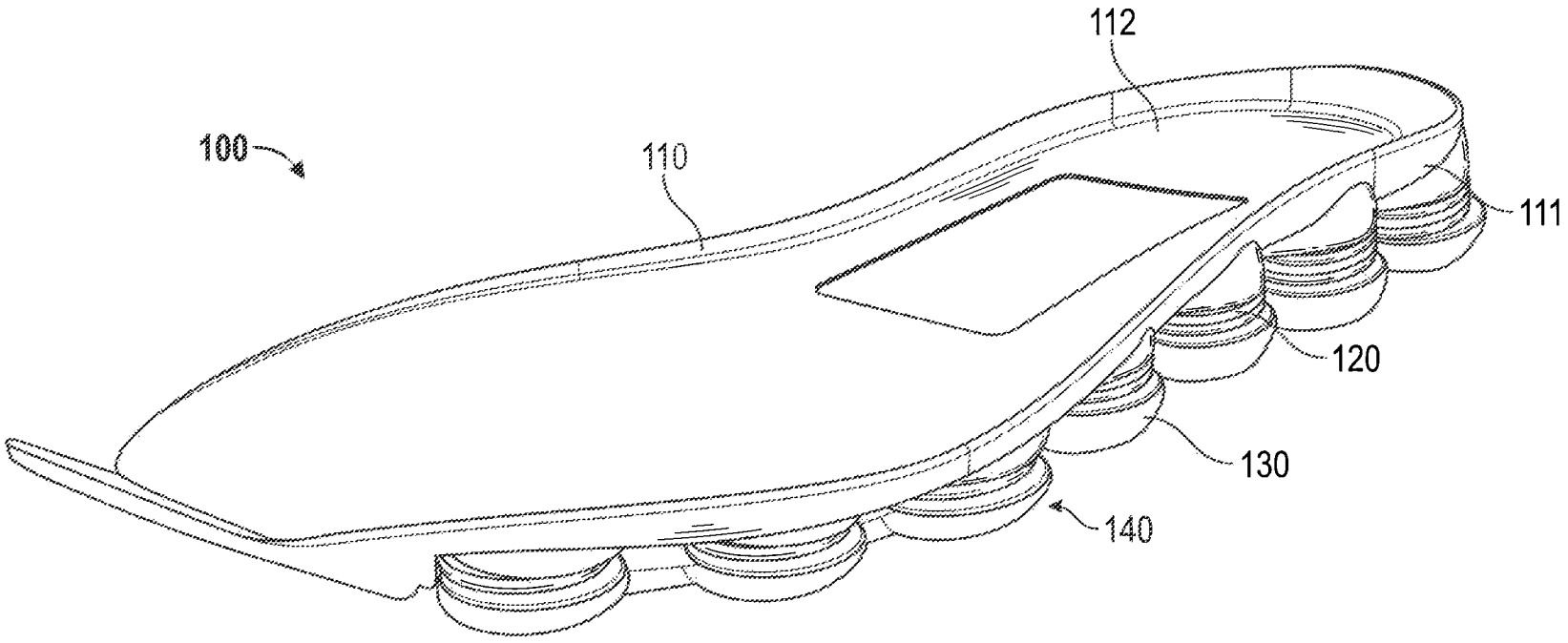
FIG. 10 is a perspective view of a sole according to an embodiment of the present invention.

With reference to FIG. 5, upper sole portion 110 may include a base 111 which may be attached to the upper 20 by adhesive bonding, welding, or other suitable technique. The upper sole portion. 110 may include a top surface 112 (as shown, for example, in FIGS. 10 and 11) generally shaped to accommodate the contours of the foot. One or more hubs 114 are formed in a bottom surface 113 of the base 111. The hubs 114 include a shoulder 118 which defines a cavity 115 for receiving a pod 121. As best shown, for example, in FIG. 8A, in one embodiment, the shoulder 118 may extend down over a top portion of the pod 121. The cavity 115 is sized and shaped to receive the pod 121. For example, in one embodiment, the cavity 115 is generally concave to receive a rounded surface of a pod. The hubs 114 are disposed on the base 111 in a manner that corresponds to the arrangement of the pod assembly 120. In this manner, in one embodiment, a plurality of hubs 114 may be formed in the bottom surface 113 of the base 111 in a substantially linear arrangement.

Figure 8A:
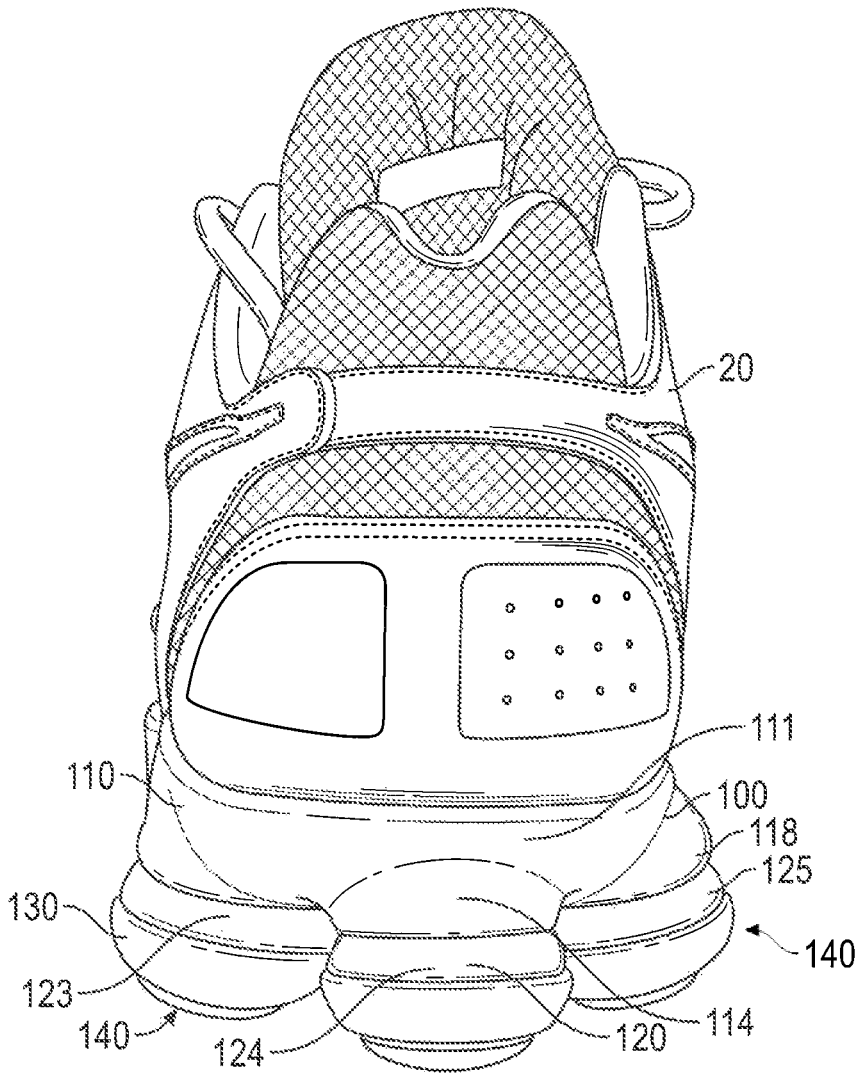
FIG. 8A is a rear view of an exemplary article of footwear according to an embodiment of the present invention.
Figure 8B:
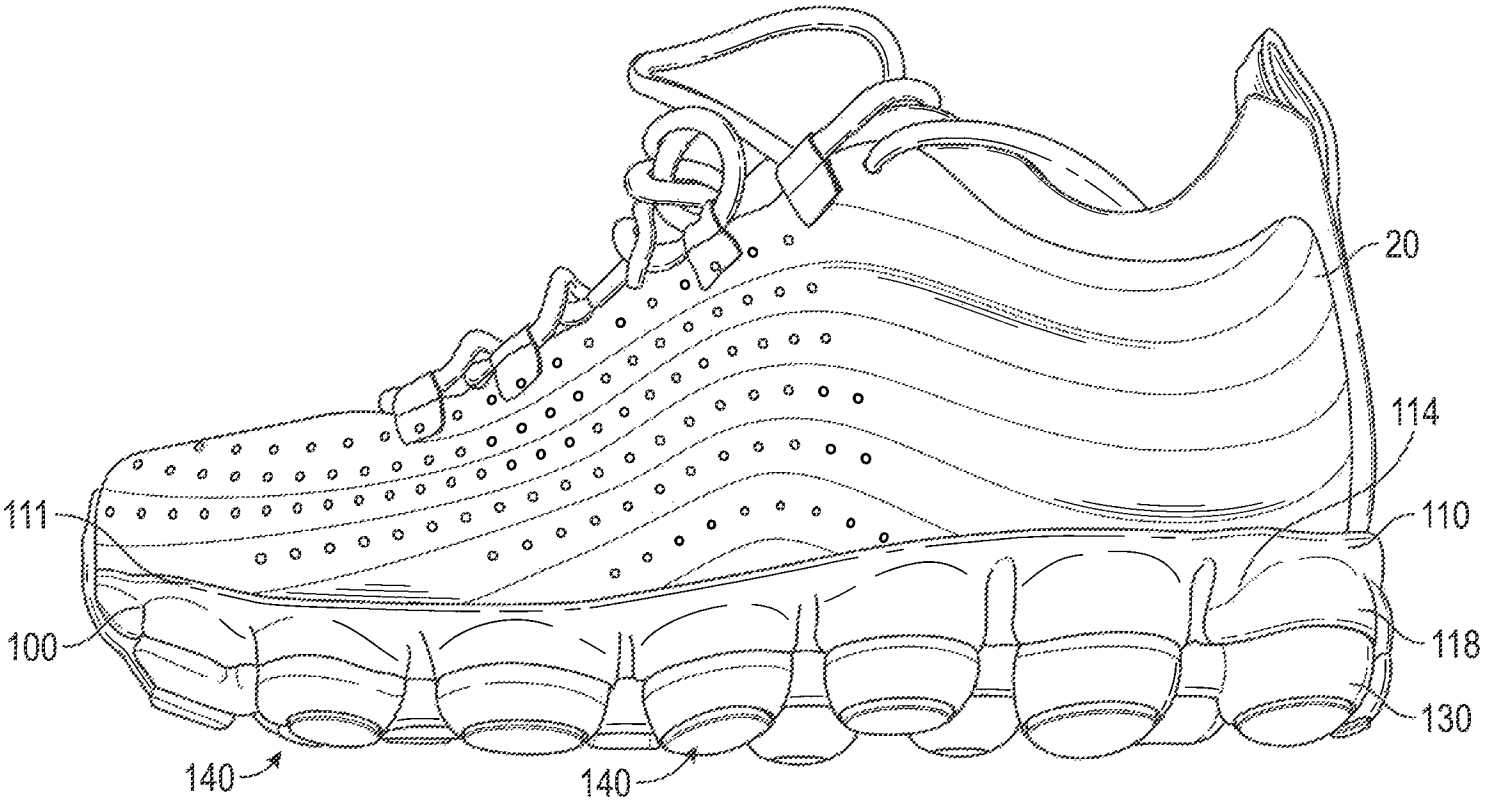
FIG. 8B is a lateral side view of an exemplary article of footwear having an encapsulated pod according to an embodiment of the present invention.

In one embodiment, all or a portion of one or more pod assemblies 120 may be visible from the exterior of the sole 100. For example, as shown in FIG. 8A, the shoulder 118 of the upper sole portion 110 extends down such that a portion of each of the lateral pod assembly 123, medial pod assembly 125, and intermediate pod assembly 124 is visible from the exterior of the sole 100. In this manner, the upper sole portion 110 and the lower sole portion 130 are decoupled. In some embodiments, this may allow the lower sole portion 130 to move independently of the upper sole portion 110 and the sole 100 may be adapted to provide particular ride features, including, but not limited to, providing a more fluid or soft feel to the wearer. In another embodiment, one or more pod assemblies 120 may not be visible. For example, as shown in FIG. 8B, the shoulder 118 of the upper sole portion 110 extends down to the lower sole portion 130 so as to encapsulate the pod 121.

Figure 6:
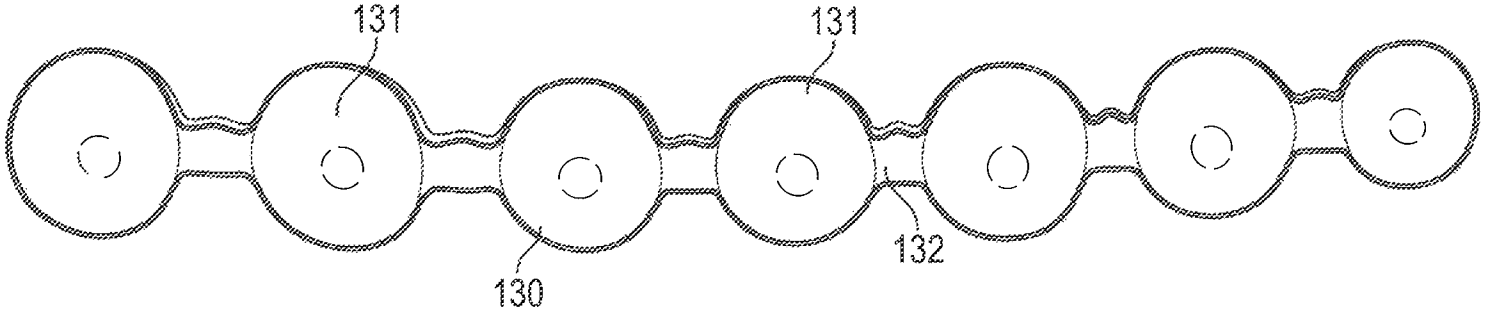
FIG. 6 is an interior perspective view of an outsole portion of a sole according to an embodiment of the present invention.
Figure 7:
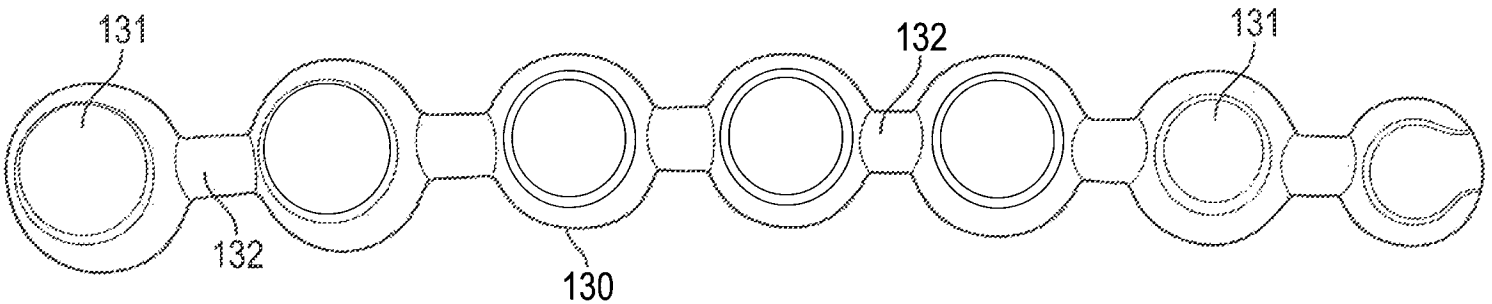
FIG. 7 is a bottom perspective view of an outsole portion of a sole according to an embodiment of the present invention.

With reference to FIGS. 6 and 7, in one embodiment lower sole portion 130 includes one or more pod covers 131 and one or more passageway portions 132. In one embodiment, the pod covers 131 have a concave, cup-like shape to snugly cover the pods 121. In some embodiments, lower sole portion 130 may comprise an outsole and may include a ground contacting surface.

The upper sole portion 110 and/or the lower sole portion 130 comprise material for providing the desired cushioning, ride, stability, and/or durability of the sole 100. Suitable material for the upper sole portion 110 and/or the lower sole portion 130 may include, but is not limited to, foam and thermoplastic polyurethane. When the upper sole portion 110 and/or the lower sole portion 130 comprise a foam, the foam may comprise, for example, ethyl vinyl acetate (EVA) based foam or polyurethane (PU) based foam and the foam may be an open-cell foam or a closed-cell foam. In other embodiments, the upper sole portion 110 and/or the lower sole portion 130 may comprise elastomers, thermoplastic elastomers (TPE), foam-like plastic, and gel-like plastics. In some embodiments, both the upper sole portion 110 and the lower sole portion 130 include the same material. In some embodiments, the lower sole portion comprises only outsole material. In one embodiment, an insole and/or sockliner may also be included within the shoe 10. In some embodiments, the sole 100 may include an insole and/or sockliner. In some embodiments, all or a portion of the lower sole portion 130 may comprise a wear-resistant material. For example, outsole material can include synthetic or natural rubber, thermoplastic polyurethane (TPU), a wear-resistant foam, or a combination thereof. In some embodiments, the sole 100 may be constructed out of one or more materials and may have zones of differing densities.

Figure 11:
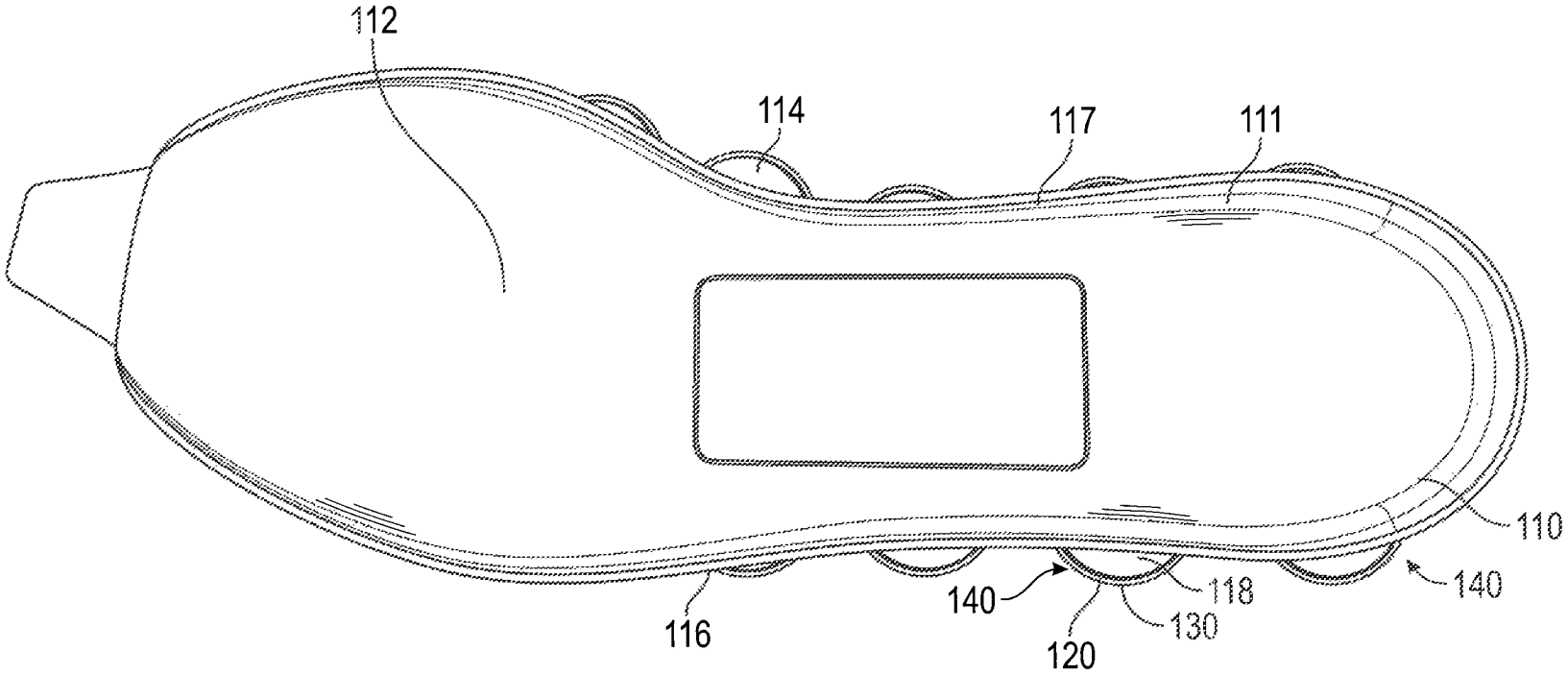
FIG. 11 is a top plan view of a sole according to an embodiment of the present invention.

In one embodiment, a pod 121, a hub 114 disposed above the pod 121, and the portion of the lower sole portion 130 disposed below the pod 121 form a projection assembly 140. In one embodiment, as shown, for example, in FIGS. 8 and 11, a plurality of projection assemblies 140 extend from the base 110 at a non-orthogonal angle. This arrangement may allow for movement of the projection assembly 140 relative to the base 110, which may provide for the desired cushioning and feel of the sole 100 to the user during a gait cycle. For example, this configuration may allow the projection assembly 140 to splay in multiple directions—outwardly from and inwardly toward the sole—when under a compressive load during use, and thereby allow for a tailored cushioning effect (e.g., allow for increased cushioning) and/or provide better overall ride of the footwear. In one embodiment, as best shown in FIG. 11, for example, a projection assembly 140 may extend from the base 110 at a non-orthogonal angle such that it extends beyond the lateral outer edge 116 or medial outer edge 117 of the sole 110. In some embodiments, the pod 121 may be positioned at an angle relative to vertical to provide the desired splay angle of the pod assembly 120.

Another embodiment of the present invention will now be described with reference to FIGS. 12-17 in which like reference numerals may refer to like elements. The embodiment may include some or all of the features described above in connection with the embodiments of FIGS. 1-11. The sole 100 includes a forefoot pod assembly 220 and a heel pod assembly 225 disposed below the upper sole portion 110 of the sole. The forefoot pod assembly 220 and the heel pod assembly 225 include a plurality of pods 221 fluidly connected by a passageway 222.

The number, size, arrangement, and shape of the pods 221 of the heel pod assembly 225 and the forefoot pod assembly 220 may be varied to provide the desired ride characteristics. In one embodiment, as shown, for example, in FIG. 15, the forefoot pod assembly 220 may include a plurality of pod strips of four or more pods 221. In one embodiment, the pod strips may be fluidly connected. In one embodiment, as shown, for example, in FIG. 16, the heel pod assembly 225 may include corrugated passageways 222 that fluidly connect adjacent pods. The corrugated passageways 222 create a flexible connection that enable a first upper pod 223 to be placed on top of a second lower pod 224 during assembly of the sole 100. In one embodiment, an intermediate sole portion 242 may be disposed between the upper pod 223 and the lower pod 224. The intermediate sole portion 242 may comprise a similar material as the upper sole portion 110 and/or the lower sole portion 130.

Figure 13:
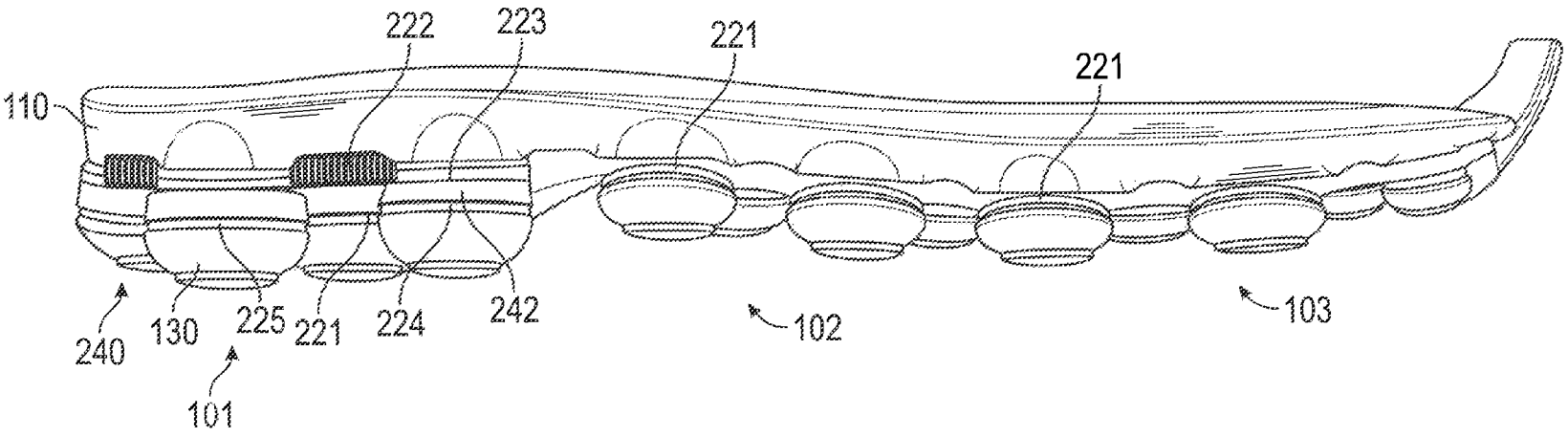
FIG. 13 is a side view of the sole of FIG. 12 according to an embodiment of the present invention.
Figure 14:
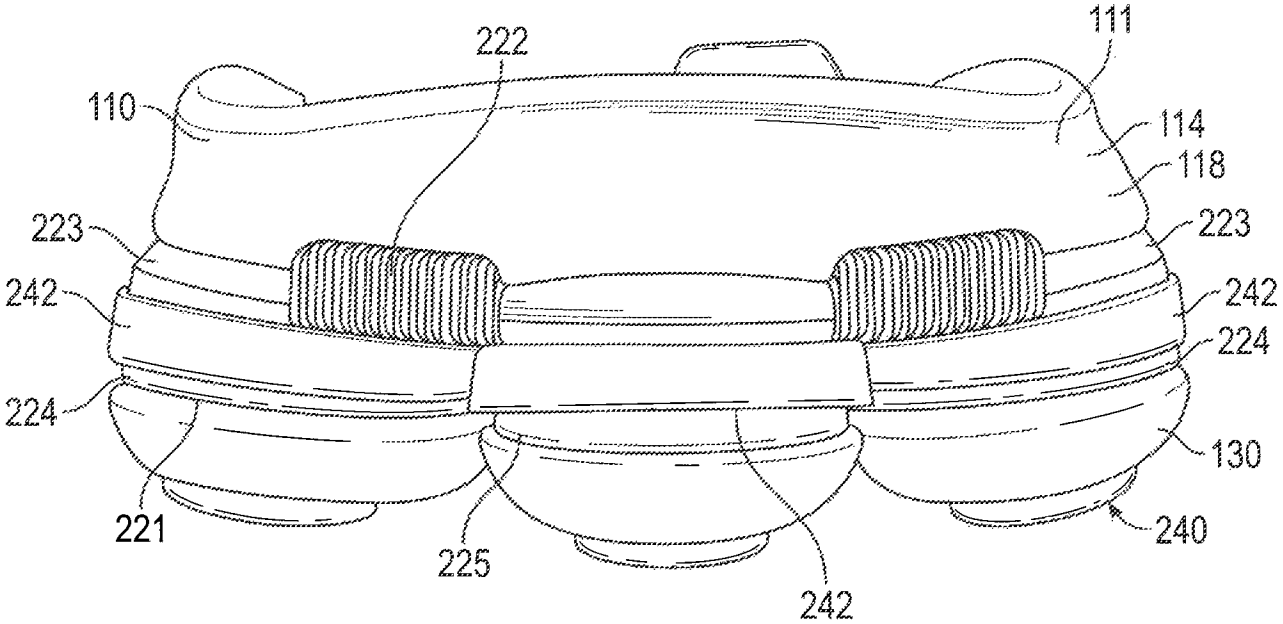
FIG. 14 is a rear view of the sole of FIG. 12 according to an embodiment of the present invention.
Figure 15:
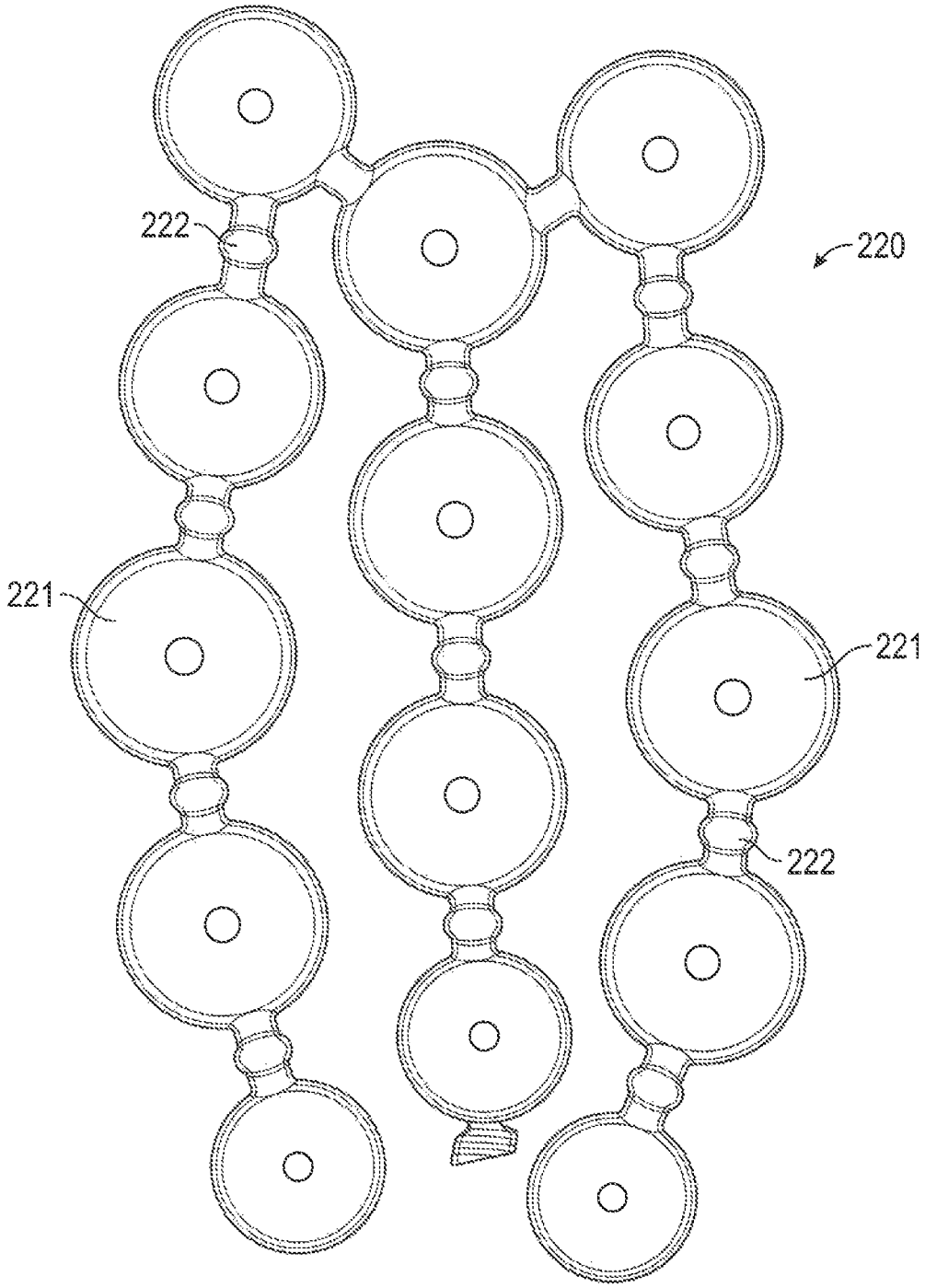
FIG. 15 is a plan view of a forefoot pod assembly of the sole of FIG. 12 according to an embodiment of the present invention.
Figure 16:
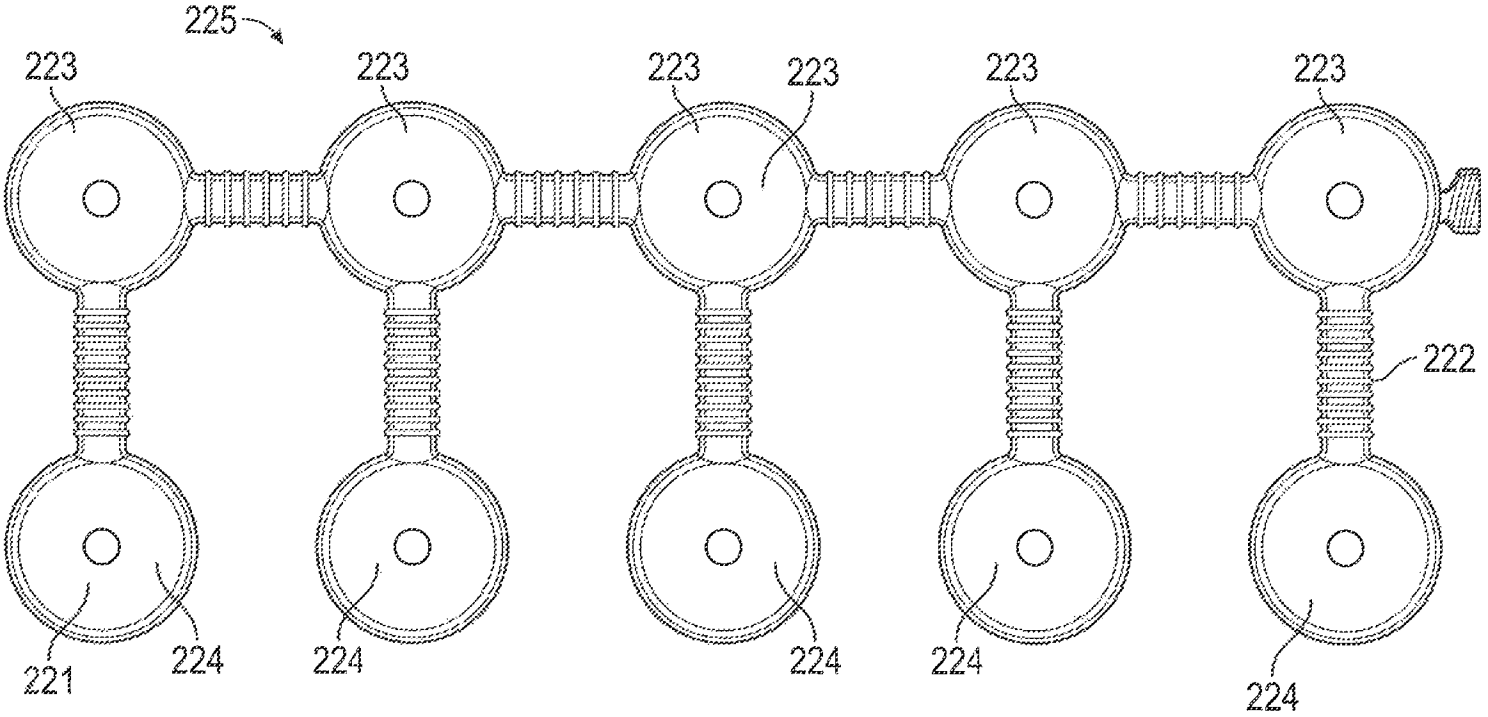
FIG. 16 is a plan view of a heel pod assembly of the sole of FIG. 12 according to an embodiment of the present invention.
Figure 17:
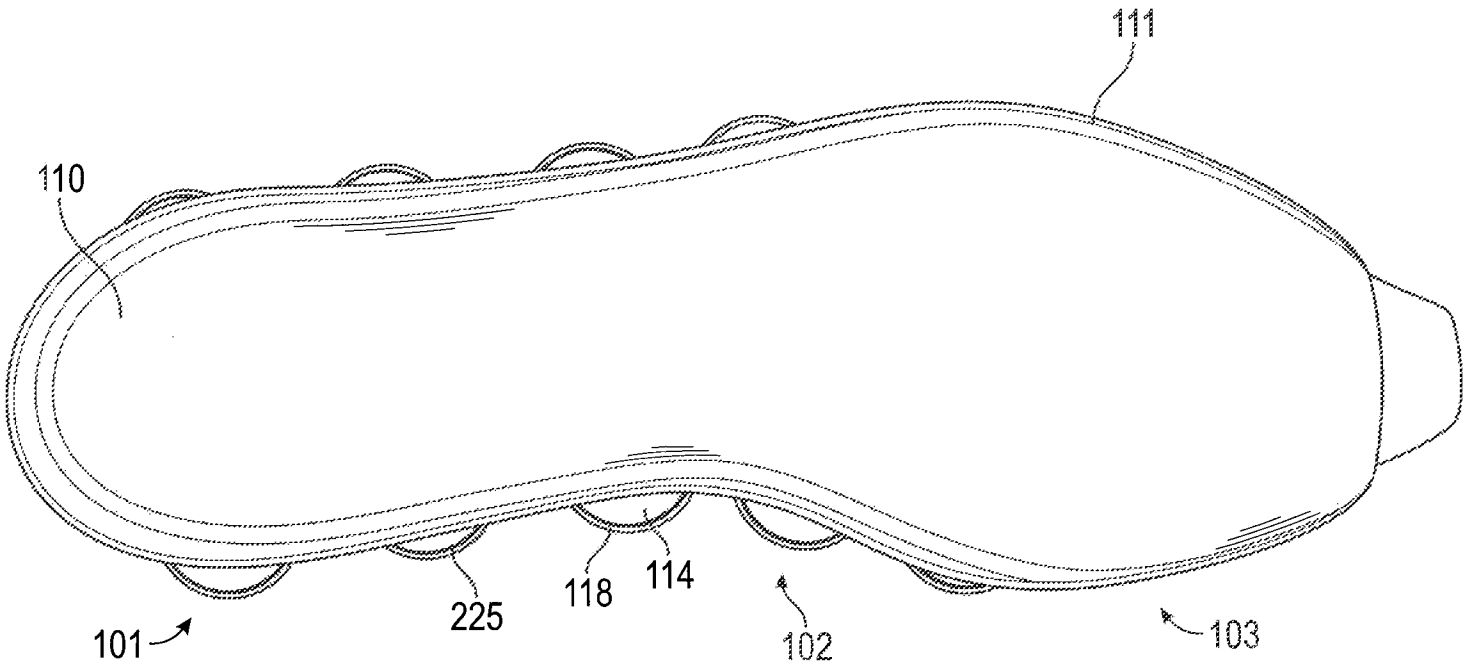
FIG. 17 is a top plan view of the sole of FIG. 12 according to an embodiment of the present invention.

In this manner, in one embodiment, as shown, for example, in FIGS. 13 and 14, an upper pod 223, a hub 114 disposed above the upper pod 223, the intermediate pod 242, the lower pod 224, and the portion of the lower sole portion 130 disposed below the lower pod 224 may form a projection assembly 240. In one embodiment, as shown, for example, in FIG. 14, a plurality of projection assemblies 240 extend from the base 110 at a non-orthogonal angle. This arrangement may allow for movement of the projection assembly 240 relative to the base 110, which may provide for the desired cushioning and feel of the sole 100 to the user during a gait cycle. In one embodiment, the heel pod assembly 220 may be arranged about the outer edge of the sole 100 in the heel region 101.

Figure 12:
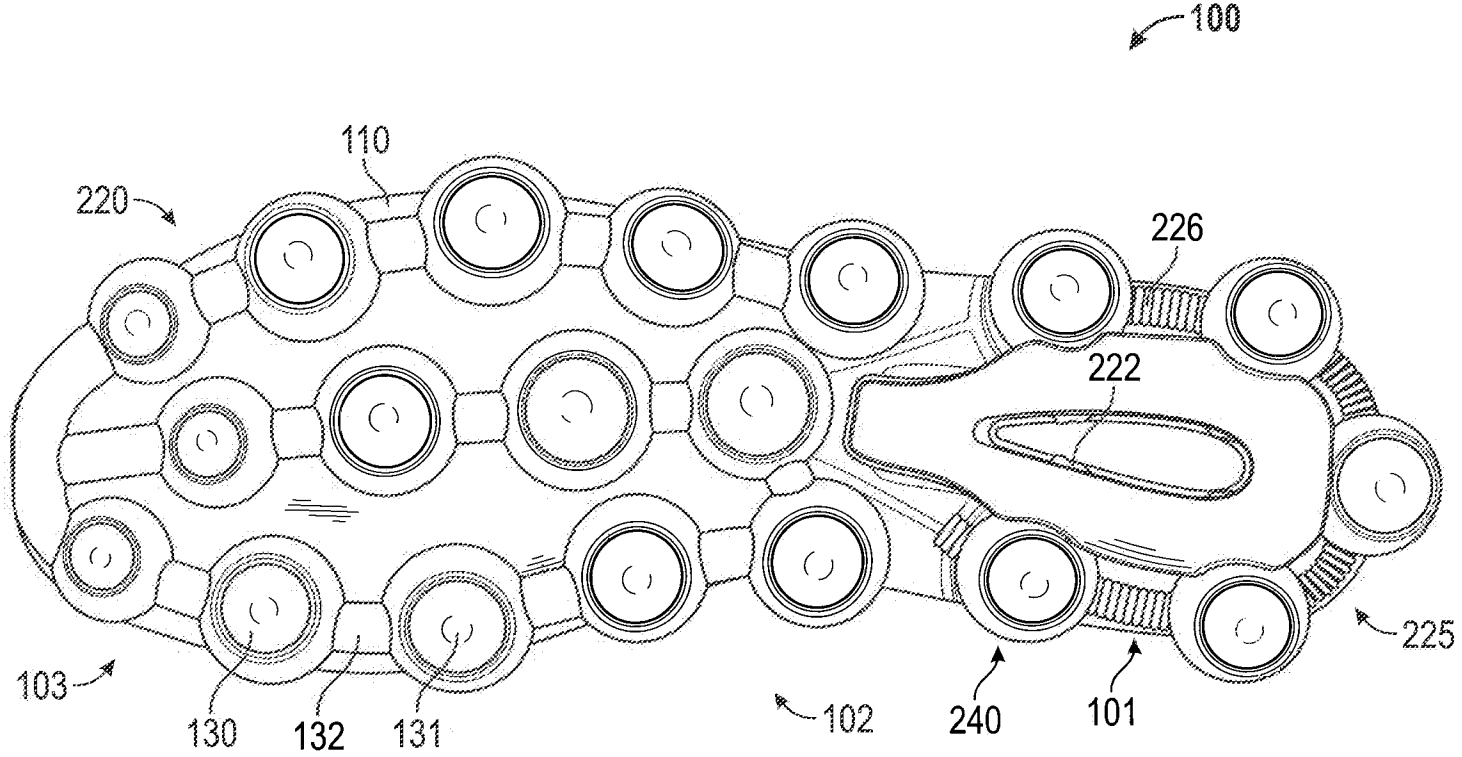
FIG. 12 is a bottom view of a sole according to an embodiment of the present invention.

In one embodiment, each upper pod 223 may be fluidly connected to an adjacent upper pod 223 and to the lower pod 224 disposed below it. In one embodiment, each lower pod 224 may only be directly fluidly connected to the upper pod 223 disposed above it. In one embodiment, as shown in FIG. 12, the fluid passageway 222 connecting an upper pod 223 to a lower pod 224 may be disposed at an interior portion of the sole. In one embodiment, the heel pod assembly 225 may or may not be connected to the forefoot pod assembly 220.

Another embodiment of the present invention will now be described with reference to FIGS. 18-21 in which like reference numerals may refer to like elements. The embodiment may include some or all of the features described above in connection with the embodiments of FIGS. 1-17. The sole 100 includes a forefoot pod assembly 320 and a heel pod assembly 325 disposed below the upper sole portion 110 of the sole. The forefoot pod assembly 320 and the heel pod assembly 325 include a plurality of pods 321 fluidly connected by a passageway 322.

The number, size, arrangement, and shape of the pods 321 of the heel pod assembly 325 and the forefoot pod assembly 320 may be varied to provide the desired ride characteristics. In one embodiment, as shown, for example, in FIGS. 18 and 20, the forefoot pod assembly 320 may include a plurality of pods which are fluidly connected transversely across the width of the sole 100. In one embodiment, as shown, for example, in FIGS. 18, 19, and 21, the heel pod assembly 325 may include corrugated passageways 322 that fluidly connect adjacent pods. The corrugated passageways 322 create a flexible connection that enable a first upper pod 323 to be placed on top of a second lower pod 324 during assembly of the sole 100. In one embodiment, an intermediate sole portion 342 may be disposed between the upper pod 323 and the lower pod 324. The intermediate sole portion 342 may comprise a similar material as the upper sole portion 110 and/or the lower sole portion 130.

Figure 18:
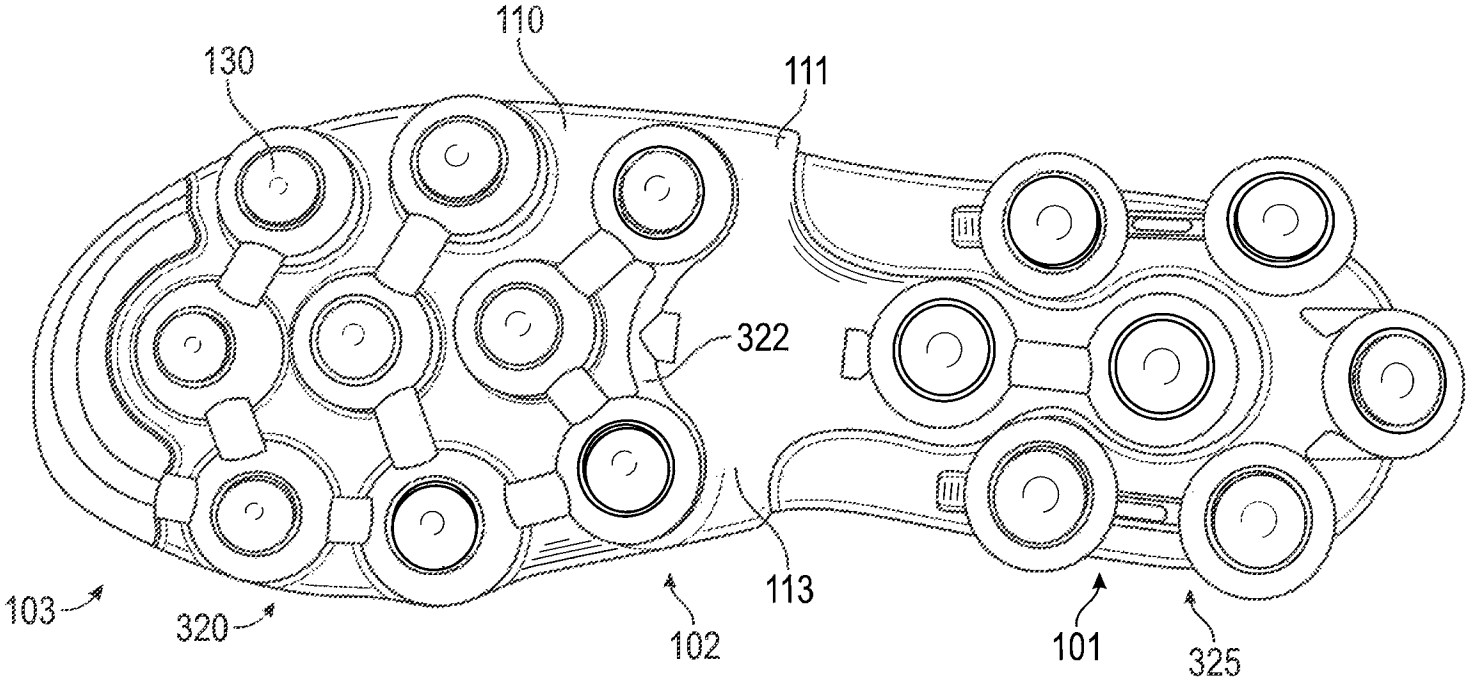
FIG. 18 is a bottom view of a sole according to an embodiment of the present invention.
Figure 19:
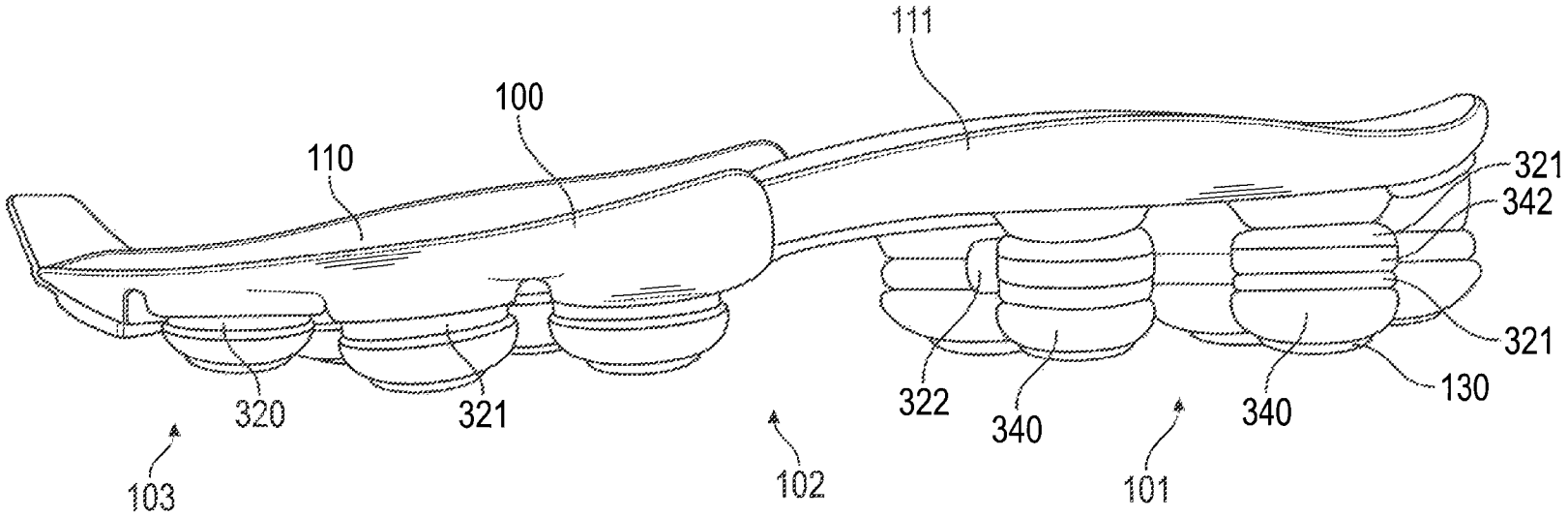
FIG. 19 is a lateral side view of the sole of FIG. 18 according to an embodiment of the present invention.
Figure 20:
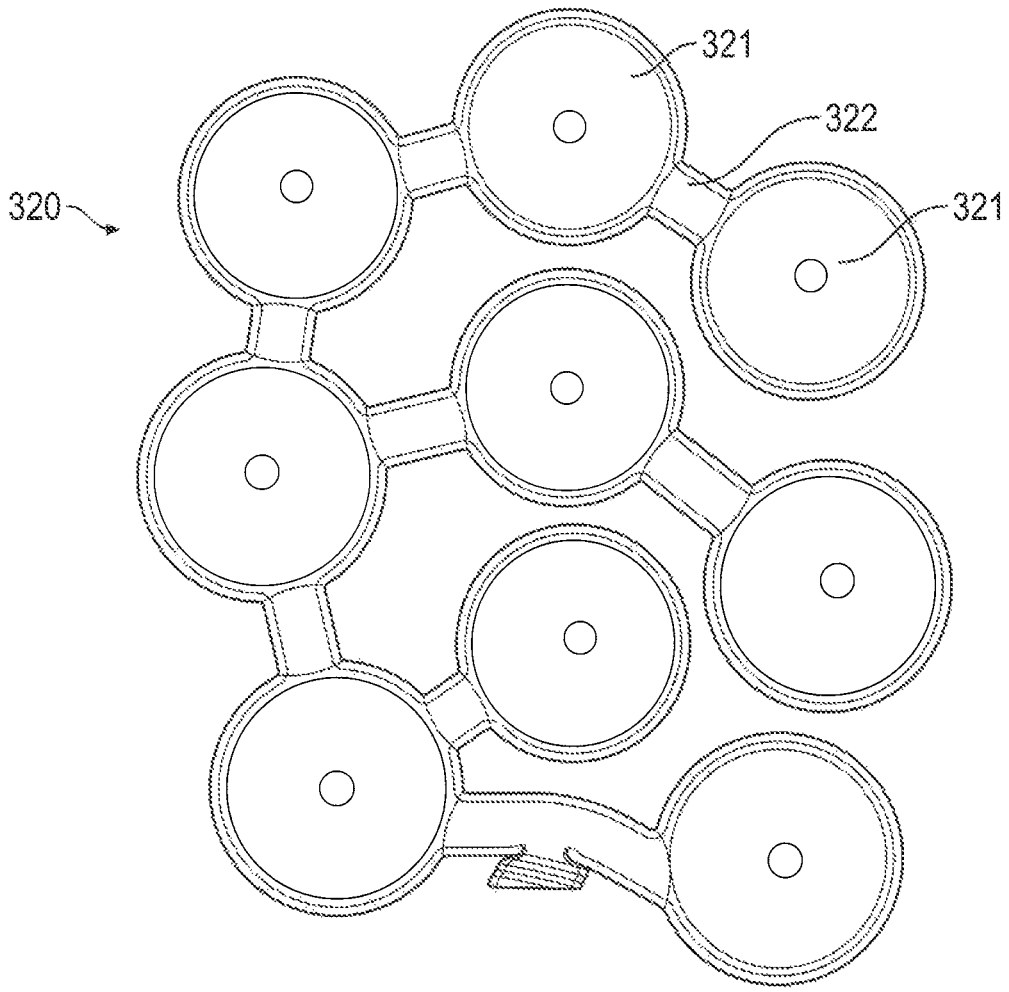
FIG. 20 is a plan view of a forefoot pod assembly of the sole of FIG. 18 according to an embodiment of the present invention.
Figure 21:
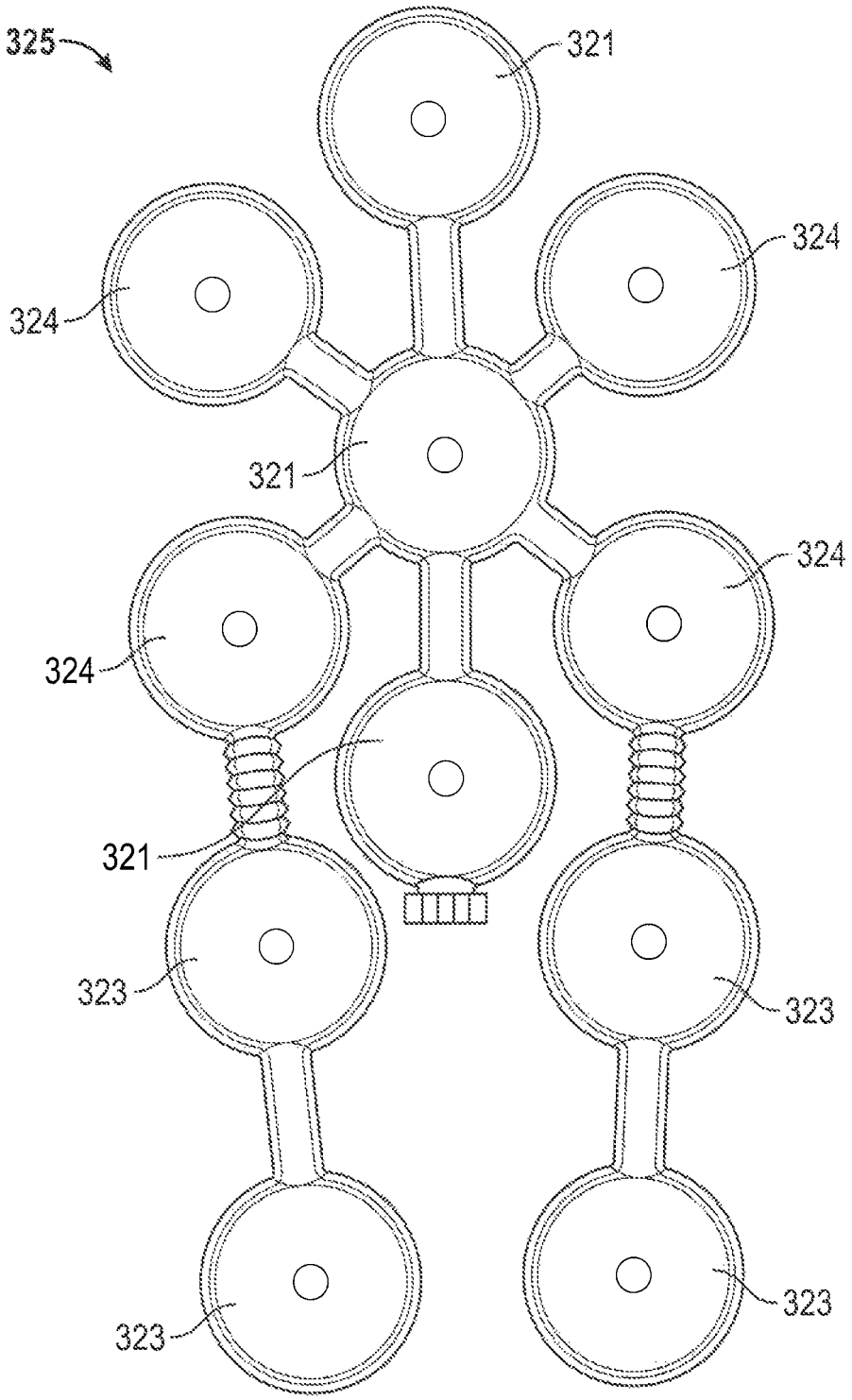
FIG. 21 is a plan view of a heel pod assembly of the sole of FIG. 18 according to an embodiment of the present invention.

In this manner, in one embodiment, as shown, for example, in FIG. 19, an upper pod 323, a hub 114 disposed above the upper pod 323, the intermediate pod 342, the lower pod 324, and the portion of the lower sole portion 130 disposed below the lower pod 324 may form a projection assembly 340. In one embodiment, as shown, for example, in FIG. 18, a plurality of projection assemblies 340 extend from the base 110 at a non-orthogonal angle. This arrangement may allow for movement of the projection assembly 340 relative to the base 110, which may provide for the desired cushioning and feel of the sole 100 to the user during a gait cycle. In one embodiment, the heel pod assembly 325 may be arranged about the outer edge of the sole 100 in the heel region 101.

In one embodiment, the heel pod assembly 325 may include a plurality of projection assemblies 340 with an upper and lower pod arrangement, and a plurality of projection assemblies 340 with a single pod 321. In one embodiment, the heel pod assembly 325 may include a centrally located pod 321 from which a plurality of pods 321, including upper 323 and lower 324 pods, are fluidly connected. In one embodiment, each lower pod 324 may be fluidly connected to the central pod 321. In one embodiment, the heel pod assembly 225 may or may not be connected to the forefoot pod assembly 220.

Figure 22:
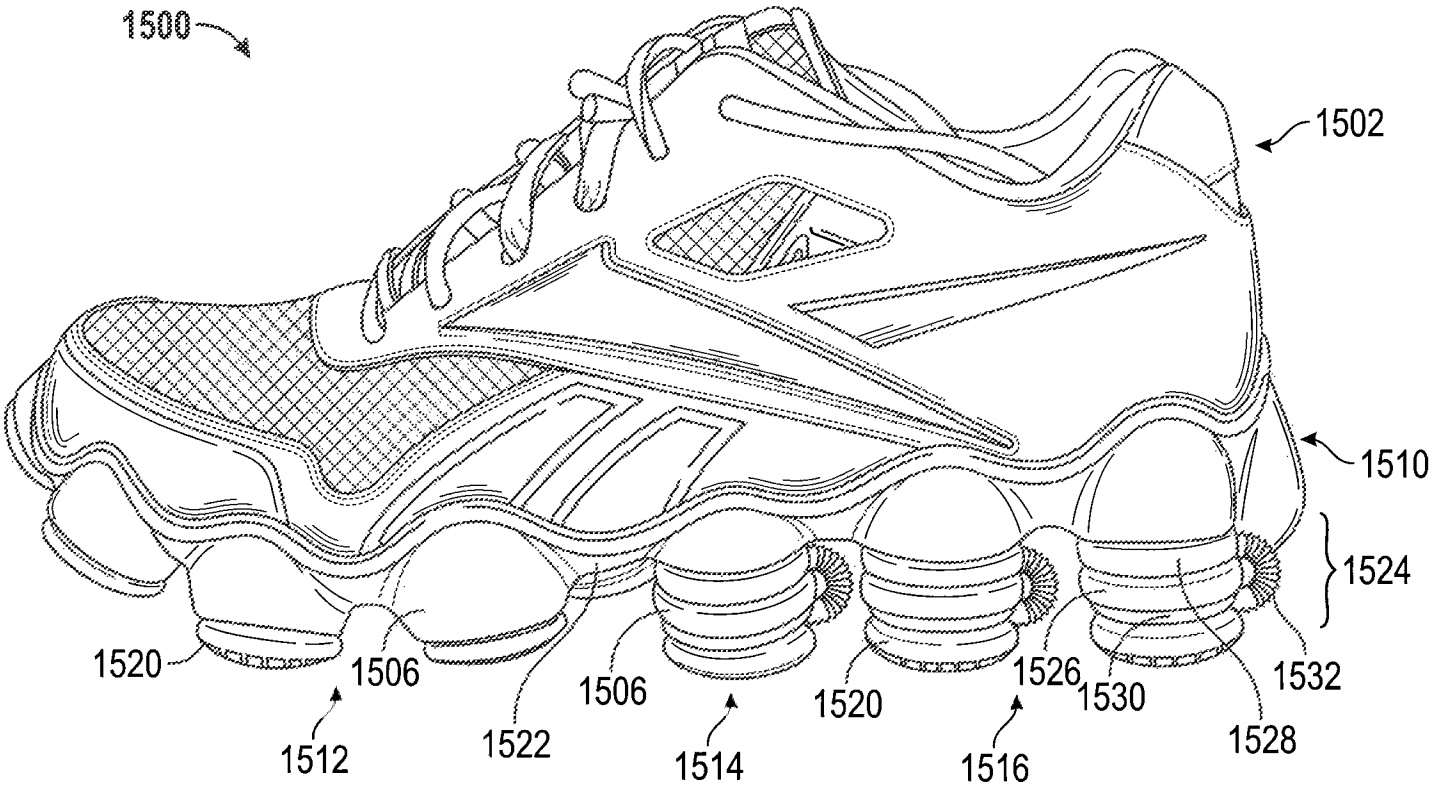
FIG. 22 is a lateral side view of an article of footwear according to an embodiment of the present invention.
Figure 23:
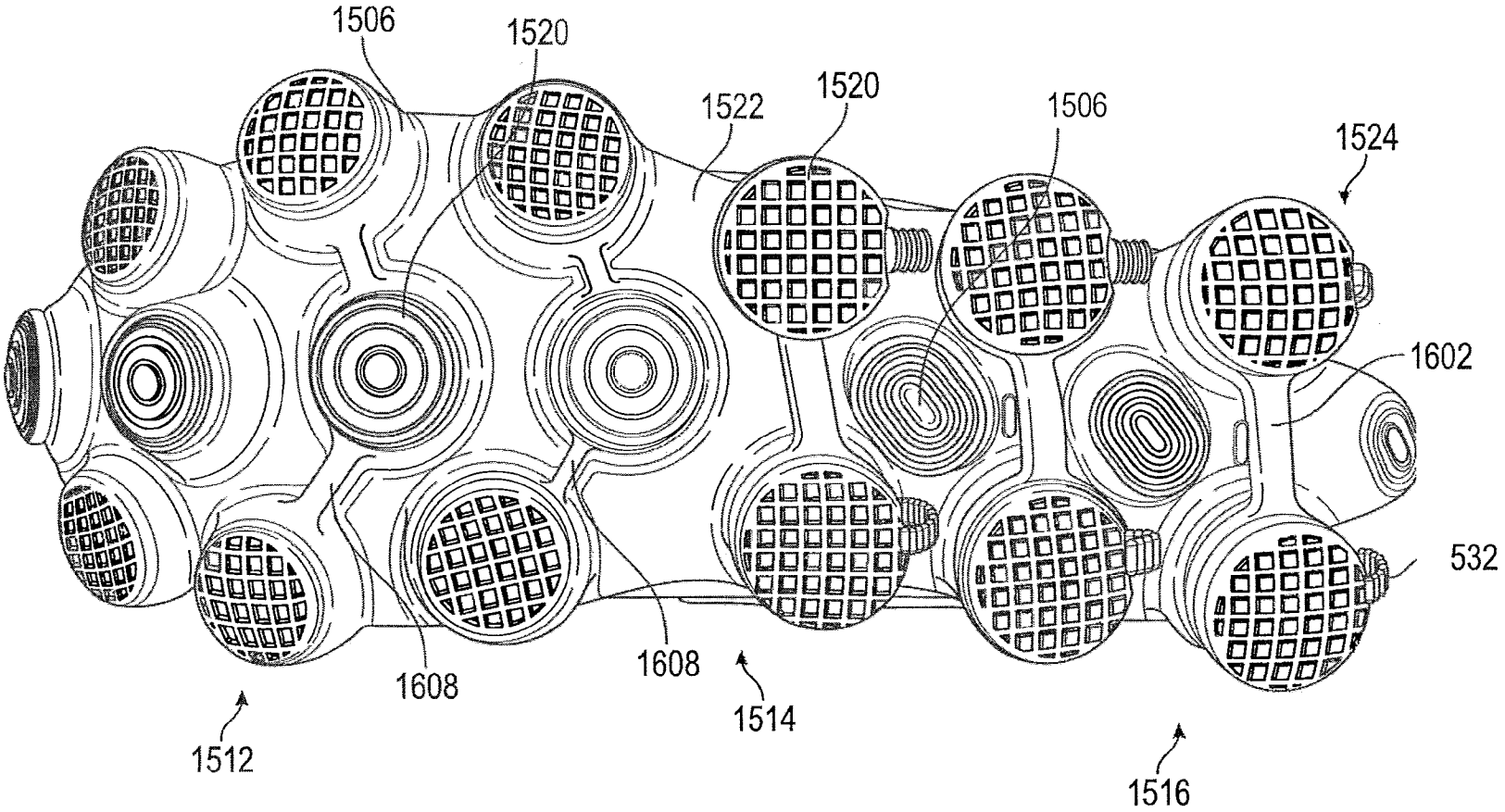
FIG. 23 is a bottom view of the article of footwear of FIG. 22 according to an embodiment of the present invention.
Figure 24:
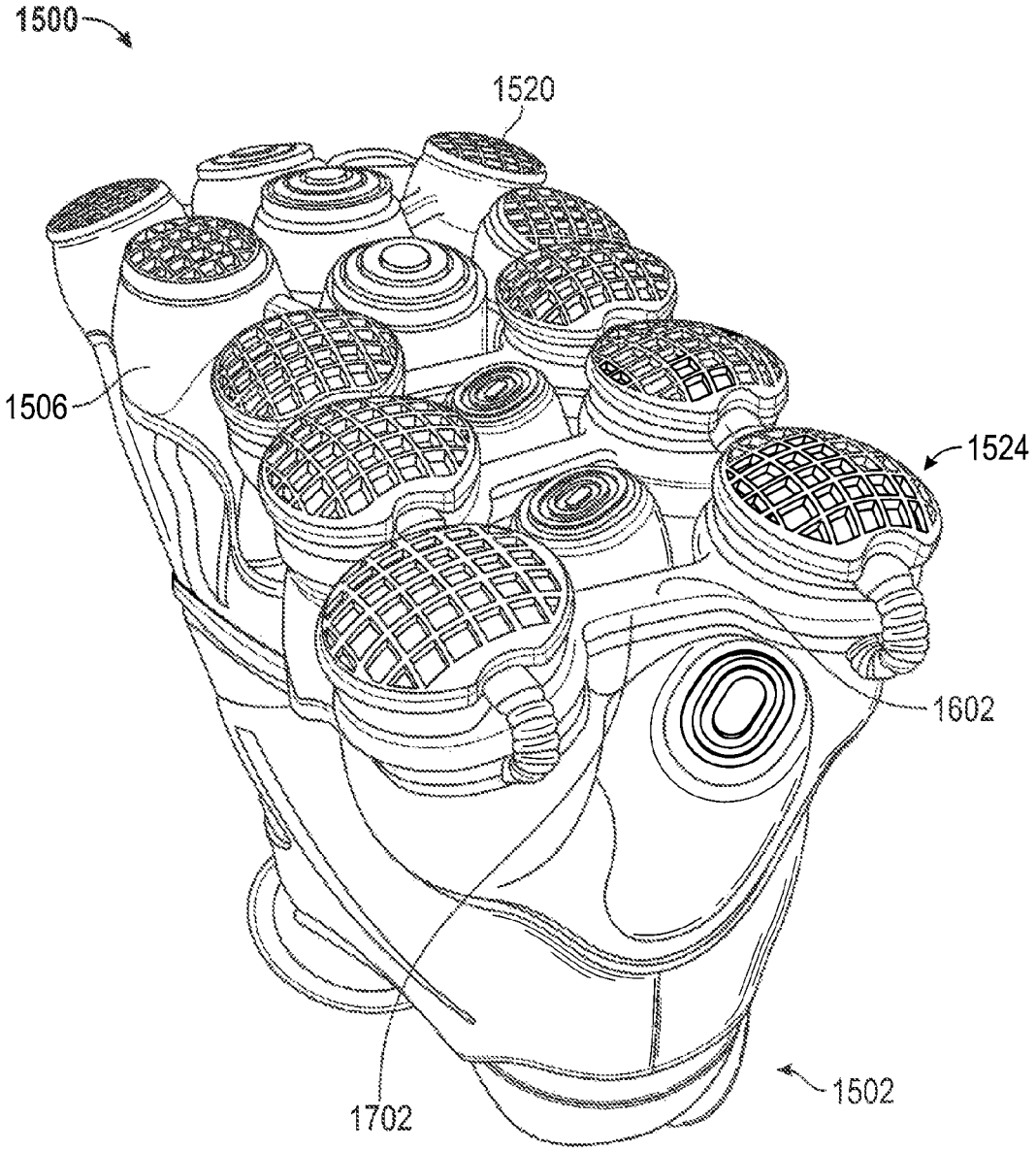
FIG. 24 is a bottom perspective view of the article of footwear of FIG. 22 according to an embodiment of the present invention.

With reference to FIGS. 22-24, another embodiment will now be described. FIG. 22 is a lateral view of a left shoe. However, to the extent that only the left or right article of footwear 1500 is described for a particular embodiment of the present invention, it will be apparent to one of ordinary skill in the art that the article of footwear 1500 suitable for the other foot, even if not specifically described, may comprise a mirror image of the described article of footwear 1500.

The shoe 1500 has a forefoot portion 1512, a midfoot portion 1514, and a heel portion 1516. The shoe includes an upper 1502 and a sole 1510. The upper 1502 may be formed to generally accommodate a human foot, and may comprise one or more textiles made of natural or man-made fibers. Materials appropriate for the upper 1502 including, but not limited to, leather, rubber, and plastic, are considered to be within the scope of the present invention.

Sole 1510 can also include outsole material 1520 as a ground contacting material. In one embodiment of the present invention, an insole and/or sockliner may also be included within the shoe 1500. In some embodiments, the sole 1510 may include an insole and/or sockliner. The outsole material 1520 may comprise a wear-resistant material. For example, outsole material 1520 can include synthetic or natural rubber, thermoplastic polyurethane (TPU), a wear-resistant foam, or a combination thereof. The sole 1510 may comprise a foam such as, for example, ethylene vinyl acetate (EVA) or polyurethane. In some embodiments, the sole can include a molded thermoplastic component such as, for example, an injection molded TPU component. In one specific embodiment, the sole is substantially composed of a molded thermoplastic such as, for example, an injection molded TPU. Alternatively, the materials comprising the sole 1510 and the outsole material 1520 may be chosen as deemed fit by one of skill in the art. The sole 1510 may be constructed out of one or more materials, and may have zones of differing densities.

The sole 1510 of shoe 1500 includes projections 1506 extending downwardly from the main body 1522 of the sole 1510. Projections 1506 can be formed in a variety of shapes, sizes, and densities in order to provide cushioning and weight properties that are tailored to specific areas of the sole 1510. Outsole material 1520 can be provided on the lower surface of projections 1506 to provide increased wear resistance and traction during use. Although shoe 1500 is shown in the figures with outsole material 1520 on every projection 1506, it is understood that outsole material 1520 can be provided only on selected projections 1506 or none of the projections 1506. Although shoe 1500 is described herein as including a sole main body 1522 from which projections 1506 extend, it is understood that shoe 1500 can be provided with no sole main body. For example, a plate formed of thermoplastic, graphite, carbon, or similar materials can be provided underneath 1502, and projections 1506 can extend from the plate.

As shown in FIG. 22, projections 1506 have a longest length in the heel portion 1516 of the shoe 1500. Shorter projections 1506 can be provided in the forefoot portion 1512 of the shoe 1500. Sole 1510 can be designed such that each projection 1506 contacts or engages the ground separately when a user is walking, running, or, more generally, moving under his or her own power. As each projection 1506 contacts or engages the ground a compressive force is exerted on the particular projection. When such compressive forces are applied, the projections 1506 can provide varying amounts of cushioning and stability depending on the diameter, length, density, and shape of the particular projection 106. The material from which a particular projection 1506 is formed can also affect the cushioning and stability provided by the projection, allowing these properties to be further refined according to the location of the projection 1506 on the sole 1510.

Projections 1506 in the forefoot portion 1520 are generally similar to the projections described herein with reference to other embodiments of the present invention. Projections 1506 on the lateral and medial perimeters of the midfoot and heel portions 1514 and 1516 of sole 1510 can comprise a projection assembly 1524. Projection assembly 1524 includes a first pod 1528, a second pod 1530, and a third pod 1526. In the embodiment shown in FIG. 22, first and second pods 1528 and 1530 are fluid containing bladders that are in fluid communication with each other via a connecting tube 1532. The bladder may be filled with a gas such as, for example, pressurized or non-pressurized (ambient) air. Fluid filled bladders suitable for use in footwear include, but are not limited to, bladders like those described in U.S. Pat. No. 7,395,617 to Christensen, et al. and U.S. Pat. No. 7,340,851 to Litchfield, et al., the disclosures of which are incorporated herein in their entirety by reference.

First and second pods 1528 and 1530 are filled with air in a preferred embodiment. Alternately, first and second pods 1528 and 1530 can be filled with a gel or liquid, or any other fluid. Third pod 1526 is formed of a foam such as, for example, ethylene vinyl acetate (EVA) or polyurethane. However, in alternate embodiments of the present invention, first and second pods 1528 and 1530 can be formed of a foam or rubber material and third pod can be a fluid containing bladder. Outsole material 1520 is provided underneath second pod 1530.

FIG. 23 is a bottom view of the exemplary article of footwear of FIG. 22. As shown in FIG. 23, projections 1506 on the perimeter of heel portion 1516 comprise projections assemblies 1524. A central row of projections 1506 are positioned between projection assemblies 1524. This central row of projections may be provided with or without outsole material thereon. An extension 1602 connects the second pods 1530 of each pair of lateral and medial projections assemblies 1524. Extension 1602 serves to limit splaying of projection assemblies 1524 and thereby improves the stability and performance of shoe 1500. In alternate embodiments, sole 1510 can be formed without extensions 1602. Preferably, three pairs of projection assemblies 1524 extend from the heel portion 1516 of sole 1510 into the rear region of midfoot portion 1514. Although not pictured, projections 1506 in the forefoot portion 1512 of sole 1510 can also be projection assemblies. Furthermore, the projections described herein with reference to other embodiments of the present invention can comprise projection assemblies 1524. Projections 1506, including projection assemblies 1524, can be angled and have varying vertical heights, shapes, diameters, and densities as described herein with reference to other embodiments of the present invention. Bridges 1608 can extend between projections 1506 in the forefoot portion 1512 of the sole 1510 to add stability, as described in detail above.

FIG. 24 is a bottom perspective view of the exemplary article of footwear of FIG. 22. As shown in FIG. 24, an extension tube 1702 extends between the first pods 1528 of each pair of lateral and medial projection assemblies 1524. Preferably, extension tube 1702 fluidly connects each pair of first pods 1528 such that the four fluid containing pods 1528 and 1530, that is, first and second pods 1528 and 1530 of both the lateral and medial projection assemblies 1524 forming one pair of projection assemblies, are all fluidly connected to each other to serve as a fluid transfer network. In other embodiments, additional projection assemblies 1524 can be fluidly connected together in a similar fashion to further enhance the cushioning properties of sole 1510.

Figure 25:
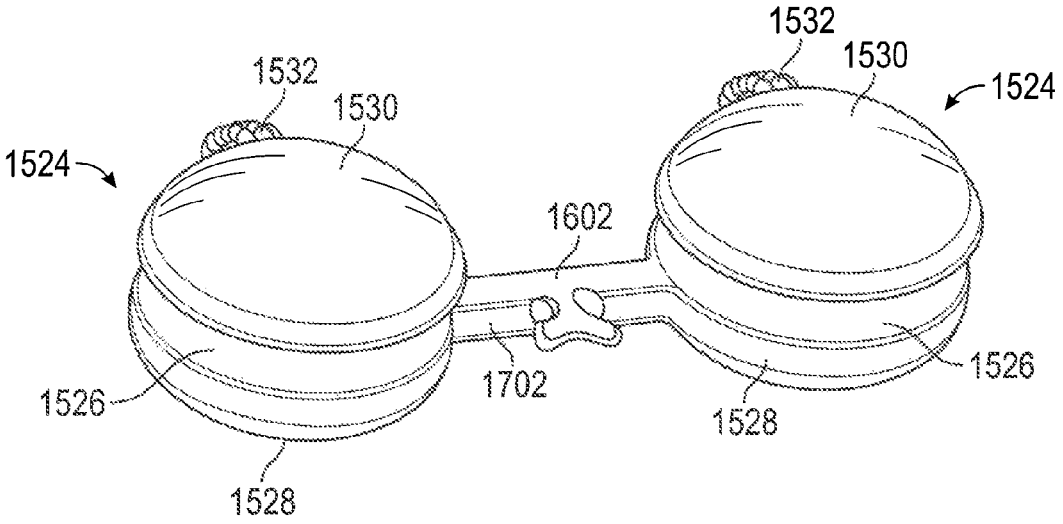
FIG. 25 is a perspective view of a portion of a pod assembly according to an embodiment of the present invention.
Figure 26:
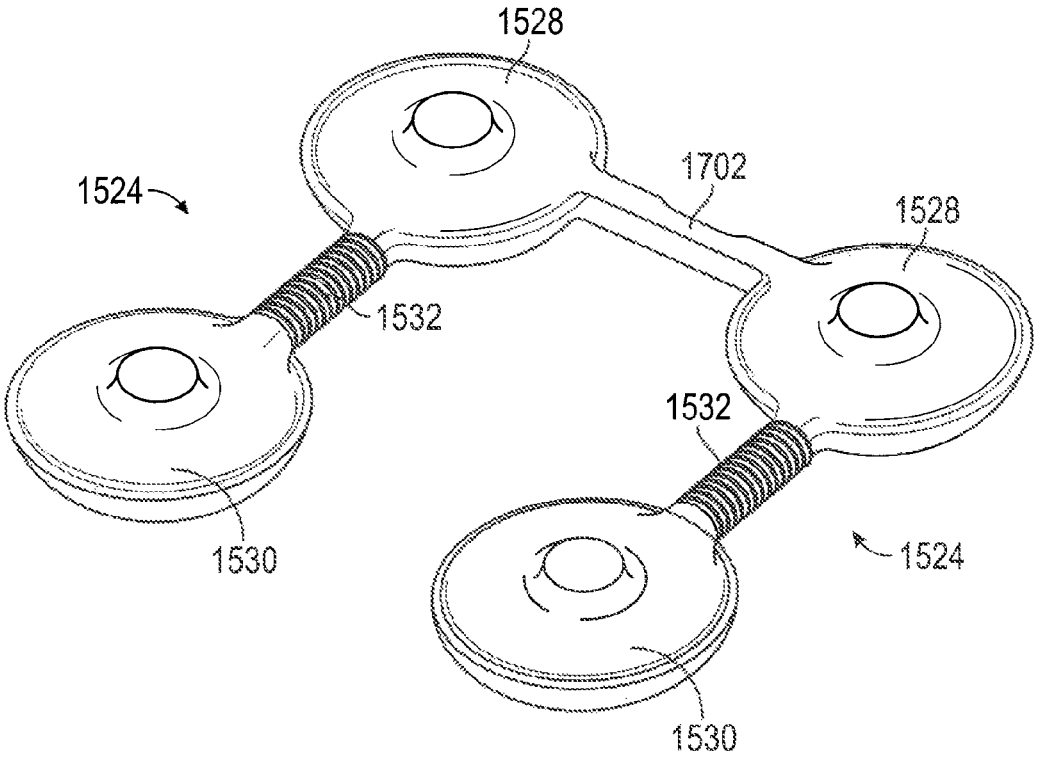
FIG. 26 is a perspective view of a portion of a pod assembly according to an embodiment of the present invention.

FIG. 25 is a perspective view of two connected projection assemblies 1524. As described above, each projection assembly 1524 includes a first pod 1528, a second pod 1530, and a third pod 1526. In the embodiment shown in FIG. 22, first and second pods 1528 and 1530 are fluid containing bladders that are in fluid communication with each other via a connecting tube 1532. An extension tube 1702 connects the first pods 1528 the two projection assemblies 1524. In other embodiments, extension tube 1702 can extend between the two second pods 1530. Two extension tubes 1702 can be provided, with one extension tube 1702 extending between first pods 1528 and one extension tube 1702 extending between second pods 1530. Although not illustrated in FIG. 25 an extension can extend between the two second pods 1526. FIG. 26 is a perspective view of two partially assembled projection assemblies 1524 without third pods 1526. As seen in FIGS. 18 and 19, extension tube 1702 can be corrugated or ridged to facilitate bending of the tube during assembly.

Figure 27:
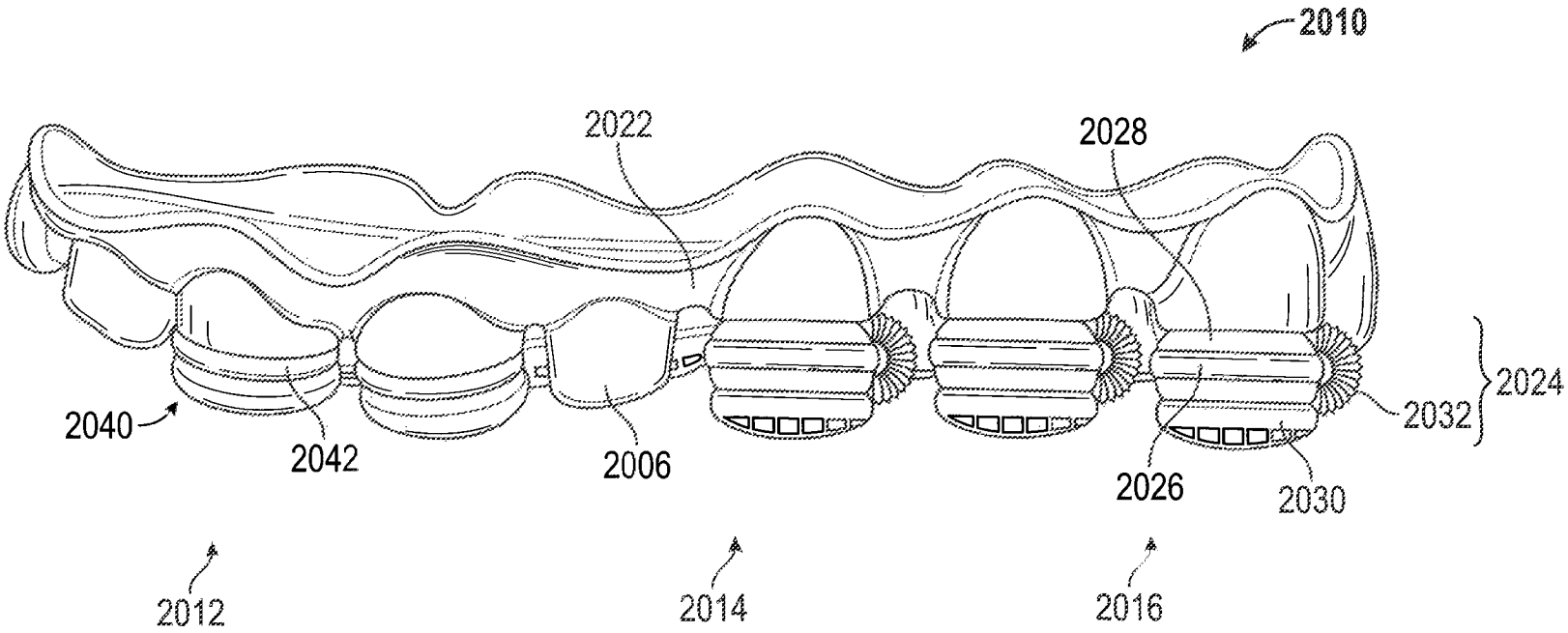
FIG. 27 is a lateral side view of a sole for an article of footwear according to an embodiment of the present invention.

FIG. 27 is a lateral side view of an exemplary sole 2010 for an article of footwear according to an embodiment of the present invention. The sole 2010 has a forefoot portion 2012, a midfoot portion 2014, and a heel portion 2016. Sole 2010 can also include outsole material 2020 as a ground contacting material. In some embodiments, the sole 2010 may include an insole and/or sockliner. The outsole material 2020 may comprise a wear-resistant material. For example, outsole material 2020 can include synthetic or natural rubber, thermoplastic polyurethane (TPU), a wear-resistant foam, or a combination thereof. The sole 2010 may comprise a foam such as, for example, ethylene vinyl acetate (EVA) or polyurethane. In some embodiments, the sole 2010 can include a molded thermoplastic component such as, for example, an injection molded TPU component. In one specific embodiment, the sole is substantially composed of a molded thermoplastic such as, for example, an injection molded TPU. Alternatively, the materials comprising the sole 2010 and the outsole material 2020 may be chosen as deemed fit by one of skill in the art. The sole 2010 may be constructed out of one or more materials, and may have zones of differing densities.

The sole 2010 of shoe 2000 includes projections 2006 extending downwardly from the main body 2022 of the sole 2010. Projections 2006 can be formed in a variety of shapes, sizes, and densities in order to provide cushioning and weight properties that are tailored to specific areas of the sole 2010. Outsole material 2020 can be provided on the lower surface of projections 2006 to provide increased wear resistance and traction during use. Although sole is described herein as including a sole main body 2022 from which projections 2006 extend, it is understood that shoe 2000 can be provided with no sole main body. For example, a plate formed of thermoplastic, graphite, carbon, or similar materials can be provided, and projections 2006 can extend from the plate.

Projections 2006 have a longest length in the heel portion 2016 of the shoe 2000. Shorter projections 2006 can be provided in the forefoot portion 2012 of the shoe 2000. Sole 2010 can be designed such that each projection 2006 contacts or engages the ground separately when a user is walking, running, or, more generally, moving under his or her own power. As each projection 2006 contacts or engages the ground a compressive force is exerted on the particular projection. When such compressive forces are applied, the projections 2006 can provide varying amounts of cushioning and stability depending on the diameter, length, density, and shape of the particular projection 2006. The material from which a particular projection 2006 is formed can also affect the cushioning and stability provided by the projection, allowing these properties to be further refined according to the location of the projection 2006 on the sole 2010.

As shown in FIG. 27 two of the projections 2006 in the forefoot portion 2012 of sole 2010 comprise forefoot projection assemblies 2040. Each forefoot projection assembly 2040 includes a pod 2042 affixed to the bottom of a projection from sole main body 2022. Pods 2042 are filled with air in a preferred embodiment. Alternately, pods 2042 can be filled with a gel or liquid, or any other fluid. Projections 2006 on the lateral and medial perimeters of the midfoot and heel portions 2014 and 2016 of sole 2010 can comprise a projection assembly 2024. Projection assembly 2024 includes a first pod 2028, a second pod 2030, and a third pod 2026. In the embodiment shown in FIG. 27, first and second pods 2028 and 2030 are fluid containing bladders that are in fluid communication with each other via a connecting tube 2032. First and second pods 2028 and 2030 are filled with air in a preferred embodiment. Alternately, first and second pods 2028 and 2030 can be filled with a gel or liquid, or any other fluid. Third pod 2026 is formed of a foam such as, for example, ethylene vinyl acetate (EVA) or polyurethane. However, in alternate embodiments of the present invention, first and second pods 2028 and 2030 can be formed of a foam or rubber material and third pod can be a fluid containing bladder. Outsole material 2020 is provided underneath second pod 2030.

Figure 28:
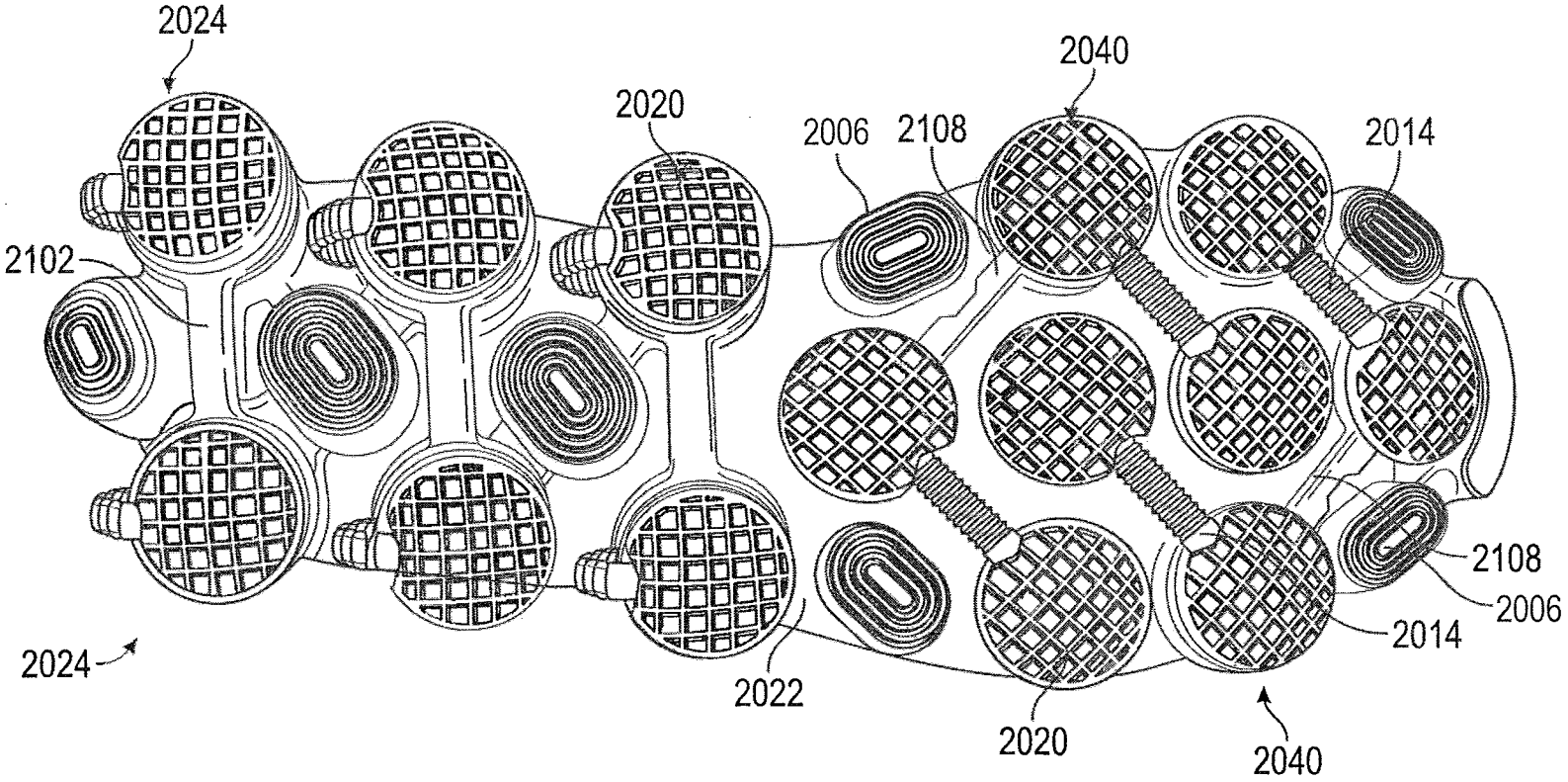
FIG. 28 is a bottom view of the sole of FIG. 27 according to an embodiment of the present invention.

FIG. 28 is a bottom view of the exemplary article of footwear of FIG. 27. Similar to the embodiments described above with reference to FIGS. 22-26, projections 2006 on the perimeter of heel portion 2016 comprise projections assemblies 2024. A central row of projections 2006 are positioned between projection assemblies 2024. This central row of projections may be provided with or without outsole material thereon. An extension 2102 connects the second pods 2030 of each pair of lateral and medial projections assemblies 2024. Extension 2102 serves to limit splaying of projection assemblies 2024 and thereby improves the stability and performance of shoe 2000. In alternate embodiments, sole 2010 can be formed without extensions 2102. Preferably, three pairs of projection assemblies 2024 extend from the heel portion 2016 of sole 2010 into the rear region of midfoot portion 2014. Furthermore, the projections described herein with reference to other embodiments of the present invention can comprise projection assemblies 2024. Projections 2006, including projection assemblies 2024, can be angled and have varying vertical heights, shapes, diameters, and densities as described herein with reference to other embodiments of the present invention.

Two or more forefoot projection assemblies 2040 can be fluidly connected by tubes 2014 allowing fluid to transfer between forefoot projection assembly pods 2042 when forces are applied to the pods during a gait cycle. Some of the projection assemblies 2040 can be connected by bridges 2108 that do not allow fluid communication but serve to link two adjacent projection assemblies 2040 together to provide additional stability. Tubes 2014 can be corrugated or ridges for ease of manufacturing. Providing ridges in the tubes 2014 allow the tubes 2014 to be stretchable and compressible, and therefore allows one size of tube 2014 to be utilized in midsoles constructed for different sizes of shoes.

Figure 29:
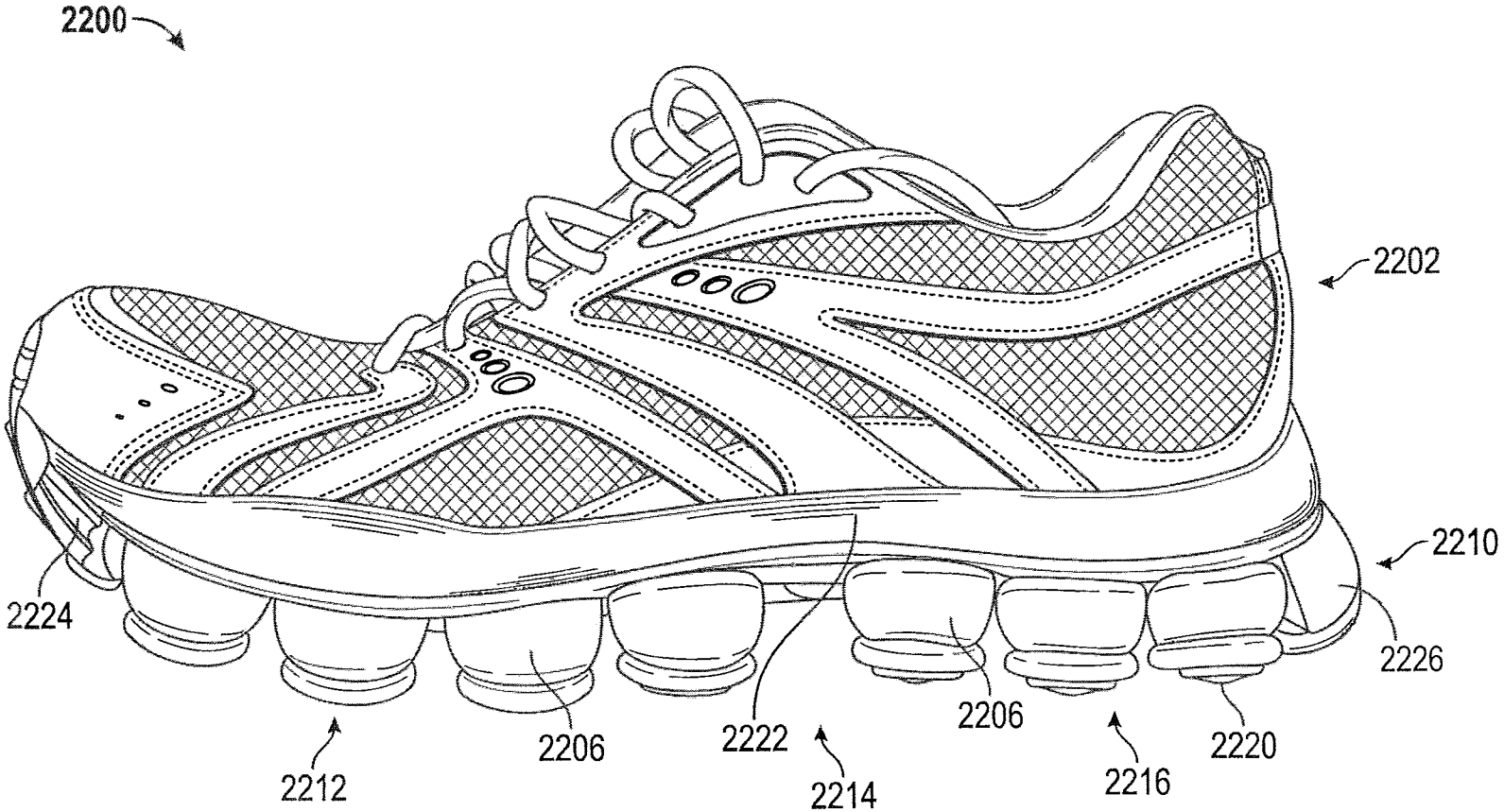
FIG. 29 is a lateral side view of an article of footwear according to an embodiment of the present invention.

FIG. 29 is a lateral view of a left shoe 2200. However, to the extent that only the left or right article of footwear 2200 is described for a particular embodiment of the present invention, it will be apparent to one of ordinary skill in the art that the article of footwear 2200 suitable for the other foot, even if not specifically described, may comprise a mirror image of the described article of footwear 2200.

The shoe 2200 has a forefoot portion 2212, a midfoot portion 2214, and a heel portion 2216. The shoe includes an upper 2202 and a sole 2210. The upper 2202 may be formed to generally accommodate a human foot, and may comprise one or more textiles made of natural or man-made fibers. Materials appropriate for the upper 2202 including, but not limited to, leather, rubber, and plastic, are considered to be within the scope of the present invention.

Sole 2210 can also include outsole material 2220 as a ground contacting material. In one embodiment of the present invention, an insole and/or sockliner may also be included within the shoe 2200. In some embodiments, the sole 2210 may include an insole and/or sockliner. The outsole material 2220 may comprise a wear-resistant material. For example, outsole material 2220 can include synthetic or natural rubber, thermoplastic polyurethane (TPU), a wear-resistant foam, or a combination thereof. The sole 2210 may comprise a foam such as, for example, ethylene vinyl acetate (EVA) or polyurethane. In some embodiments, the sole can include a molded thermoplastic component such as, for example, an injection molded TPU component. In one specific embodiment, the sole is substantially composed of a molded thermoplastic such as, for example, an injection molded TPU. Alternatively, the materials comprising the sole 2210 and the outsole material 2220 may be chosen as deemed fit by one of skill in the art. The sole 2210 may be constructed out of one or more materials, and may have zones of differing densities.

The sole 2210 of shoe 2200 includes projections 2206 extending downwardly from the main body 2222 of the sole 2210. Projections 2206 are fluid-filled bladders that provide cushioning during use of the shoe 2200. In another embodiment of the present invention, projections 2206 can be formed of foam, rubber, or mechanical cushioning mechanisms. Outsole material 2220 can be provided on the lower surface of projections 2206 to provide increased wear resistance and traction during use. Although shoe 2200 is shown in the figures with outsole material 2220 on every projection 2206, it is understood that outsole material 2220 can be provided only on selected projections 2206 or none of the projections 2206. Although shoe 2200 is described herein as including a sole main body 2222 from which projections 2206 extend, it is understood that shoe 2200 can be provided with no sole main body. For example, a plate formed of thermoplastic, graphite, carbon, or similar materials can be provided underneath 2202, and projections 2206 can extend from the plate. Sole 2210 can also have a forefoot extension 2224 and a heel extension 2226. The forefoot and heel extensions 2224 and 2226 are formed of the same material as the sole main body 2222. In other embodiments of the present invention, forefoot and heel extensions 2224 and 2226 can be fluid-filled bladders.

Figure 30:
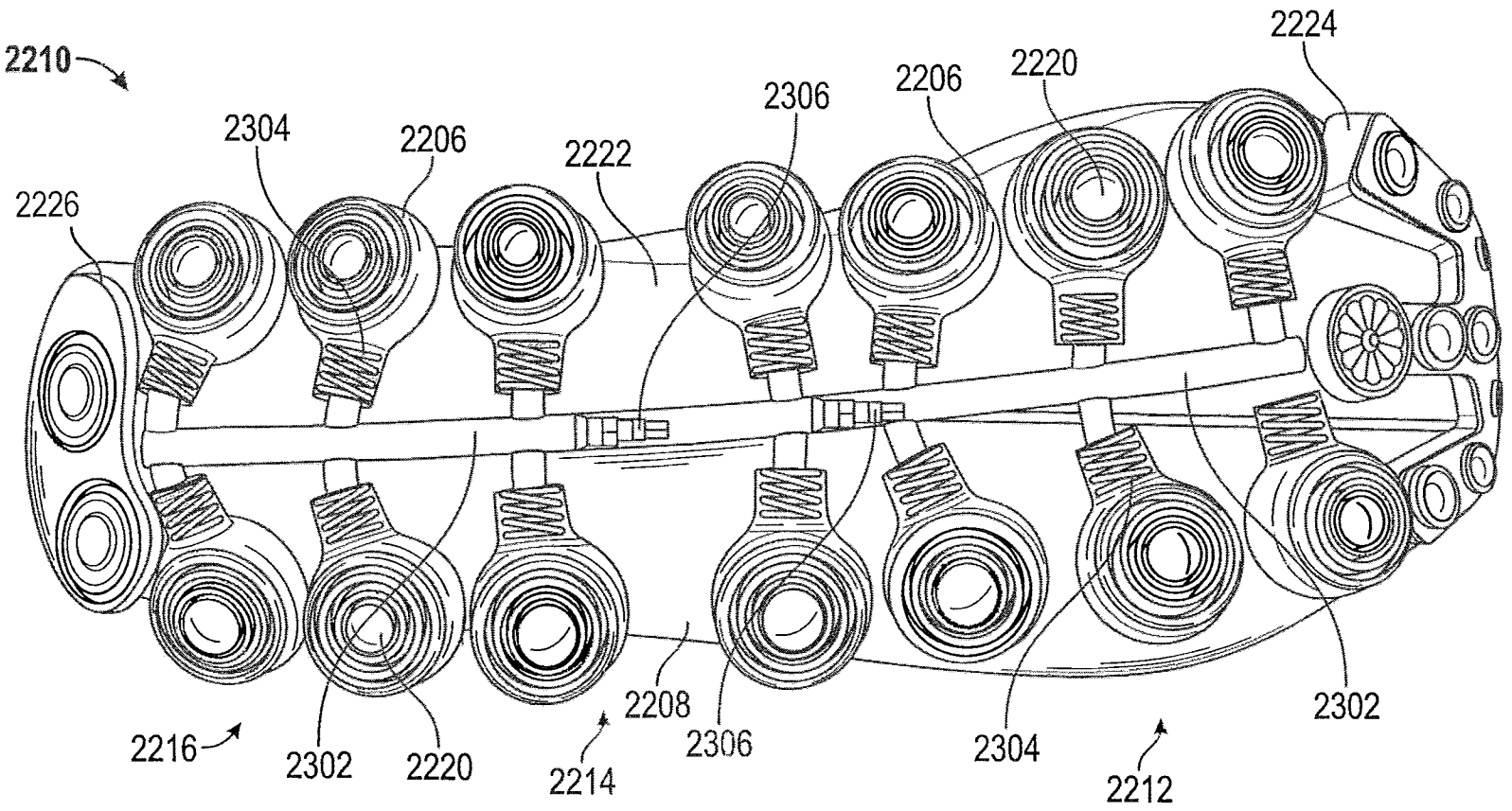
FIG. 30 is a bottom view of the article of footwear of FIG. 29 according to an embodiment of the present invention.
Figure 31:
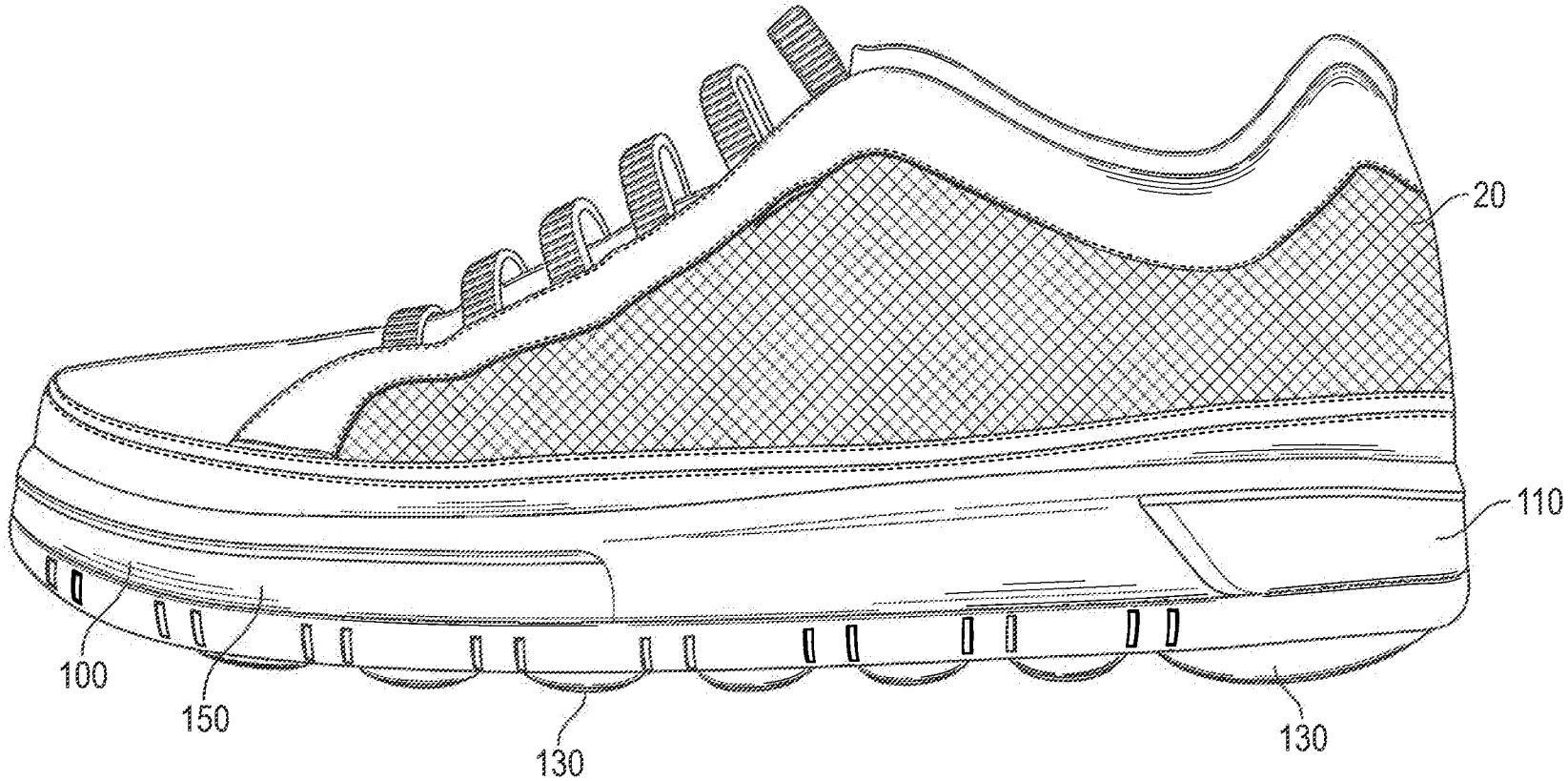
FIG. 31 is a lateral side view of an article of footwear according to an embodiment of the present invention.
Figure 32:
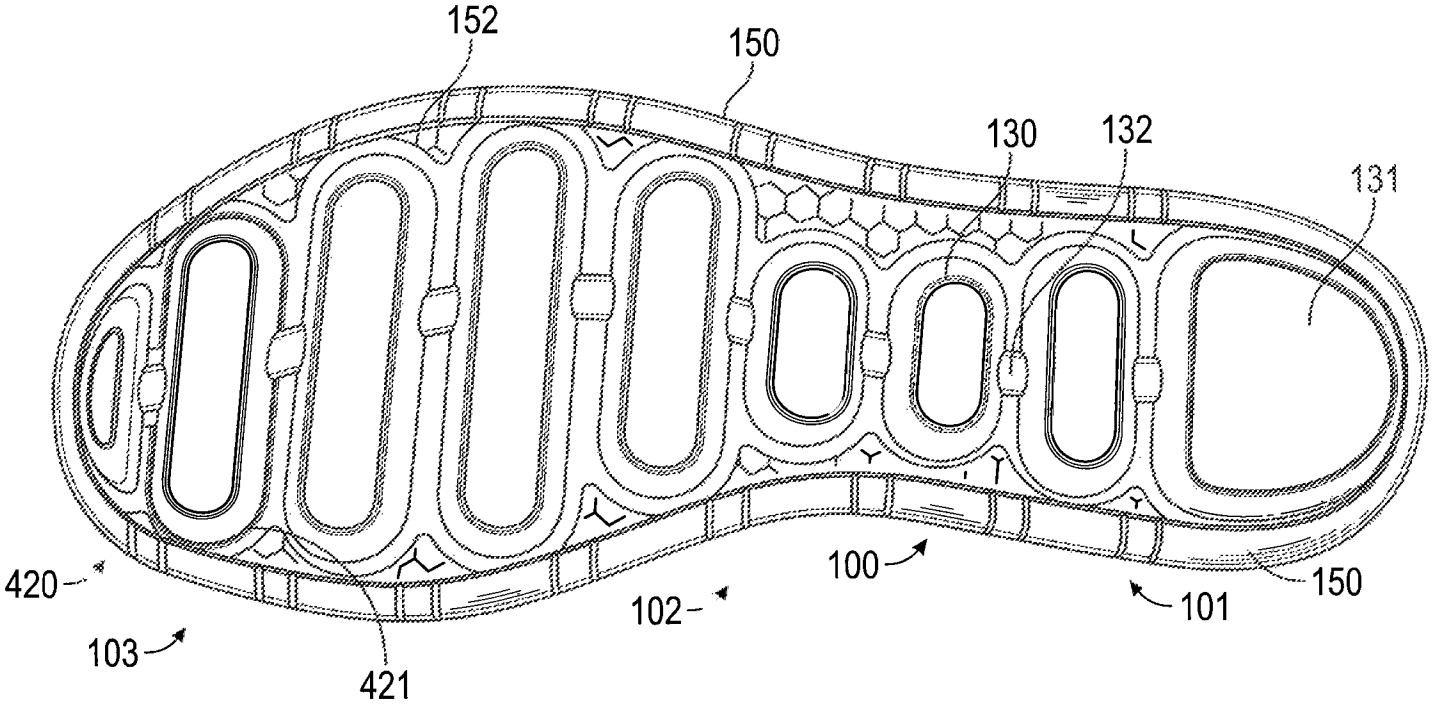
FIG. 32 is a bottom view of the article of footwear of FIG. 31 according to an embodiment of the present invention.
Figure 33:
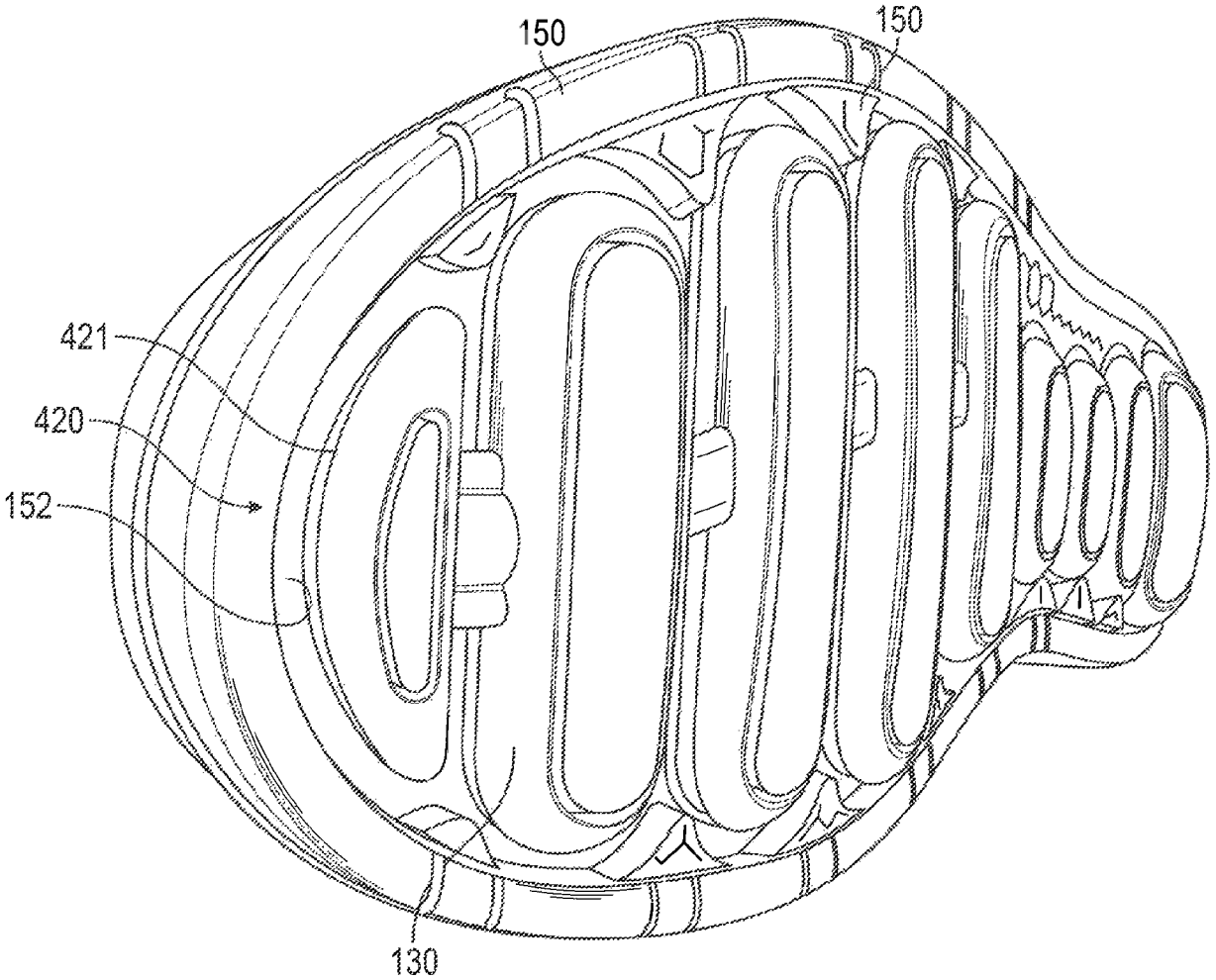
FIG. 33 is a front perspective view of the article of footwear of FIG. 31 according to an embodiment of the present invention.
Figure 34:
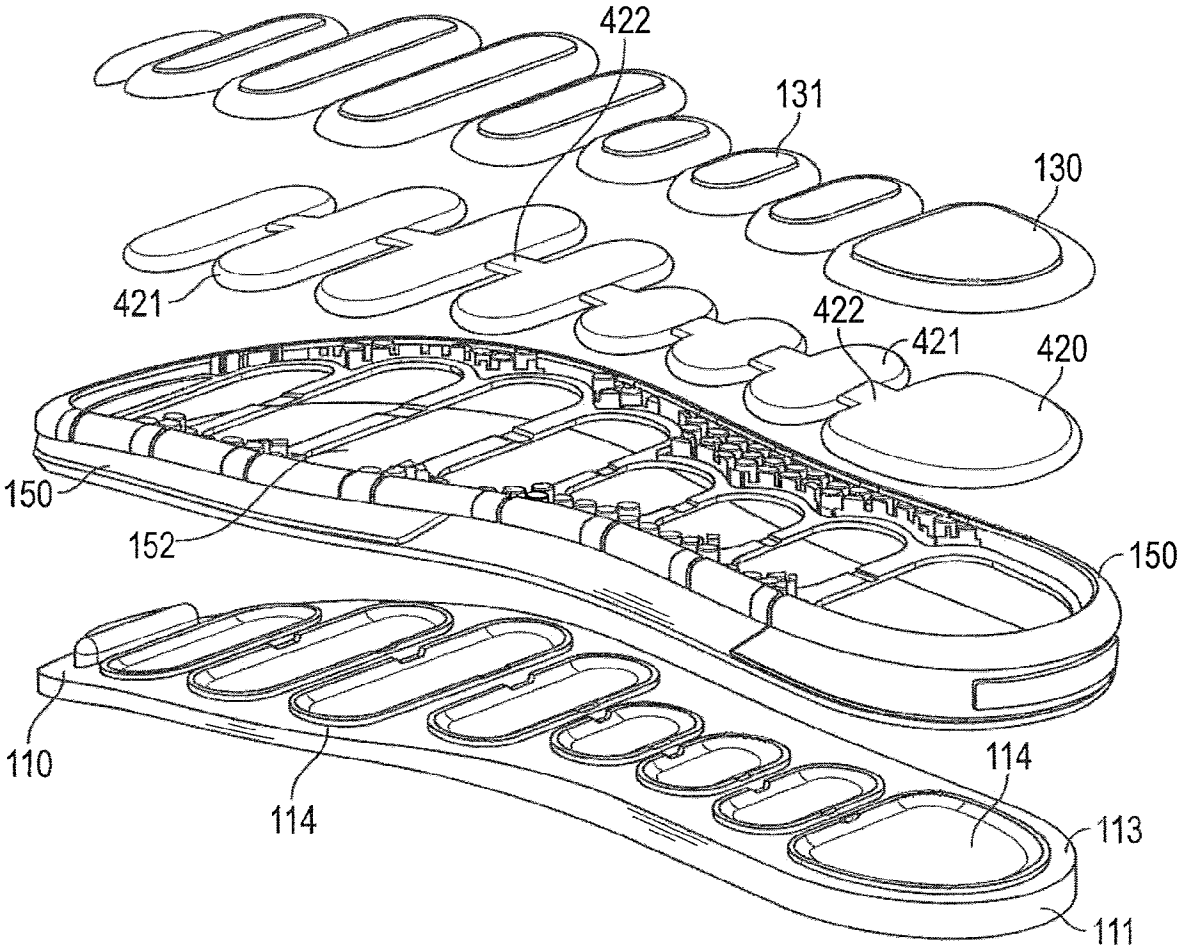
FIG. 34 is an exploded perspective view of the article of footwear of FIG. 31 according to an embodiment of the present invention.

Sole 2210 can be designed such that each projection 2206 contacts or engages the ground separately when a user is walking, running, or, more generally, moving under his or her own power. As each projection 2206 contacts or engages the ground a compressive force is exerted on that projection. When such compressive forces are applied, the projections 2206 can provide varying amounts of cushioning and stability depending on the pressure and density of the fluid in the projections 2206. Projections 2206 in different areas of the sole 2210 can be provided with difference pressures corresponding to the impact forces experienced by that area during use. Although the projections 2206 shown in FIGS. 29 and 30 are generally the same size and shape, projections 2006 can be formed in a variety of shapes and sizes. Some of the projections 2206 can be replaced with projections or projection assemblies described elsewhere herein.

FIG. 30 depicts a bottom perspective view of the exemplary article of footwear of FIG. 29. As shown in FIG. 30, projections 2206 are provided in two rows, one on the lateral side of sole 2210 and one on the medial side of sole 2210. Projections 2206 are fluidly connected to each other through a network of tubes 2302 and 2304. Tube branches 2304 extend from each projection towards the longitudinal axis of the sole 2210 and connect with a central longitudinal tube 2302. Valves 2306 can be provided at various locations in central longitudinal tube 2302 to regulate air flow between portions of the sole 2210. For example, valves 2306 can substantially isolate the network of projections 2206 in the heel portion 2216 of sole 2210. The projections 2206 in the forefoot portion 2212 of sole 2210 can also be substantially fluidly isolated from the projections in the midfoot portion 2214 and heel portion 2216 of sole 2210. In other embodiments, fluid from the projections 2206 can flow with little or no regulation by valves 2306, and sole 2210 can be provided without valves 2306. Valves 2306 can also be provided on tube branches 2304. If the forefoot or heel extensions 2224 and 2226 are fluid-filled bladders, they can also be connecting to the network of branches 2302 and 2304. Bridges or braces (not shown) may also be provided on sole 2210 to connect two or more projections in order to improve the stability of the shoe 2200 and to prevent splaying of the projections 2206. Additional projections 2206 can be provided on sole 2210.

Another embodiment of the present invention will now be described with reference to FIGS. 31-34 in which like reference numerals may refer to like elements. The embodiment may include some or all of the features described above in connection with the embodiments of FIGS. 1-30. The sole 100 includes a pod assembly 420 having a plurality of pods 421 fluidly connected by one or more passageways 422. The pod assembly 420 may be generally centrally located along a central axis of the sole 100 and may be disposed in a substantially linear arrangement. In one embodiment, the upper sole portion 110 includes a base 111 and a rim portion 150 disposed about the base 111. The rim portion 150 may include a plurality of voids 152 for receiving one or more hubs 114 of the upper sole portion 110 and/or all or a portion of the one or more pods 421, as shown, for example, in FIG. 34. In one embodiment, all or a portion of the pod assembly 420 may be visible. In another embodiment, the upper sole portion 110 may extend down to the lower sole portion 130 so as to encapsulate the one or more pods 421.

The number, size, arrangement, and shape of the pods 421 of the pod assembly 420 may be varied to provide the desired ride characteristics. In one embodiment, as shown, for example, in FIGS. 32-34, the lateral to medial width of the pods 421 may vary along the length of the sole 100. For example, wider pods 421 may be disposed in the forefoot region 103 of the sole, and narrower pods 421 may be disposed in the midfoot or arch region 102 and/or heel region 101. In some embodiments, both fluid filled pods 421 and connecting passageways 422 may be disposed in the midfoot or arch region 102.

Figure 35:
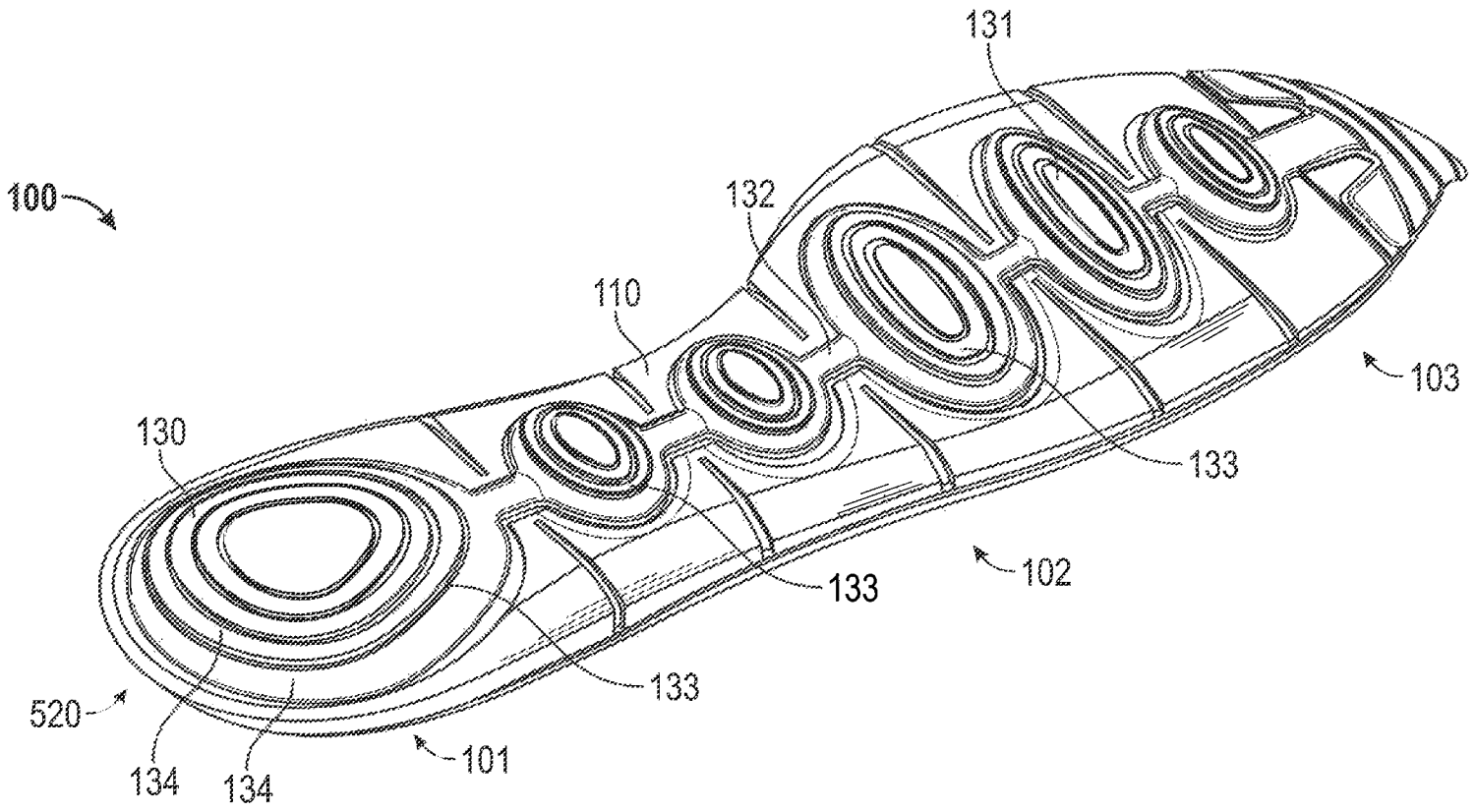
FIG. 35 is a perspective view of an article of footwear according to an embodiment of the present invention.
Figure 36:
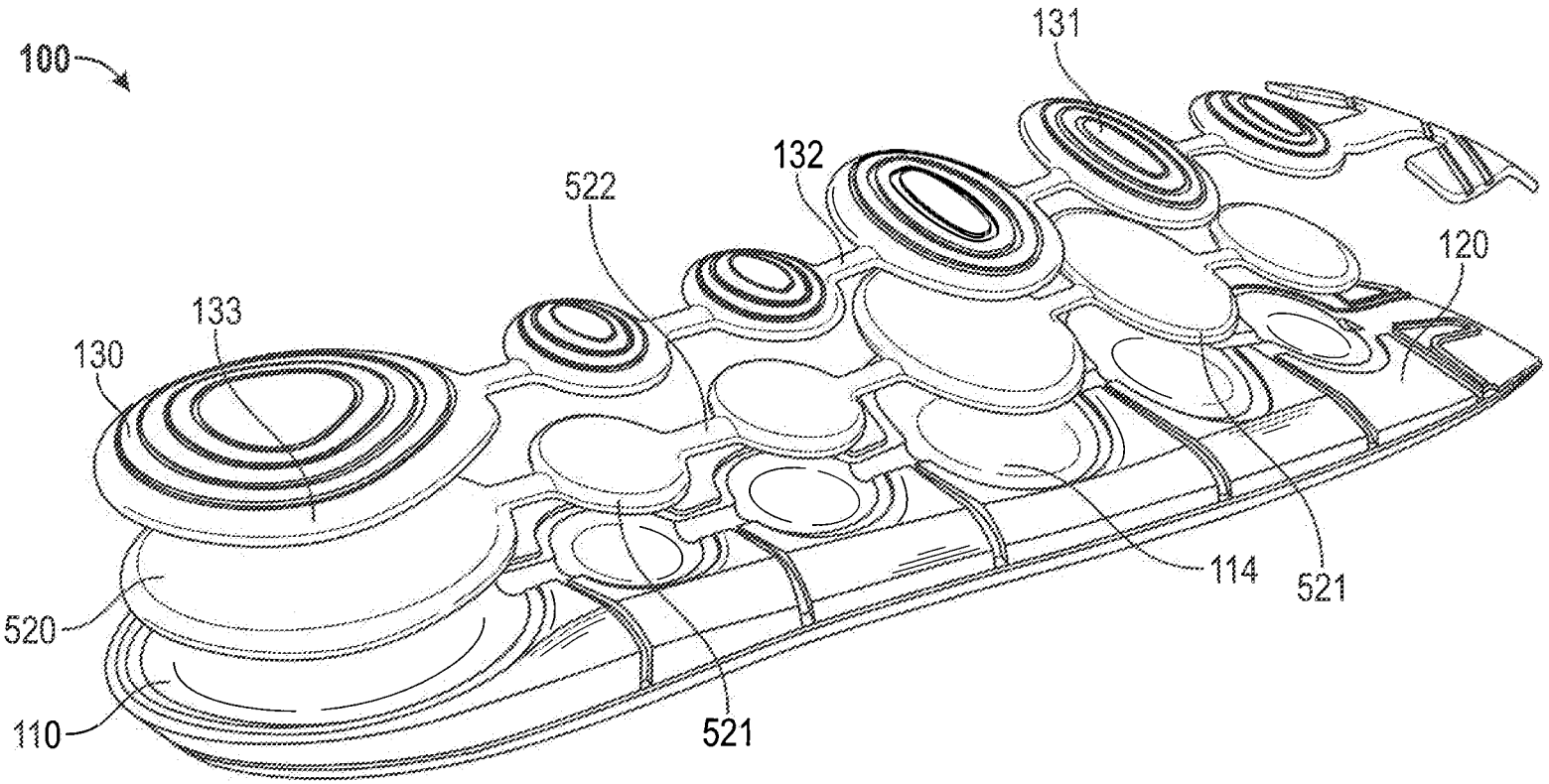
FIG. 36 is an exploded perspective view of the article of footwear of FIG. 35 according to an embodiment of the present invention.
Figure 37:
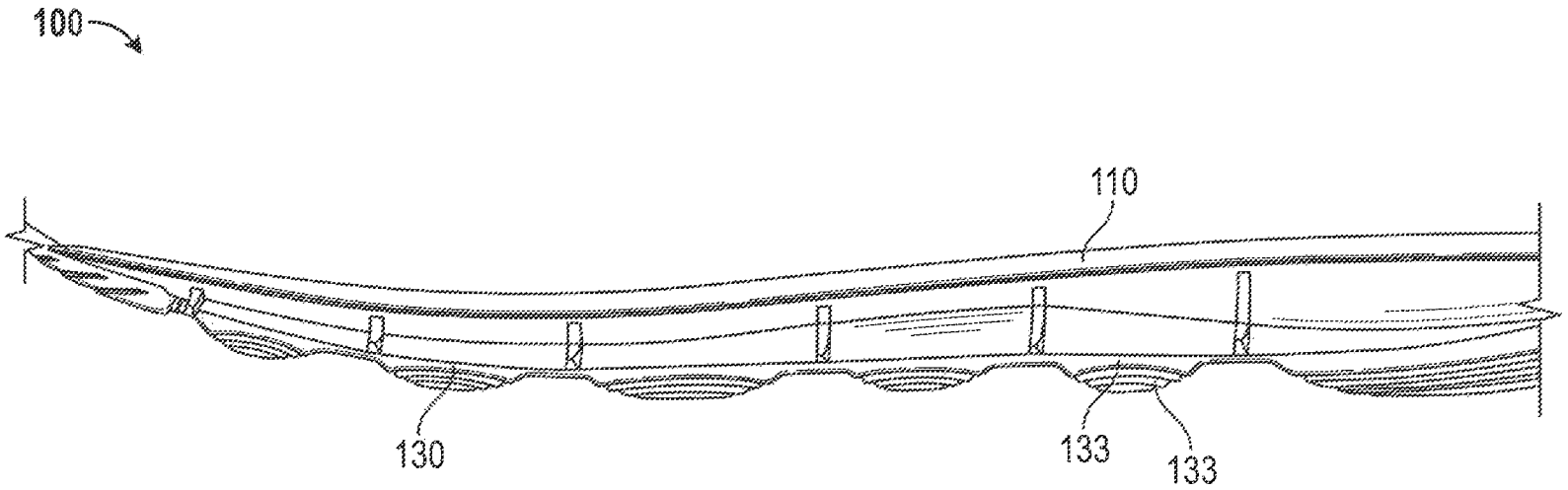
FIG. 37 is a partial side view of the article of footwear of FIG. 35 according to an embodiment of the present invention.

Another embodiment of the present invention will now be described with reference to FIGS. 35-40 in which like reference numerals may refer to like elements. The embodiment may include some or all of the features described above in connection with the embodiments of FIGS. 1-34. The sole 100 includes a pod assembly 520 having a plurality of pods 521 fluidly connected by one or more passageways 522. The pod assembly 520 may be generally centrally located along a central axis of the sole 100 and may be disposed in a substantially linear arrangement. In one embodiment, as best shown in FIG. 37, each pod cover 131 of the lower sole portion 130 bulges in a manner corresponding to the pod 521 that it covers. As shown in FIGS. 35-37, for example, a plurality of bulges may be formed in the lower sole portion 130 generally along a central axis of the sole 100 and in a substantially linear arrangement. In some embodiments, the bulges of the lower sole portion may create a controlled rocking motion, or instability, during the gait cycle in both a medial to lateral direction and a heel to toe direction. The wearer's body may work to stabilize the gait, and by forcing the wearer's body to do so, the shoe may trigger increased training to the muscles such as those muscles in the wearer's calves, thighs, lower back, buttocks, and/or abdomen.

In one embodiment, the lower sole portion 130 includes one or more grooves 133 formed in a pod cover 131. In one embodiment, as shown, for example, in FIGS. 35-36, a pod cover 131 may include a plurality of grooves 133 formed therein in a concentric arrangement. In this manner, a plurality of concentric treads 134 may be separated by each groove 133 and may radiate from the center of the pod cover 131. In one embodiment, the grooves 133 may allow movement of the pod assembly 520 when under pressure during a gait cycle, and may enhance the controlled instability created by the bulges in the lower sole portion 130. In some embodiments, the grooves 133 may enhance a cushioning effect, and may provide a more fluid or soft feel to the wearer. In one embodiment, each groove 133 may have the same depth. In other embodiments, the grooves may have different depths. In some embodiments, a deeper groove 133 may allow the bulge in the lower sole portion 130 to more easily move under pressure during a gait cycle. The size, depth, and shape of the grooves 133 may be adapted to provide particular ride features, including, but not limited to, providing a more fluid or soft feel to the wearer.

Figure 38:
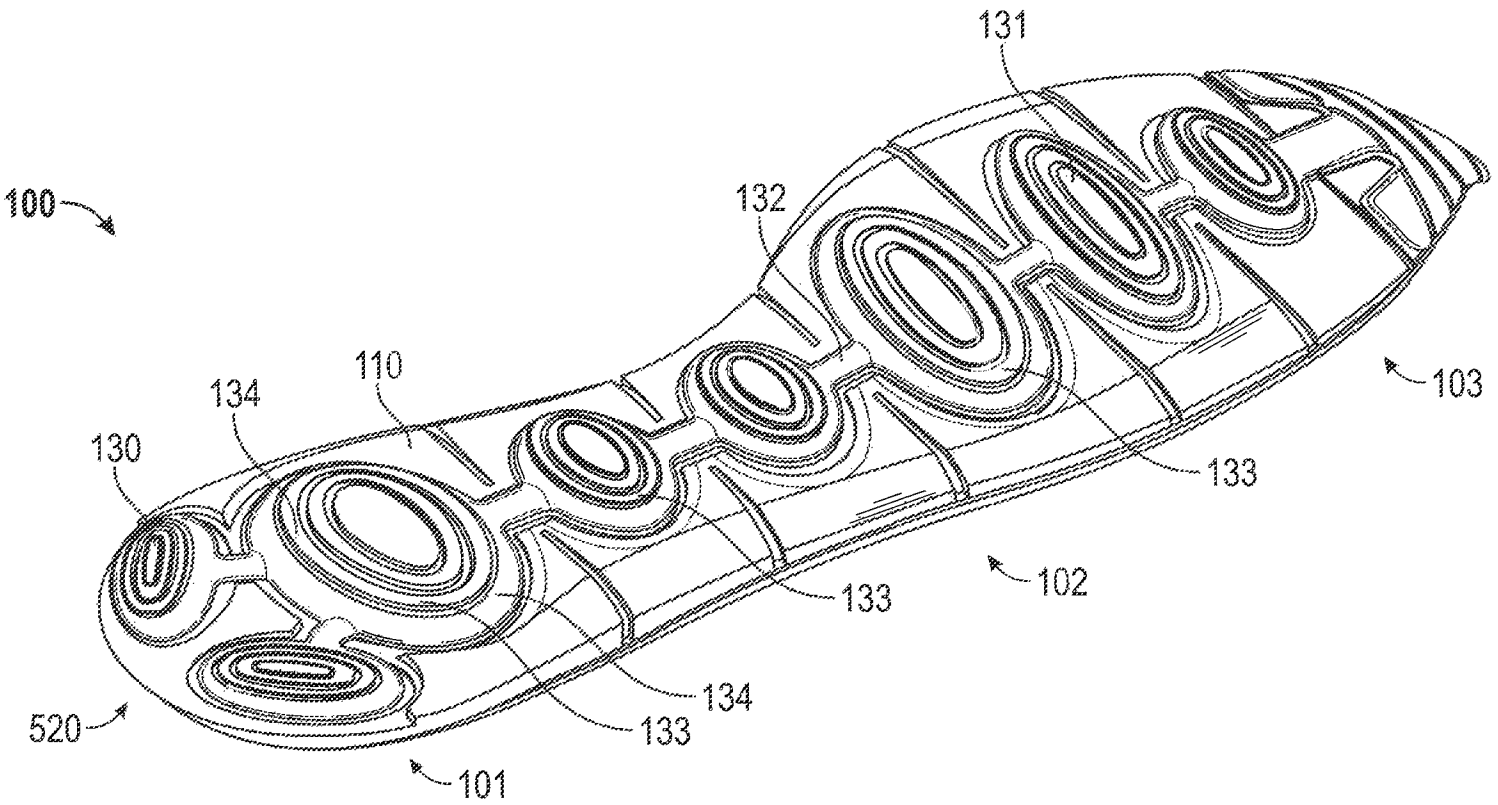
FIG. 38 is a perspective view of an article of footwear according to an embodiment of the present invention.
Figure 39:
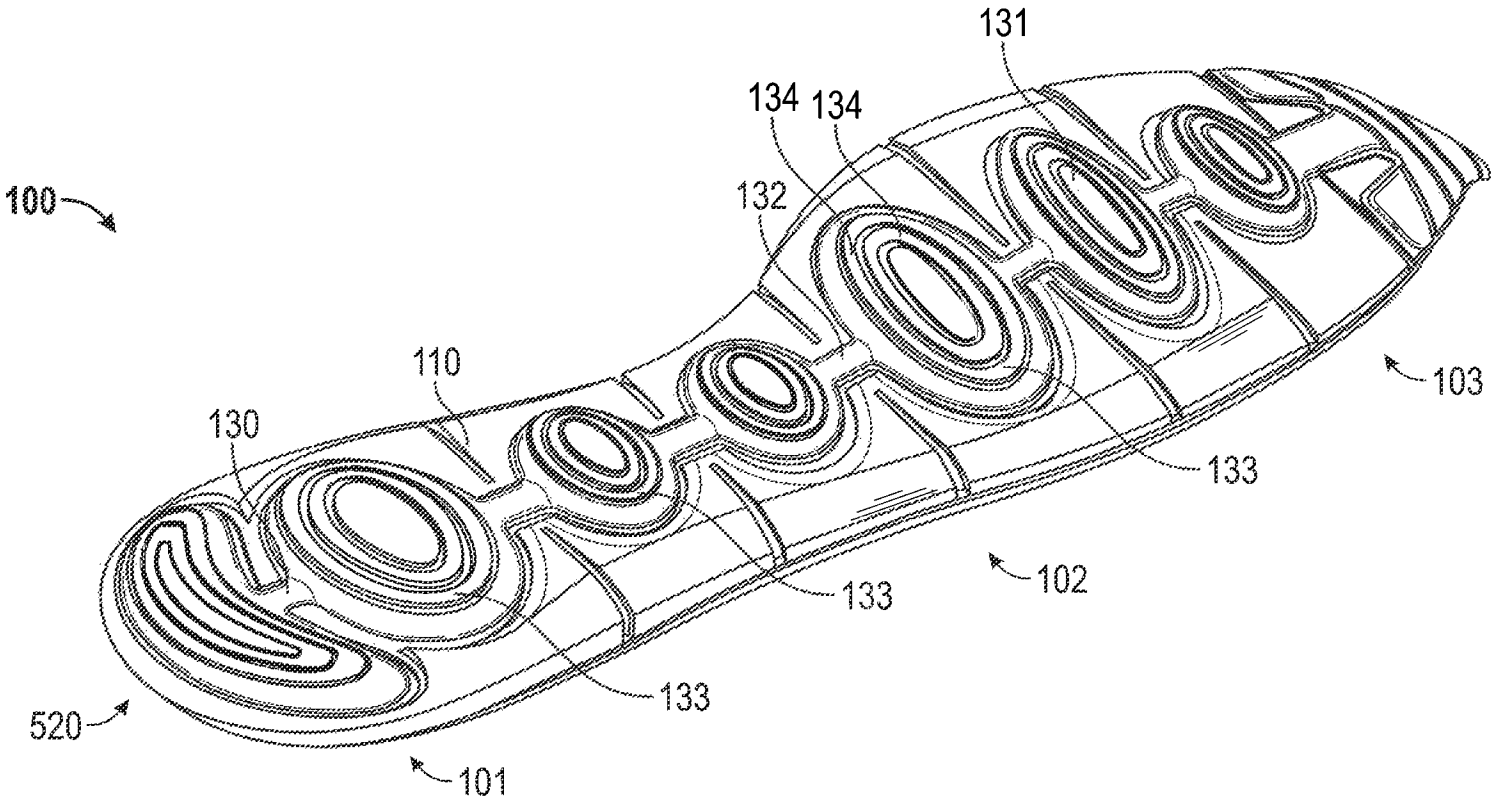
FIG. 39 is a perspective view of an article of footwear according to an embodiment of the present invention.
Figure 40:
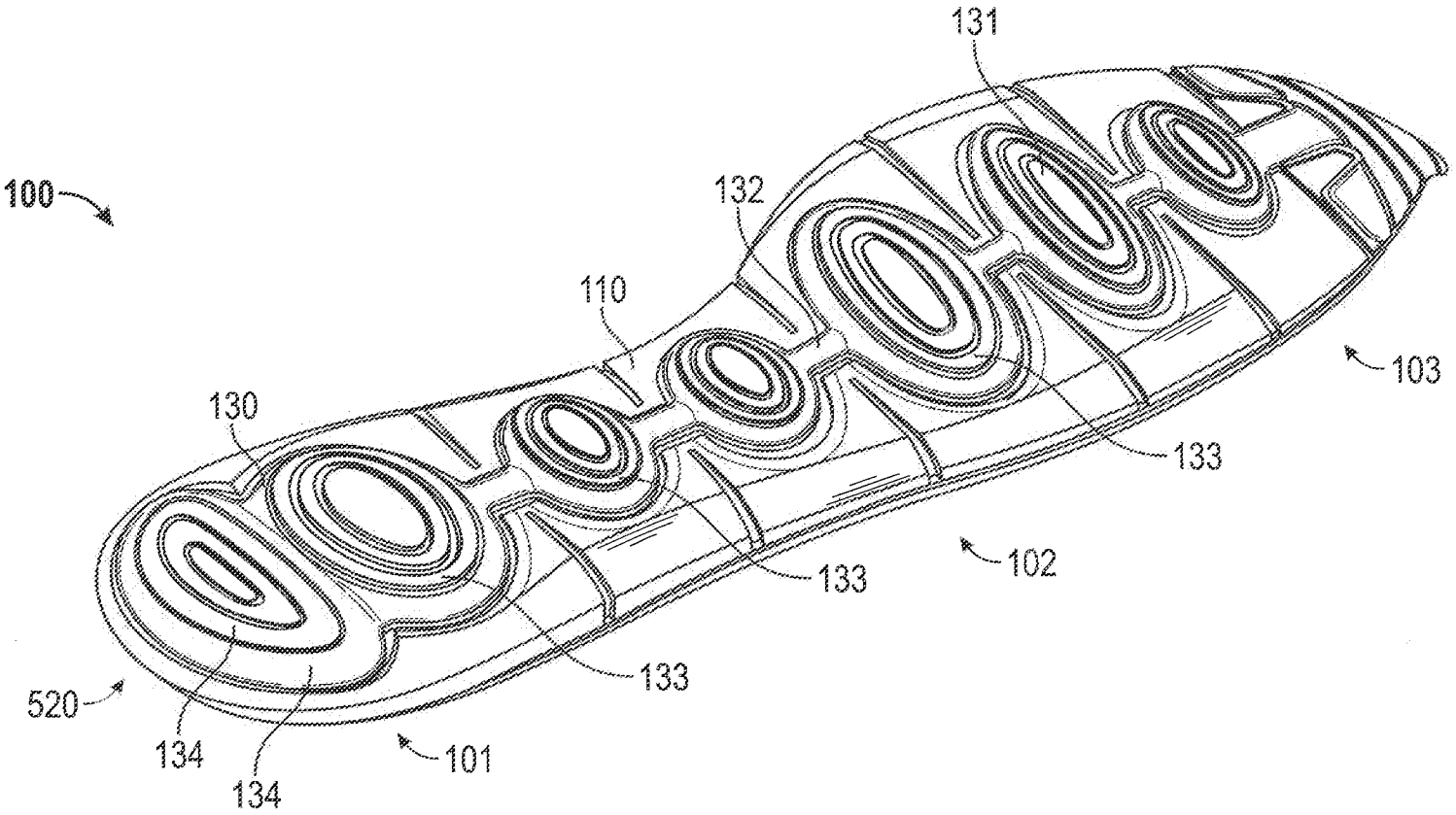
FIG. 40 is a perspective view of an article of footwear according to an embodiment of the present invention.
Figure 41:
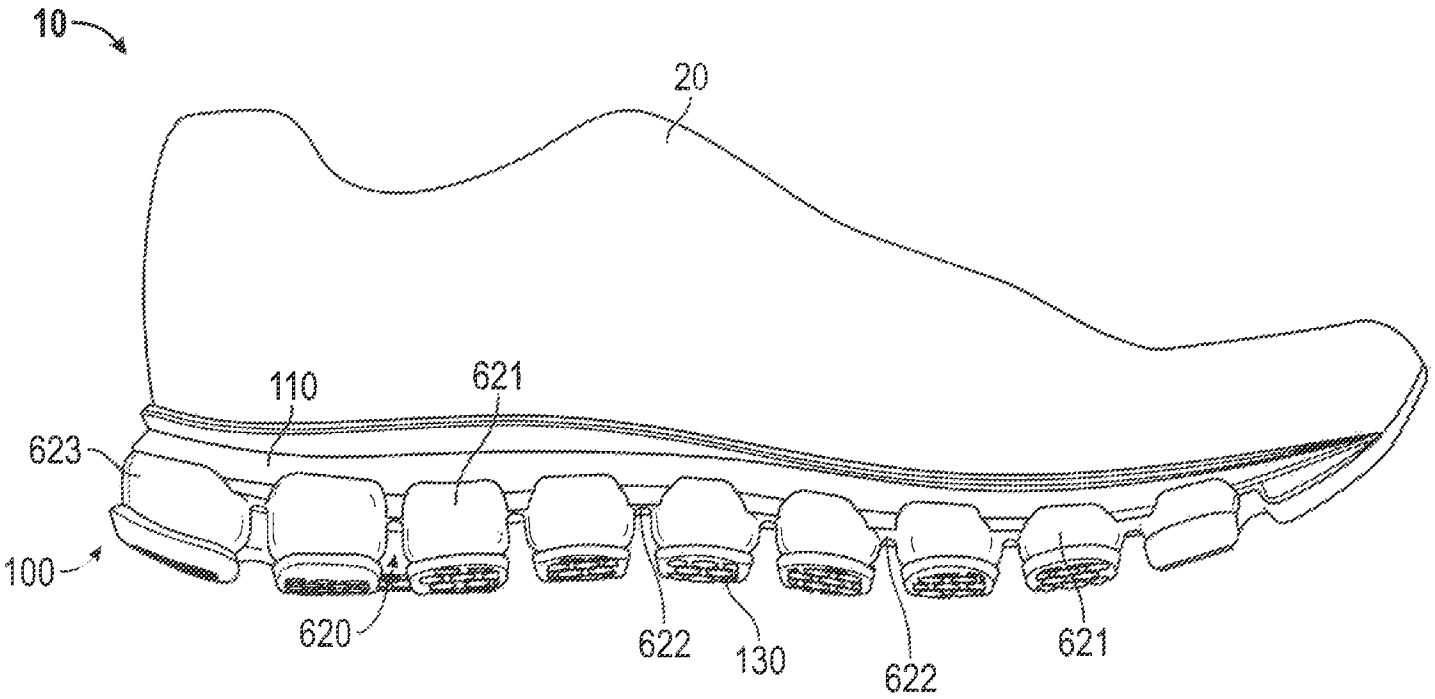
FIG. 41 is a lateral side view of an article of footwear having a sole according to an embodiment of the present invention.
Figure 42:
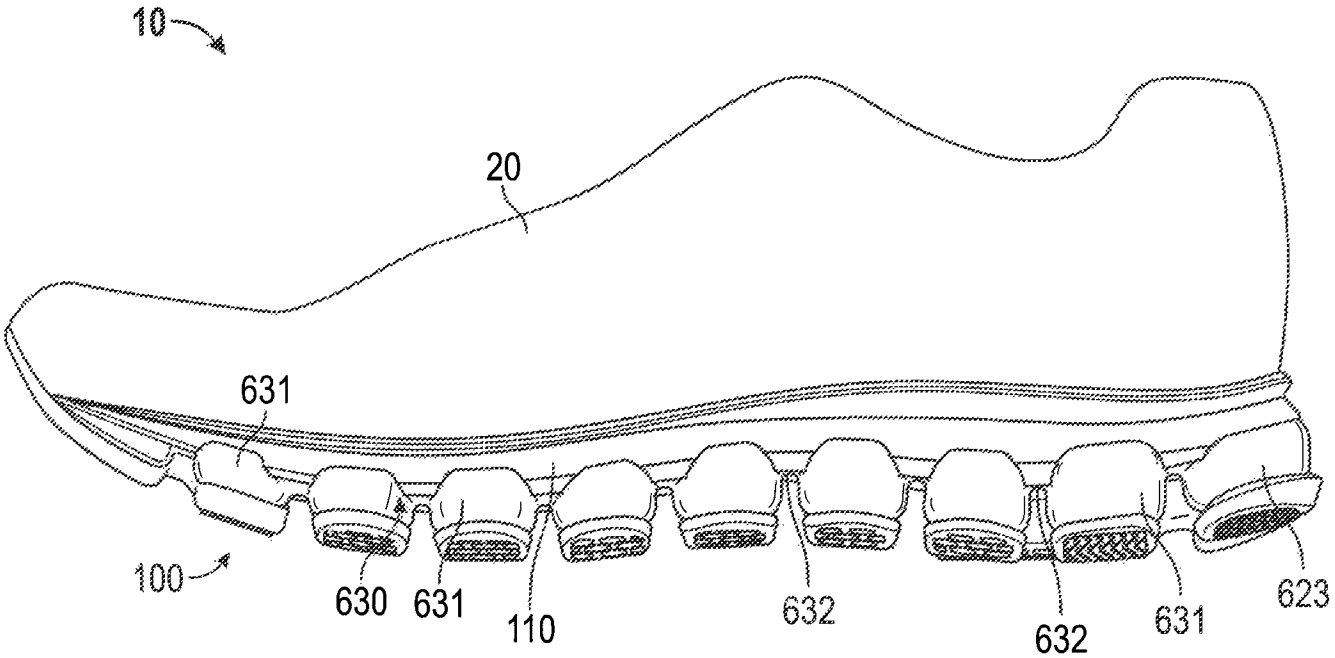
FIG. 42 is a medial side view of the article of footwear of FIG. 41 according to an embodiment of the present invention.

The number, size, arrangement, and shape of the pods 521 of the pod assembly 520 also may be varied to provide the desired ride characteristics. As shown in FIGS. 35 and 36, in one embodiment, the pod assembly 520 may include a large pod 521 in the heel region 101 of the sole. The pod assembly 520 may include pods 521 in the forefoot region 103, the arch or midfoot region 102, and/or the heel region 101. As shown in FIG. 38, in one embodiment pod assembly 520 may include a plurality of pods 521 in the heel region 101 of the sole. For example, two or more pods 521 may branch from a rearmost of a plurality of pods connected in series. As shown in FIG. 39, in one embodiment pod assembly 520 may include two large pods 521 in the heel region 101 in which one of the pods 521 is formed around the rear perimeter of the heel of the sole 100. In one embodiment, as shown in FIG. 40, two large heel pods 521 may be substantially joined together.

Another embodiment of the present invention will now be described with reference to FIGS. 41-44 in which like reference numerals may refer to like elements. The embodiment may include some or all of the features described above in connection with the embodiments of FIGS. 1-40. The sole 100 includes a first pod assembly 620 having a plurality of pods 621 fluidly connected by one or more passageways 622, and a second pod assembly 630 having a plurality of pods 631 fluidly connected by one or more passageways 632. In one embodiment, as shown for example in FIG. 43, the first pod assembly 620 may be a lateral pod assembly 620 extending from a heel region 101 of the sole 100 to a forefoot region 103 along a lateral side of the sole 100, and the second pod assembly 630 may be a medial pod assembly 630 extending from a heel region 101 of the sole 100 to a forefoot region 103 along a medial side of the sole 100.

The number, size, and shape of the pods 621 and 631 may be varied to provide the desired ride characteristics. In one embodiment, as shown, for example, in FIG. 43, the lateral pod assembly 620 may include nine pods 621 fluidly connected in series. In one embodiment, the lateral pod assembly 620 may terminate in a large heel pod 623. In one embodiment, the medial pod assembly 630 may include at least eight pods 631 fluidly connected in series. In one embodiment, one or more medial pods 631 may be connected to a central pod 633 disposed in a central portion of the heel region 101. In one embodiment, lateral pods 621 and medial pods 631 have a generally square or rectangular cross-section, as shown, for example, in FIGS. 41-44.

Figure 43:
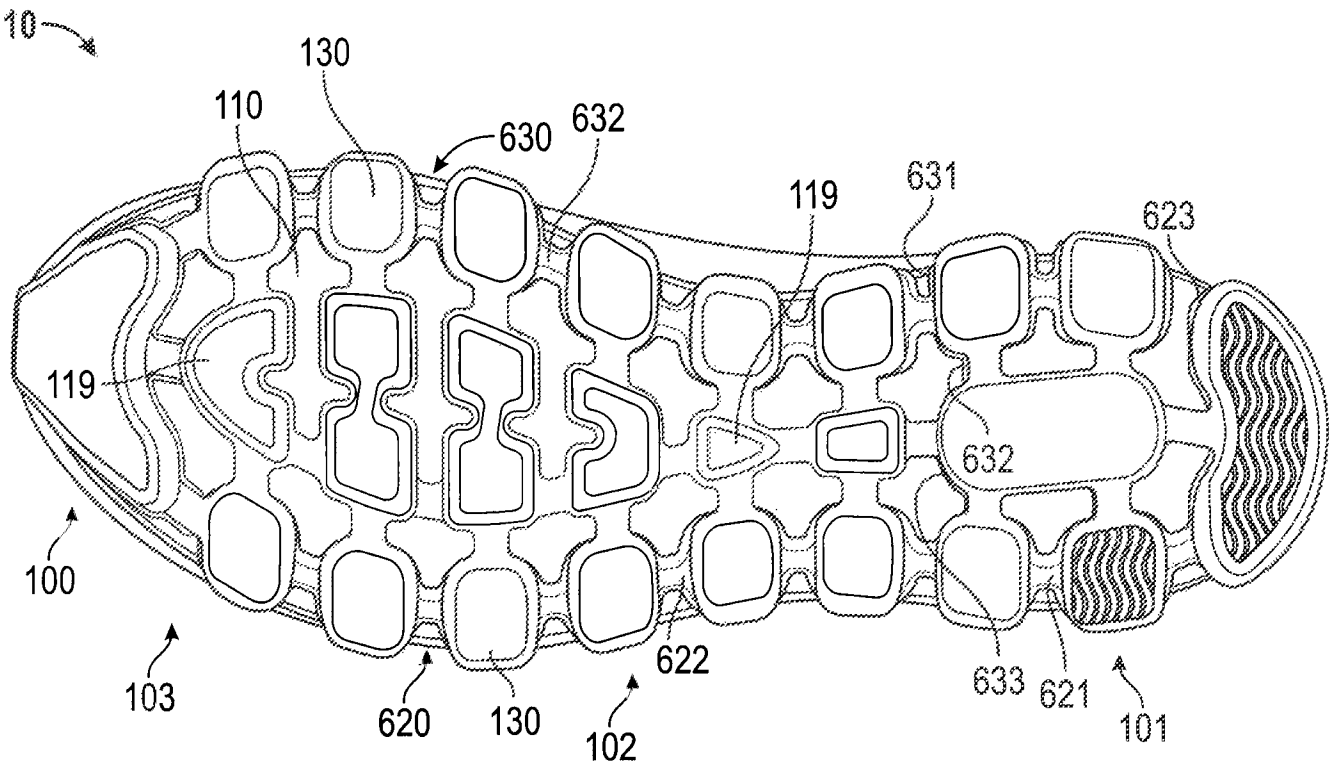
FIG. 43 is a bottom view of the article of footwear of FIG. 41 according to an embodiment of the present invention.
Figure 44:
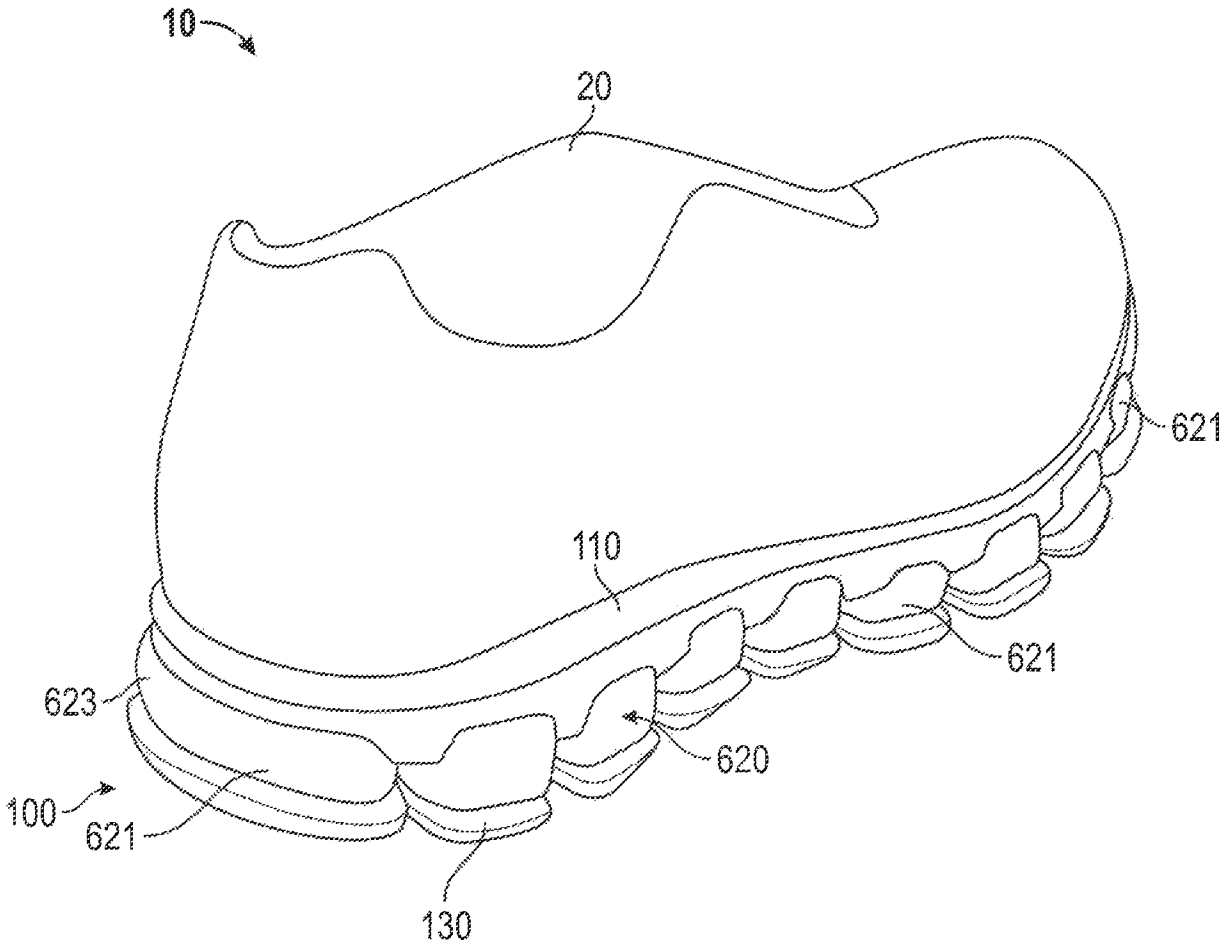
FIG. 44 is a rear lateral perspective view of the article of footwear of FIG. 41 according to an embodiment of the present invention.
Figure 45:
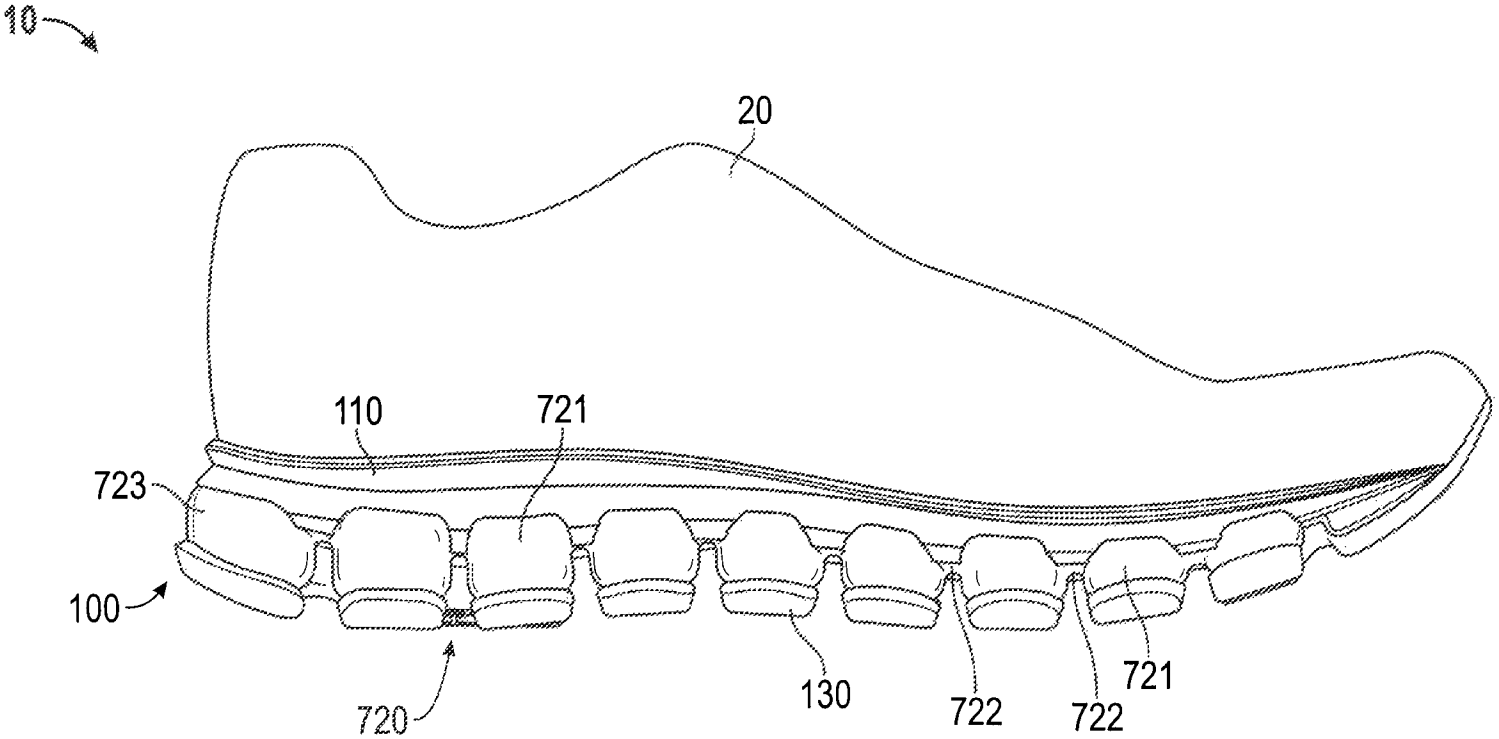
FIG. 45 is a lateral side view of an article of footwear having a sole according to an embodiment of the present invention.

In one embodiment, a portion of sole 100, for example, extending from the upper sole portion 110, may extend between the lateral pod assembly 620 and the medial pod assembly 630. For example, as shown in FIG. 43, one or more projections 119 may extend from the upper sole portion 110 between the lateral pod assembly 620 and the medial pod assembly 630. In embodiments in which upper sole portion 119 comprises foam, the one or more projections 119 may also comprise foam. In one embodiment, the projections 119 may be formed integrally with the upper sole portion 110. In another embodiment, the projections 119 may be formed separately from the upper sole portion 110 and attached thereto.

The number, size, and shape of the projections 119 may be varied to provide the desired ride characteristics. In one embodiment, as shown in FIG. 43, the projections 119 may be generally centrally located along a central axis of the sole 100. In one embodiment, the projections may be generally disposed in a substantially linear arrangement. In one embodiment, larger projections 119 may be disposed in the forefoot region 103 of the sole 100. For example, as shown in FIG. 43, a plurality of projections 119, including horseshoe shaped and dumbbell shaped projections 119, may form a generally oval pattern in the forefoot region 103 of the sole 100 generally associated with the ball of the foot of the wearer.

Another embodiment of the present invention will now be described with reference to FIGS. 45-50 in which like reference numerals may refer to like elements. The embodiment may include some or all of the features described above. The sole 100 includes a first pod assembly 720 having a plurality of pods 721 fluidly connected by one or more passageways 722, and a second pod assembly 730 having a plurality of pods 731 fluidly connected by one or more passageways 732. In one embodiment, as shown for example in FIG. 46, the first pod assembly 720 may be a lateral pod assembly 720 extending from a heel region 101 of the sole 100 to a forefoot region 103 along a lateral side of the sole 100, and the second pod assembly 730 may be a medial pod assembly 730 extending from as heel region 101 of the sole 100 to a forefoot region 103 along a medial side of the sole 100.

The number, size, and shape of the pods 721 and 731 may be varied to provide the desired ride characteristics. In one embodiment, as shown, for example, in FIGS. 47 and 48, the lateral pod assembly 720 may include nine pods 721 fluidly connected in series. In one embodiment, the lateral pod assembly 720 may terminate in a large heel pod 723. In one embodiment, the medial pod assembly 730 may include at least eight pods 731 fluidly connected in series. In one embodiment, lateral pods 721 and medial pods 731 have a generally square or rectangular cross-section, as shown, for example, in FIGS. 45-49.

Figure 46:
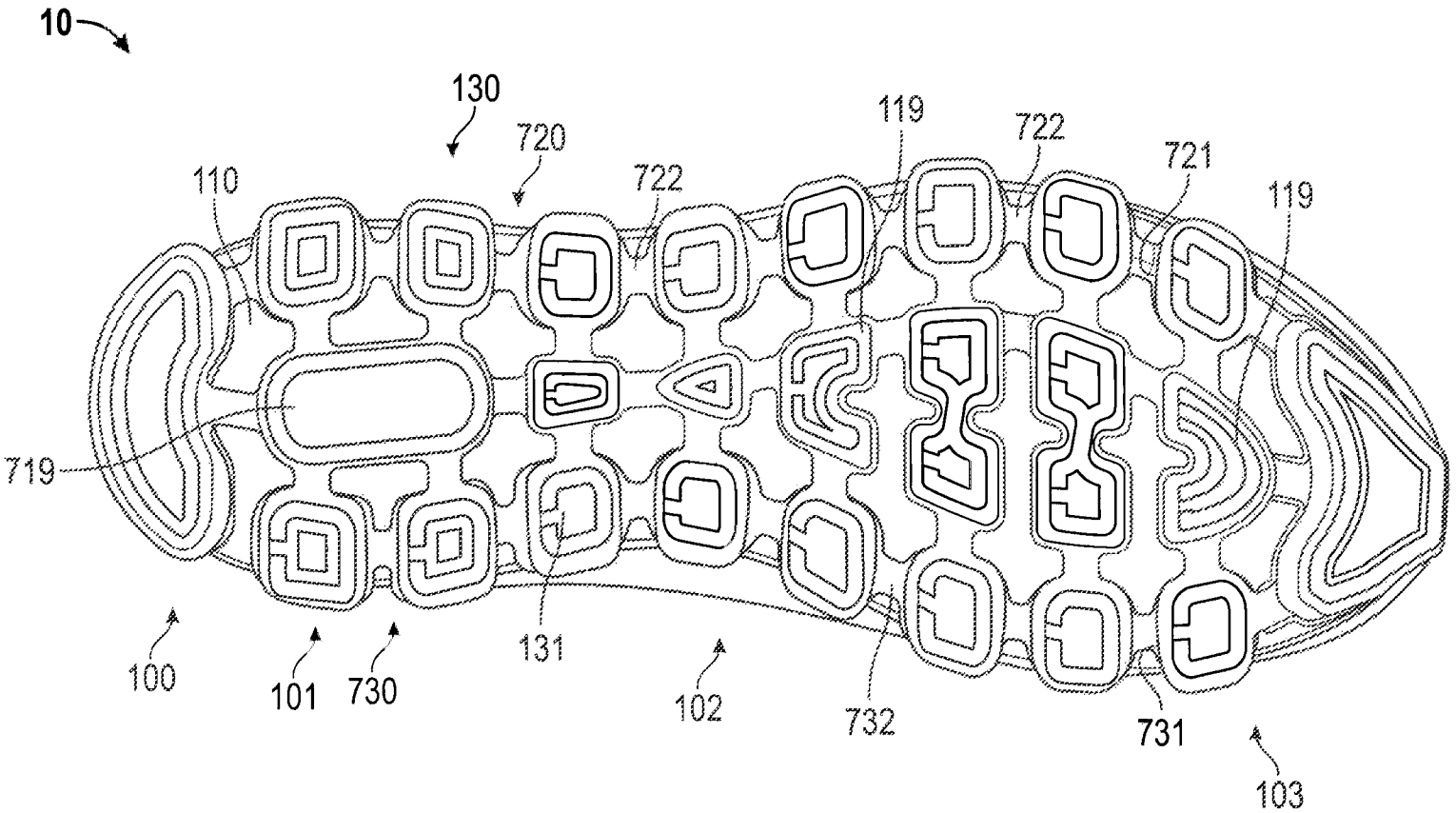
FIG. 46 is a bottom view of the article of footwear of FIG. 45 according to an embodiment of the present invention.
Figure 47:
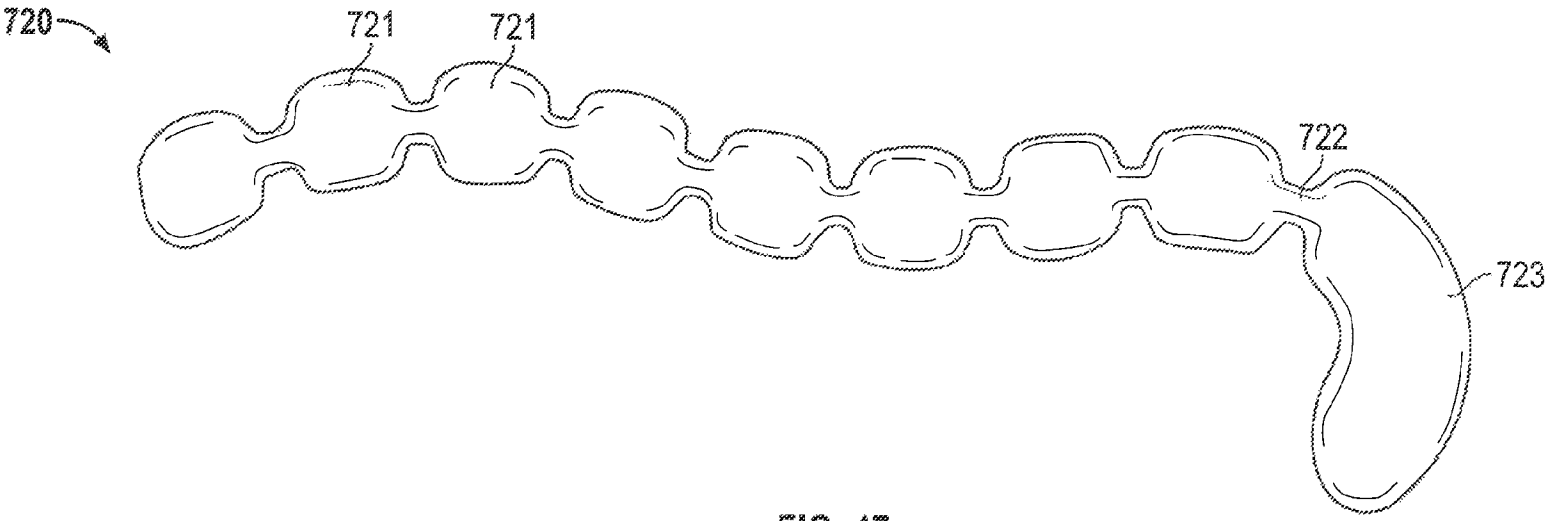
FIG. 47 is a top view of a lateral pod assembly of the article of footwear of FIG. 45 according to an embodiment of the present invention.
Figure 48:
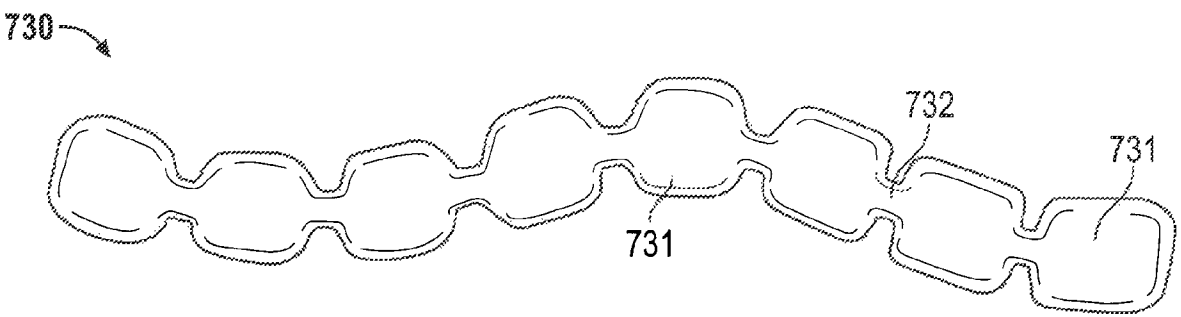
FIG. 48 is a top view of a medial pod assembly of the article of footwear of FIG. 45 according to an embodiment of the present invention.
Figure 49:
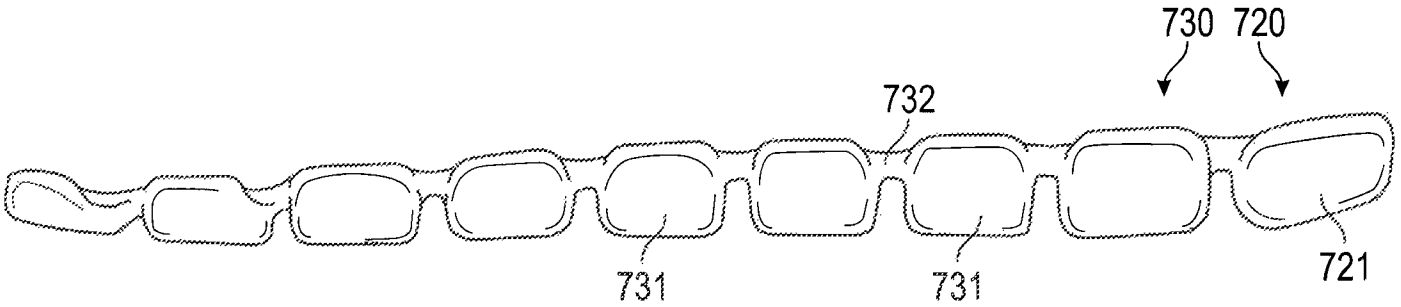
FIG. 49 is a side view of lateral and medial pod assemblies of the article of footwear of FIG. 45 according to an embodiment of the present invention.

In one embodiment, a portion of sole 100, for example, extending from the upper sole portion 110, may extend between the lateral pod assembly 720 and the medial pod assembly 730. For example, as shown in FIG. 46, one or more projections 119 may extend from the upper sole portion 110 between the lateral pod assembly 720 and the medial pod assembly 730. In embodiments in which upper sole portion 110 comprises foam, the one or more projections 119 may also comprise foam. In one embodiment, the projections 119 may be formed integrally with the upper sole portion 110. In another embodiment, the projections 119 may be formed separately from the upper sole portion 110 and attached thereto.

The number, size, and shape of the projections 119 may be varied to provide the desired ride characteristics. In one embodiment, as shown in FIG. 46, the projections 119 may be generally centrally located along a central axis of the sole 100. In one embodiment, the projections may be generally disposed in a substantially linear arrangement. In one embodiment, larger projections 119 may be disposed in the forefoot region 103 of the sole 100. For example, as shown in FIG. 46, a plurality of projections 119, including horseshoe shaped and dumbbell shaped projections 119, may form a generally oval pattern in the forefoot region 103 of the sole 100 generally associated with the ball of the foot of the wearer. In one embodiment, a large oval shaped projection 719 may be disposed in the heel region 101 proximate lateral heel pod 723.

Figure 50:
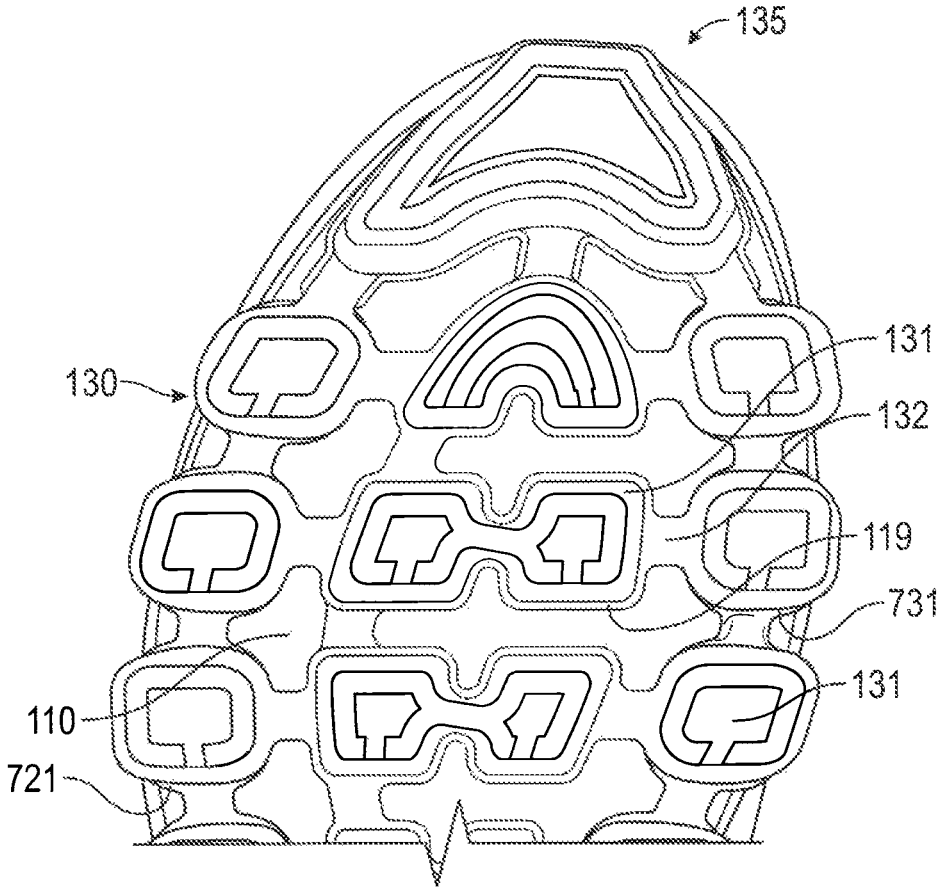
FIG. 50 is enlarged partial bottom view of a sole of the article of footwear of FIG. 45 according to an embodiment of the present invention.

In one embodiment, as best shown in FIGS. 46 and 50, lower sole portion 130 may include one or more covers 131 disposed on one or more of lateral pods 721, medial pods 731, and/or projections 119, and one or more passageway portions 132 connecting adjacent covers 131. In one embodiment, the covers 131 have a concave, cup-like shape to snugly cover the pods 721 and 731 and/or projections 119. In some embodiments, lower sole portion 130 may comprise an outsole and may include a ground contacting surface. In one embodiment, a plurality of covers 131 interconnected by passageway portions 132 may be integrally formed in a cover grouping 135. For example, as shown in FIG. 50, a cover 131 in a front toe region and a plurality of adjacent covers 131 may be formed together as a cover grouping 135 in a toe region.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A sole for an article of footwear, comprising:

a foam base having an exposed outer lateral edge;

a lateral pod assembly having a plurality of pods fluidly connected in series disposed below the foam base, wherein the lateral pod assembly extends from a heel portion of the sole to a forefoot portion of the sole along a lateral side of the sole; and a medial pod assembly having a plurality of pods fluidly connected in series disposed below the foam base, wherein the medial pod assembly extends from the heel portion of the sole to the forefoot portion of the sole along a medial side of the sole, wherein a portion of the foam base comprising a plurality of discrete foam projections extends between the lateral pod assembly and the medial pod assembly, and wherein the lateral pod assembly extends laterally beyond the exposed outer lateral edge of the foam base, the plurality of pods of the lateral pod assembly forming a sidewall of the sole.

2. The sole of claim 1, wherein the foam base extends between the lateral pod assembly and the medial pod assembly in the forefoot portion of the sole.

3. The sole of claim 1, wherein the lateral pod assembly includes greater than 5 pods.

4. The sole of claim 1, wherein the lateral pod assembly includes greater than 6 pods.

5. The sole of claim 1, wherein the lateral pod assembly includes 9 pods.

6. The sole of claim 1, wherein the lateral pod assembly and the medial pod assembly each include greater than 5 pods.

7. The sole of claim 1, wherein the lateral pod assembly and the medial pod assembly are not fluidly connected.

8. The sole of claim 1, wherein the plurality of lateral pods are rectangular in shape.

9. The sole of claim 1, wherein the plurality of lateral pods are square in shape.

10. The sole of claim 1, wherein the lateral pod assembly includes a heel pod.

11. The sole of claim 1, wherein the plurality of pods of the lateral pod assembly are fluidly connected in a substantially linear arrangement.

12. The sole of claim 1, wherein the lateral pod assembly, the medial pod assembly, and the portion of the foam base form three longitudinal rows of projections.

13. The sole of claim 1, wherein there is a gap between the lateral pod assembly and the portion of the foam base.

14. A sole for an article of footwear, comprising:

an upper sole having an exposed outer lateral edge and a base with a heel region, a midfoot region, and a toe region;

a first pod assembly disposed below the upper sole, the first pod assembly having at least five pods fluidly connected in series extending from the heel region to the toe region, the at least five pods forming a sidewall of the sole that extends laterally beyond the exposed outer lateral edge of the upper sole; and a second pod assembly disposed below the upper sole, the second pod assembly having at least five pods fluidly connected in series extending from the heel region to the toe region, wherein a portion of the upper sole from the midfoot region to the toe region extends from the base between the first pod assembly and the second pod assembly, and wherein the portion of the upper sole extending from the base comprises a plurality of discrete foam projections.

15. The sole of claim 14, wherein the second pod assembly extends from the heel region to the toe region along an outer medial edge of the sole.

16. The sole of claim 14, further comprising a lower sole, wherein the first pod assembly is disposed between the upper sole and the lower sole.

17. The sole of claim 14, wherein the upper sole comprises foam.

18. The sole of claim 14, wherein the plurality of pods of the first pod assembly are fluidly connected in a substantially linear arrangement.

19. The sole of claim 14, wherein the plurality of pods of the first pod assembly are rectangular.

20. The sole of claim 14, wherein the first pod assembly and the second pod assembly are not fluidly connected.

21. The sole of claim 14, wherein the portion of the upper sole extending from the base is disposed substantially along a central longitudinal axis of the base.

22. The sole of claim 14, wherein the portion of the upper sole extending from the base is from the heel region to the toe region.

23. An article of footwear, comprising:

an upper; and a sole coupled to the upper, the sole comprising:

a base with a heel region, a midfoot region, and a toe region, the base forming an exposed outer medial edge;

a lateral pod assembly disposed below the base, the lateral pod assembly having at least five pods fluidly connected in series extending from the heel region to the toe region along an outer lateral side of the sole; and a medial pod assembly disposed below the base, the medial pod assembly having at least five pods fluidly connected in series extending from the heel region to the toe region along an outer medial side of the sole, the at least five pods forming a sidewall of the sole that extends medially beyond the exposed outer medial edge of the base, wherein a portion of the sole extends from the base from the midfoot region to the toe region between the lateral pod assembly and the medial pod assembly, and wherein the portion of the upper sole extending from the base comprises a plurality of discrete foam projections.

* * * * *